US006502816B2

(12) United States Patent
Inoue et al.

(10) Patent No.: US 6,502,816 B2
(45) Date of Patent: Jan. 7, 2003

(54) SHEET FEEDING APPARATUS AND IMAGE FORMING APPARATUS HAVING SAME

(75) Inventors: Ryukichi Inoue, Abiko (JP); Yoshiyuki Yamazaki, Toride (JP); Yoshihiro Matsuo, Boise, ID (US); Masayuki Fukuda, Toride (JP); Ryuichi Kojima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/801,818

(22) Filed: Mar. 9, 2001

(65) Prior Publication Data

US 2002/0008348 A1 Jan. 24, 2002

(30) Foreign Application Priority Data

Mar. 13, 2000 (JP) ..... 2000-069338
Apr. 13, 2000 (JP) ..... 2000-112136
Feb. 20, 2001 (JP) ..... 2001-044123

(51) Int. Cl.[7] ..... B65H 3/52
(52) U.S. Cl. ..... 271/121; 271/124; 271/167
(58) Field of Search ..... 271/121, 124, 271/167

(56) References Cited

U.S. PATENT DOCUMENTS 5,253,854 A 10/1993 Tanoue et al. ..... 271/10
5,292,116 A 3/1994 Inoue et al. ..... 271/157
5,358,230 A 10/1994 Ikemori et al. ..... 271/114
5,527,029 A * 6/1996 Bortolotti et al. ..... 271/124
5,651,540 A 7/1997 Watanabe et al. ..... 271/10.12
5,823,524 A * 10/1998 Kawada ..... 271/124
5,907,745 A 5/1999 Azuma et al. ..... 399/92
5,927,702 A 7/1999 Ishii et al. ..... 271/9.09
6,055,407 A 4/2000 Inoue et al. ..... 399/381
6,070,867 A 6/2000 Tsurumi et al. ..... 271/114
6,116,589 A * 9/2000 Bortolotti ..... 271/121
6,139,007 A * 10/2000 Cahill et al. ..... 271/121
6,158,733 A * 12/2000 Muraki ..... 271/124
6,273,416 B1 * 8/2001 Watanabe et al. ..... 271/121
6,308,947 B1 * 10/2001 Kojima et al. ..... 271/124
6,375,183 B1 * 4/2002 Inoue et al. ..... 271/121

* cited by examiner

*Primary Examiner*—H. Grant Skaggs
(74) *Attorney, Agent, or Firm*—Fitzpatrick, Cella, Harper & Scinto

(57) ABSTRACT

An object of the present invention is to provide a sheet feeding apparatus in which double-feeding of thin sheets can be prevented positively and a thick sheet can be fed positively. To achieve the above object, the present invention provides a sheet feeding apparatus comprising sheet feeding means abutting against a sheet contained in sheet containing means to feed out the sheet, and a separating inclined surface for separating and feeding the sheet fed out by the sheet feeding means one by one, wherein the separating inclined surface can be shifted along a sheet advancing direction with the sheet fed out by the sheet feeding means.

27 Claims, 38 Drawing Sheets

WHEN SHEET FEEDING MOTION IS EFFECTED

AFTER SHEET FEEDING MOTION IS EFFECTED

SHEET FEEDING APPARATUS AND IMAGE FORMING APPARATUS HAVING SAME

BACKGROUND OF THE INVENTION

1. Field of the Invention

The present invention relates to a sheet feeding apparatus and an image forming apparatus having such a sheet feeding apparatus, and more particularly, it relates to a sheet feeding apparatus in which sheets are separated by using a separating inclined surface.

2. Related Background Art

In conventional image forming apparatuses such as printers, copying machines, facsimile apparatuses and the like, there is provided a sheet feeding apparatus for feeding a sheet to an image forming portion. Among such sheet feeding apparatuses, there is a sheet feeding apparatus in which sheets are separated one by one by a separating inclined surface to be supplied to the image forming portion.

FIG. 41 is a schematic constructural view of an image forming apparatus having such a conventional sheet feeding apparatus. In FIG. 41, the image forming apparatus 100 includes a sheet feeding tray 101 having a horizontal sheet stacking surface 101*a*, and a separating inclined surface 102 disposed at an end of the sheet feeding tray 101 in a sheet feeding direction. The separating inclined surface 102 is inclined with respect to a sheet (stack) S by an angle of θ (obtuse angle). Incidentally, there is further provided a trailing end regulating member 120 for supporting a trailing end of the sheet (stack) S rested on the sheet stacking surface, and a position of such a member can be adjusted.

The sheet feeding apparatus includes a sheet feeding roller 103 to which a gear 103*a* is integrally formed, a sheet feeding roller arm 105 adapted to rotatably support the sheet feeding roller 103 and rotatably held on a driving shaft 104, a driving gear 106 secured to the driving shaft 104, and idler gears 107*a* to 107*d* held on the sheet feeding roller arm 105 and serving to transmit a driving force of the driving gear 106 to the sheet feeding roller 103. Incidentally, the driving shaft 104 is driven by a controllable driving mechanism (not shown) so that start and stop of an sheet feeding operation can be controlled by the driving of the driving shaft 104.

There are further provided a conveying sub-roller 109 urged against a conveying roller 108 with predetermined pressure by means of biasing means (not shown) (the sheet S fed out by the sheet feeding roller 103 is conveyed by rotations of the conveying roller 108 and the conveying sub-roller 109), an upper surface conveying guide 111 for guiding an upper surface of the sheet, and a lower surface conveying guide 110 for guiding a lower surface of the sheet. The sheet feeding tray 101, sheet feeding roller 103, sheet feeding roller arm 105 and the like constitute the sheet feeding apparatus 100A.

On the other hand, in FIG. 41, there are further provided a photosensitive drum 112, a toner cartridge 113 for integrally holding the photosensitive drum 112 and image developing means (not shown), a laser scanner 114 for forming a latent image on the photosensitive drum by exposing the surface of the photosensitive drum, and a transfer roller 115 for transferring a toner image (formed on the photosensitive drum by developing the latent image formed on the photosensitive drum in the toner cartridge) onto the sheet S. The photosensitive drum 112 and the transfer roller 115 are parts of an image forming portion 100B.

There are further provided a fixing device 116 for fixing the toner image transferred by the transfer roller 115 onto the sheet S, a sheet discharging roller pair 117 for conveying the sheet S to which the toner image was fixed, a sheet discharging roller pair 118 for discharging the sheet S out of the image forming apparatus, and a sheet discharge tray 119 on which the sheet S is discharged.

When image formation is effected in the image forming apparatus 100 having the above mentioned construction, first of all, the latent image is formed on the surface of the photosensitive drum 112 by the exposure effected by the laser scanner 114, and, thereafter, the toner image is formed on the surface of the photosensitive drum by developing the latent image by means of the image developing means provided in the toner cartridge 113.

On the other hand, in synchronous with the above operation, the driving shaft 104 is rotated by the driving mechanism (not shown), and the rotation of the driving shaft is transmitted to the gear 103*a* of the sheet feeding roller 103 via the idler gears 107*a* to 107*d* born on the sheet feeding roller arm 105, thereby starting to rotate the sheet feeding roller 103.

By the way, as shown in FIG. 42, since the sheet feeding roller 103 is urged against an upper surface of an uppermost sheet S1 included in the sheet stack S (referred to as "uppermost sheet" hereinafter) rested on the sheet stacking surface, when the rotation of the sheet feeding roller 103 is started in this way, a feeding force Fp due to a friction force acts on the uppermost sheet S1. Further, at the same time, the uppermost sheet S1 is subjected to a friction force Fs12 as a resistance force from an underlying next sheet S2.

As a result, the uppermost sheet S1 abuts against the separating inclined surface 102 and is subjected to a reaction force R1 from the separating inclined surface 102, with the result that a leading end portion of the uppermost sheet is bent upwardly. Thereafter, when the sheet feeding roller 103 is further rotated, the bent sheet S1 is further advanced while abutting the leading end thereof against the separating inclined surface. Incidentally, since the next sheet S2 is subjected to a friction force Fs23 from an underlying sheet S3, the next sheet does not advance together with the uppermost sheet S1, thereby preventing double-feeding.

The uppermost sheet S1 separated and fed by the sheet feeding roller 103 and the separating inclined surface 102 in this way is conveyed by the rotations of the conveying roller 108 and the conveying sub-roller 109 shown in FIG. 41 and is sent to a nip between the photosensitive drum 112 and the transfer roller 115.

Thereafter, the toner image formed on the photosensitive drum is transferred onto the sheet S1 (sent to the nip between the photosensitive drum 112 and the transfer roller 115) by the transfer roller 115, and the sheet S1 to which the toner image was transferred in this way is conveyed to the fixing device 116. After the toner image was fixed in the fixing device 116, the sheet S1 is discharged out of a main body 100C of the image forming apparatus and is rested on the sheet discharge tray 119.

By the way, in such a conventional sheet feeding apparatus and image forming apparatus having the sheet feeding apparatus, as mentioned above, the prevention of the double-feeding of sheets relies upon deformation resistance of the sheet and the friction force between the sheets.

Thus, for example, when new sheets are replenished before the previously replenished sheets are used up, if coefficient of friction in the interface between the newly replenished sheet and the previously existing sheet is lower than coefficient of friction before other sheets, the sheet separation will be effected only by the deformation resistance of the sheet on the separating inclined surface 102, with the result that, regarding sheets having low resiliency such as thin sheets, double-feeding may occur frequently in such an interface.

In order to prevent the double-feeding of thin sheets efficiently, for example, although there has been proposed a technique in which a distance between the sheet feeding roller 103 and the separating inclined surface 102 is decreased, if such a technique is used, the double-feeding of thin sheets can be prevented, but, a force required for feeding a thick sheet will become insufficient, thereby causing poor sheet feeding.

SUMMARY OF THE INVENTION

The present invention is made in consideration of the above-mentioned circumstances, and an object of the present invention is to provide a sheet feeding apparatus in which double feeding of thin sheets can be prevented positively and a thick sheet can be fed positively.

To achieve the above object, the present invention provides a sheet feeding apparatus comprising sheet feeding means abutting against a sheet contained in sheet containing means to feed out the sheet, and a separating inclined surface for separating and feeding the sheet fed out by the sheet feeding means one by one, wherein the separating inclined surface can be shifted along a sheet advancing direction with the sheet fed out by the sheet feeding means.

DESCRIPTION OF THE PREFERRED EMBODIMENTS

The present invention will now be fully explained in connection with embodiments thereof with reference to the accompanying drawings.

Figure 1:
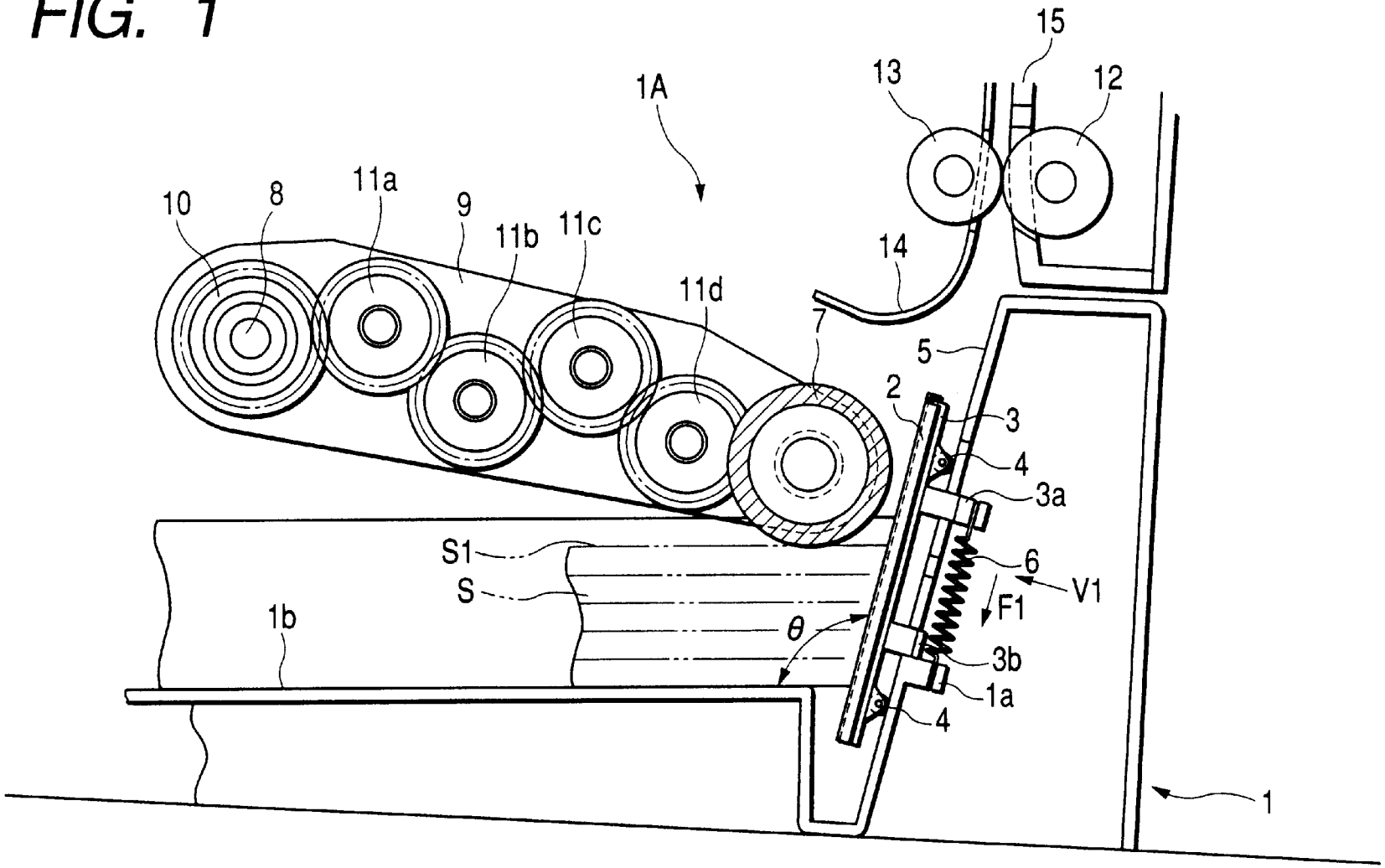
FIG. 1 is a view for explaining a construction of a sheet feeding apparatus according to a first embodiment of the present invention.
Figure 2:
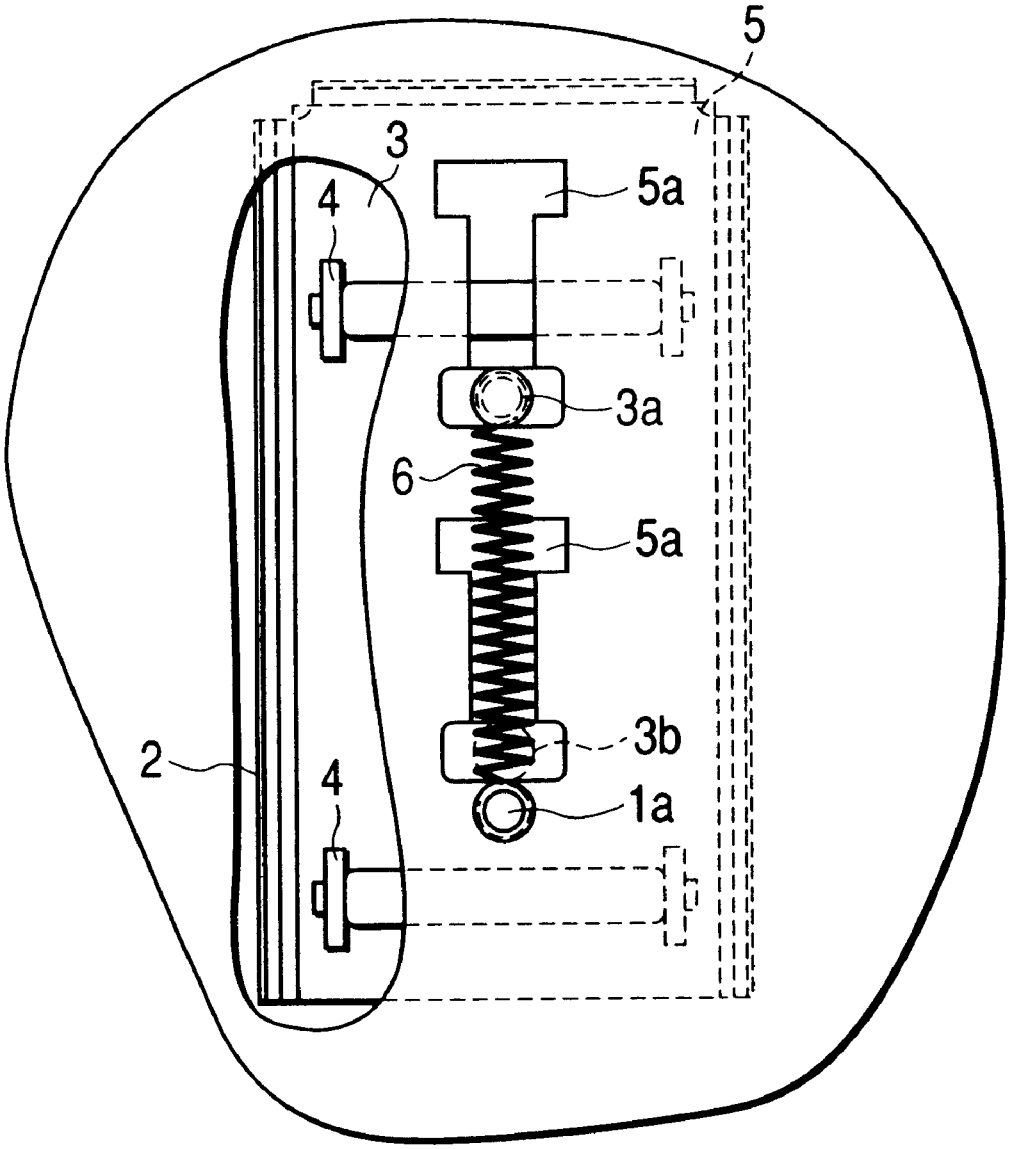
FIG. 2 is a view looked at from a direction shown by the arrow V1 in FIG. 1.

FIG. 1 is a view for explaining a construction of a sheet feeding apparatus according to a first embodiment of the present invention, and FIG. 2 is a view looked at from a direction shown by the arrow V1 in FIG. 1. In FIGS. 1 and 2, a sheet feeding apparatus 1A includes a sheet feeding tray 1 as sheet containing means having fixed sheet stacking surface 1*b* designed so that a sheet feeding end thereof becomes higher than the other end, and a separating inclined surface 2 disposed at the sheet feeding end of a sheet containing portion (for containing sheets) of the sheet feeding tray 1 and is inclined with respect to a rested sheet stack S by an angle θ.

There are further provided an inclined surface holding member 3 for holding the separating inclined surface 2, and sliding sub-rollers 4 rotatably attached to the inclined surface holding member 3. Incidentally, in the illustrated embodiment, although two pairs of sliding sub-rollers 4 are attached to the inclined surface holding member 3, the number of the sliding sub-rollers 4 is not limited to four so long as the inclined surface holding member 3 can be shifted smoothly.

The inclined surface holding member 3 can be shifted, via the sliding sub-rollers 4, along a fixed inclined surface reference surface 5 disposed at the sheet feeding end of the sheet feeding tray 1 in parallel with a sheet abut surface (against which the sheet stack abuts) of the separating inclined surface 2. With this arrangement, the separating inclined surface 2 can be shifted toward and away from a sheet advancing direction.

The reference numeral 6 denotes an inclined surface spring as an elastic member; 3*a* denotes a spring receiving movable boss provided on the inclined surface holding member 3 and adapted to hold one end of the inclined surface spring 6; 1*a* denotes a spring receiving fixed boss provided on the sheet feeding tray 1 and adapted to hold the other end of the inclined surface spring 6; and 3*b* denotes a slidable dislodgment preventing boss for cooperating with the spring receiving movable boss 3*a* to prevent dislodgment of the inclined surface holding member 3 with respect to the inclined surface reference surface 5. The spring receiving movable boss 3*a* and the dislodgment preventing boss 3*b* are inserted into guide slits 5*a* formed in the inclined surface reference surface 5, and the prevention of dislodgment is performed by flanges formed on the spring receiving movable boss 3*a* and the dislodgment preventing boss 3*b*. Incidentally, the guide slits 5*a* are provided at their upper parts with enlarged openings through which the flanges of the bosses are inserted.

Incidentally, FIG. 1 shows a condition that the inclined surface holding member 3 is positioned at an initial position before a sheet feeding operation is started, and, in this condition, the inclined surface spring 6 pulls the inclined surface holding member 3 by a predetermined force F1. Further, in this case, the spring receiving movable boss 3*a* and the dislodgment preventing boss 3*b* abut against lower ends of the guide slits 5*a* formed in the inclined surface reference surface 5 as shown in FIG. 2, with the result that the inclined surface holding member 3 is held on the inclined surface reference surface 5 while being pulled by the predetermined force F1 of the inclined surface spring 6.

There are further provided a sheet feeding roller (sheet feeding means) 7 integrally holding a gear (not shown), a driving shaft 8, a sheet feeding roller arm 8 for rotatably holding the sheet feeding roller 7 and rotatably held on the driving shaft 8, a driving gear 10 secured to the driving shaft 8, and idler gears 11*a*, 11*b*, 11*c*, 11*d* held by the sheet feeding roller arm 9 and adapted to transmit a driving force of the driving gear 10 to the sheet feeding roller 7. Incidentally, the driving shaft 8 receives a driving force from a controllable driving mechanism (not shown) so that start and stop of the sheet feeding operation can be controlled.

There are further provided a conveying roller 12 rotated by a driving force from a driving portion (not shown), a conveying sub-roller 13 urged against the conveying roller 12 with predetermined pressure by biasing means (not shown) (the fed sheet is conveyed by these rollers 12, 13), an upper conveying guide 14 for guiding an upper surface of the sheet, and a lower conveying guide 15 for guiding a lower surface of the sheet. Incidentally, in the illustrated embodiment, disposition of the sheet feeding roller 7 and the inclination angle θ between the separating inclined surface 2 and the sheet (stack) S are appropriately selected to prevent double-feeding of thin sheets. Further, since the separating inclined surface 2 cannot be laid down greatly in order to transfer the sheet to a conveying path constituted by the upper conveying guide 14 and the lower conveying guide 15 for conveying the sheet in a vertical direction, the sheet stacking surface 1*b* is designed so that a sheet feeding end thereof becomes higher than the other end to maintain the inclination angle θ.

Next, a sheet separating operation of the sheet feeding apparatus 1A having the above-mentioned construction will be explained. When the sheet feeding operation is started, the driving shaft 8 and the driving gear 10 are drivingly rotated by the driving force from the driving mechanism (not shown). The rotation of the driving gear is transmitted to the sheet feeding roller 7 through the idler gears 11*a*, 11*b*, 11*c*, 11*d* held by the sheet feeding roller arm 9, thereby starting rotation of the sheet feeding roller 7.

Since the sheet feeding roller 7 abuts against an upper surface of an uppermost sheet S1 included in the sheet (stack) S, when the rotation of the sheet feeding roller 7 is started, a feeding force due to a friction force acts on the uppermost sheet S1.

Figure 3:
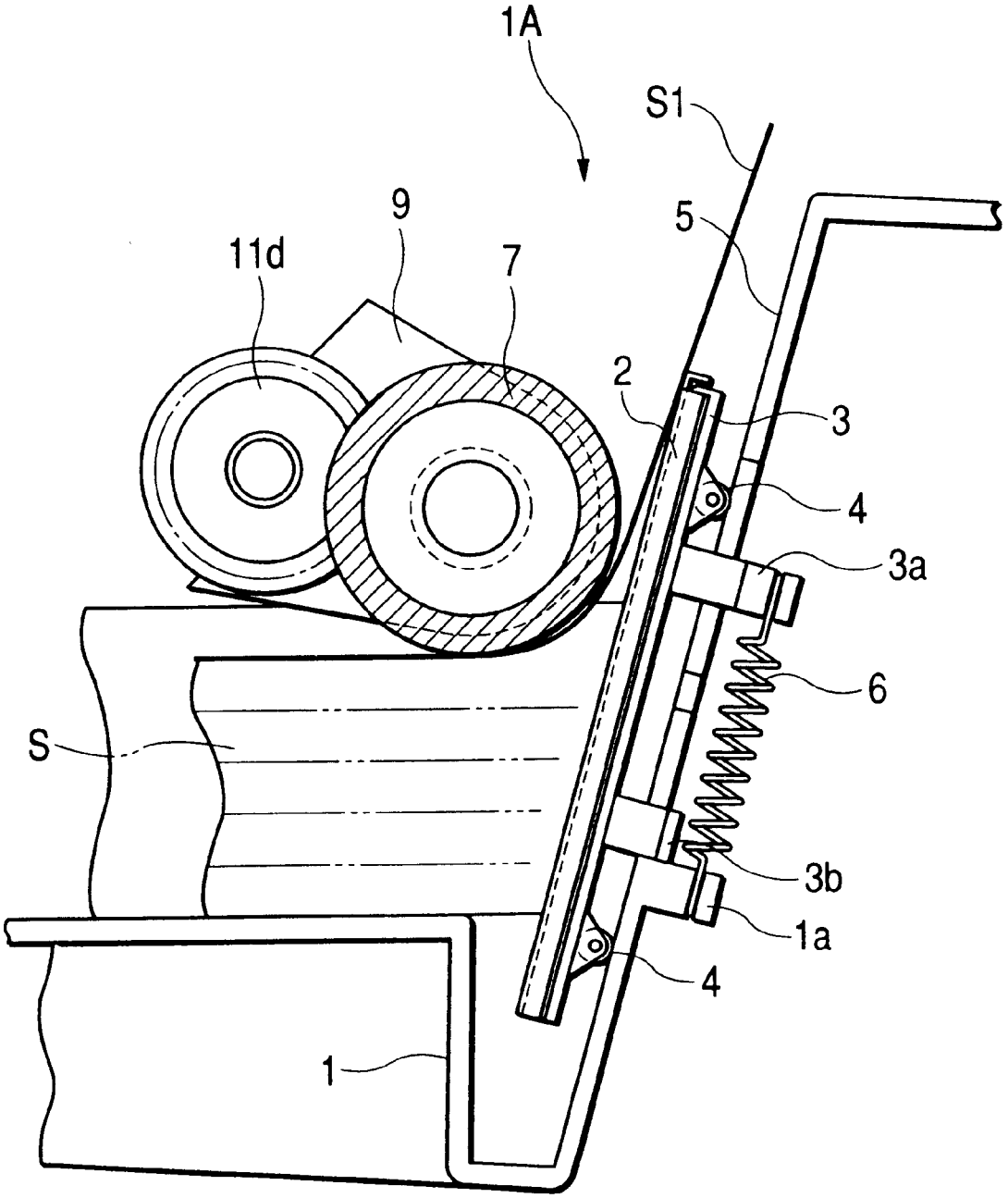
FIG. 3 is an enlarged view of main parts of the sheet feeding apparatus of FIG. 1 in a condition that a thick sheet is fed.

By the way, when thin sheets are fed, if the feeding force is small as shown in FIG. 3, by the disposition of the sheet feeding roller 7 and the separating inclined surface 2, the uppermost sheet S1 is deformed along the separating inclined surface 2 and then is advanced while being guided by the upper and lower conveying guides 14, 15 and thereafter is conveyed to an image forming apparatus (not shown) by the conveying roller 13 and the conveying sub-roller 12.

On the other hand, in case of a thick sheet having strong rigidity, by the disposition of the sheet feeding roller 7 and the separating inclined surface 2, a leading end of the uppermost sheet S1 is not firstly deformed along the separating inclined surface 2, and, thereafter, when the value of the feeding force is increased by the rotation of the sheet feeding roller 7, the feeding force acts toward along which the inclined surface holding member 3 is pushed up by the resiliency of the sheet S1.

Further, thereafter, if a force component of the feeding force parallel with the separating inclined surface 2 exceeds the predetermined force F1 applied to the inclined surface holding member 3 by the inclined surface spring 6 in the initial condition, the inclined surface holding member 3 starts to be shifted upwardly. Incidentally, since the contact between the inclined surface holding member 3 and the inclined surface reference surface 5 is rolling contact due to the presence of the sliding sub-rollers 4, a friction force therebetween can be neglected.

Figure 4:
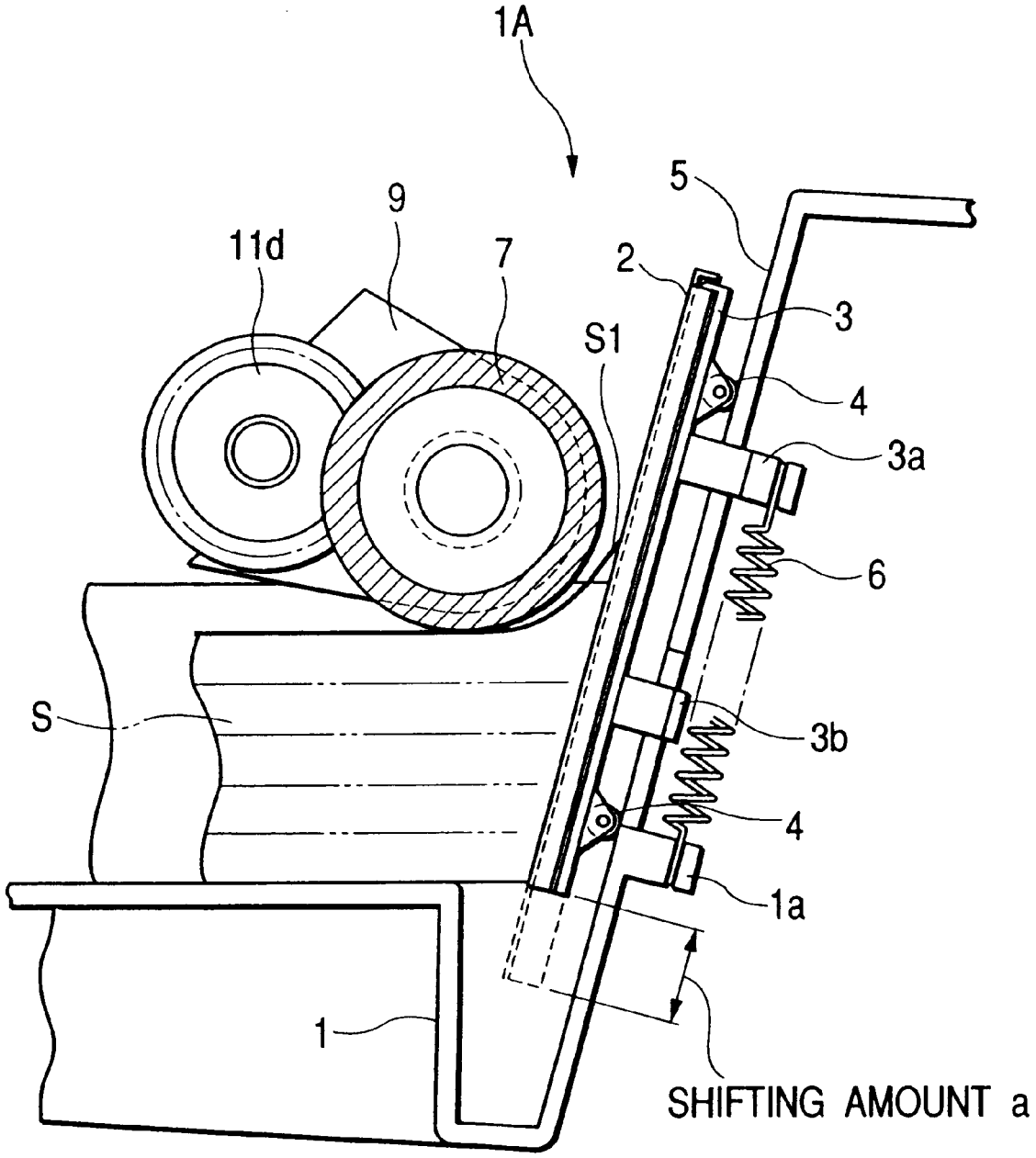
FIG. 4 is an enlarged view of main parts of the sheet feeding apparatus of FIG. 1 in a condition that a thick sheet is fed.

When the inclined surface holding member 3 starts to be shifted upwardly in this way, since the leading end of the sheet strongly abuts against the separating inclined surface 2 held by the inclined surface holding member 3 pushed upwardly, as shown in FIG. 4, as the inclined surface holding member 3 (the separating inclined surface 2) is shifted, the leading end of the sheet is lifted upwardly. As a result, since the uppermost sheet S1 is flexed and an abut angle between the leading end of the sheet and the separating inclined surface 2 is decreased to facilitate occurrence of slip, the upper most sheet is supplied along the sheet abut surface of the separating inclined surface 2.

In this way, by providing the arrangement in which the separating inclined surface 2 is shifted together with the sheet fed out from the sheet feeding roller 7 when the sheet is fed, i.e., by permitting the shifting movement of the separating inclined surface 2 relative to the sheet feeding roller 7, the thick sheet can be fed while adopting the position of the sheet feeding roller 7 and the inclination angle of the separating inclined surface 2 capable of positively preventing the double feeding of thin sheets.

Further, the feeding force required for feeding the thick sheet can be reduced thereby to reduce the load of the driving source. In addition, the above-mentioned effect can be achieved by using a mechanism having a smaller installation space.

Further, by using the sliding sub-rollers 4, since an operation threshold value of the inclined surface holding member 3 is not influenced by a vertical component (normal to the inclined surface reference surface 5) of the friction force but is determined only by the initial value of the inclined surface spring 6, more positive operating discrimination can be made between the thin sheet and he thick sheet. Incidentally, after the separated sheet is fed out, the separating inclined surface 2 is returned, by the inclined surface spring 6, to the initial position from where the separating inclined surface starts to be shifted. In order to return the separating inclined surface 2 to the initial position, the inclined surface spring 6 may be not used but the weight of the separating inclined surface 2 itself or an additional weight may be used.

Next, an alteration of the above-mentioned embodiment will be explained with reference to the accompanying drawings. Incidentally, the same elements as those of the sheet feeding apparatus according to the first embodiment are designated by the same reference numerals and explanation thereof will be omitted.

Figure 5:
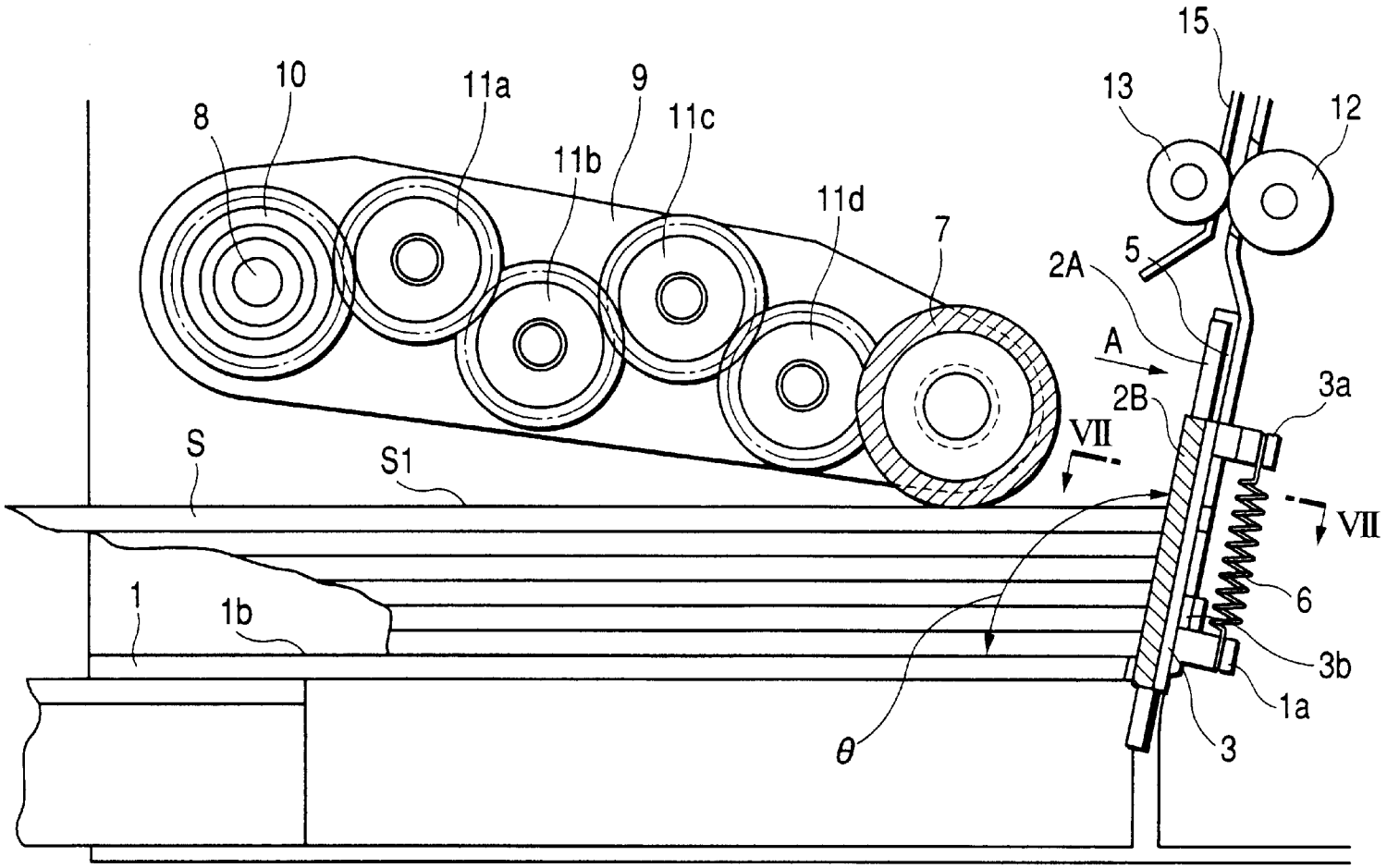
FIG. 5 is a view showing a construction of the sheet feeding apparatus according to an alteration of the first embodiment of the present invention.
Figure 6:
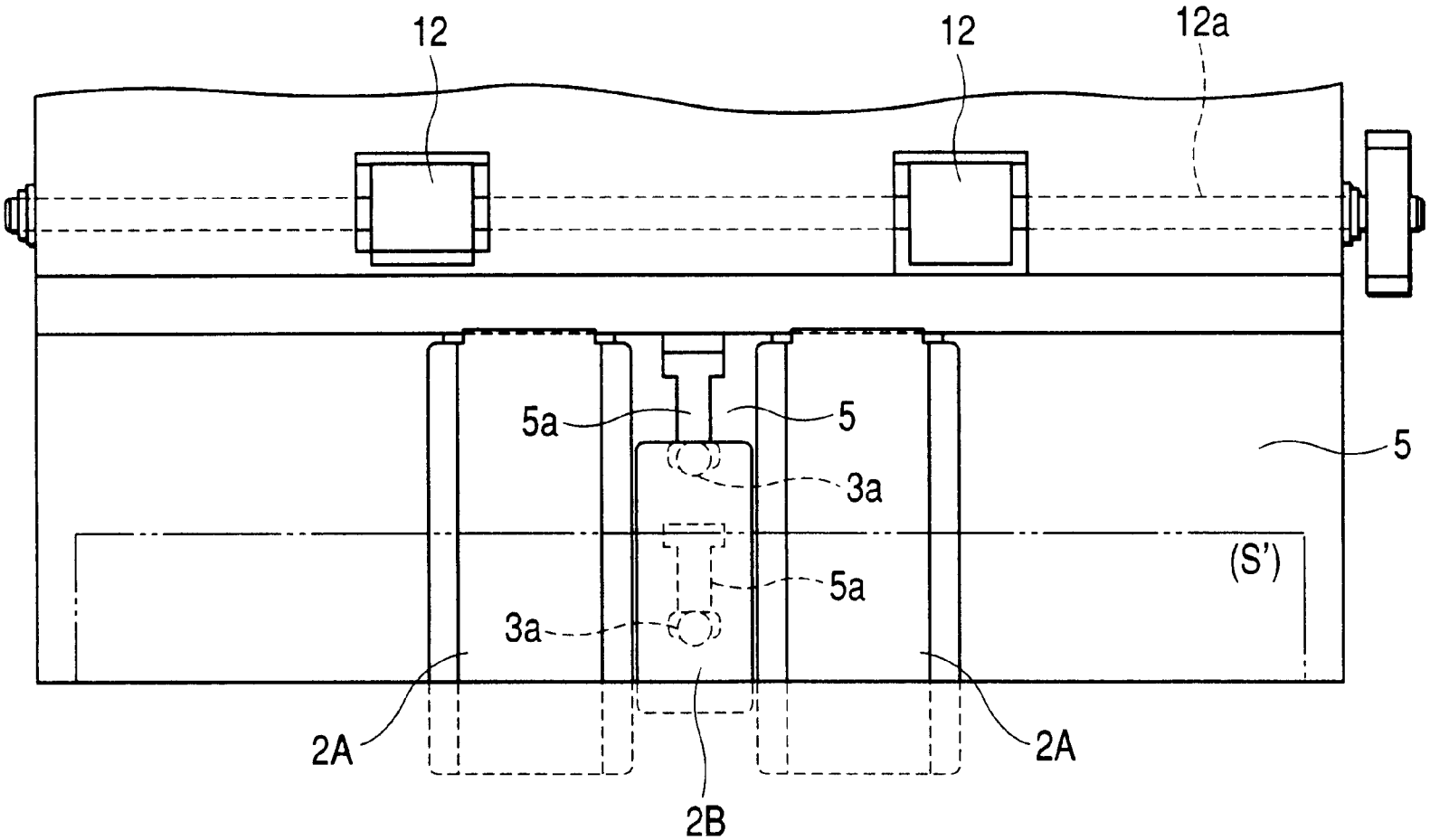
FIG. 6 is a view looked at from a direction shown by the arrow A in FIG. 5.
Figure 7:
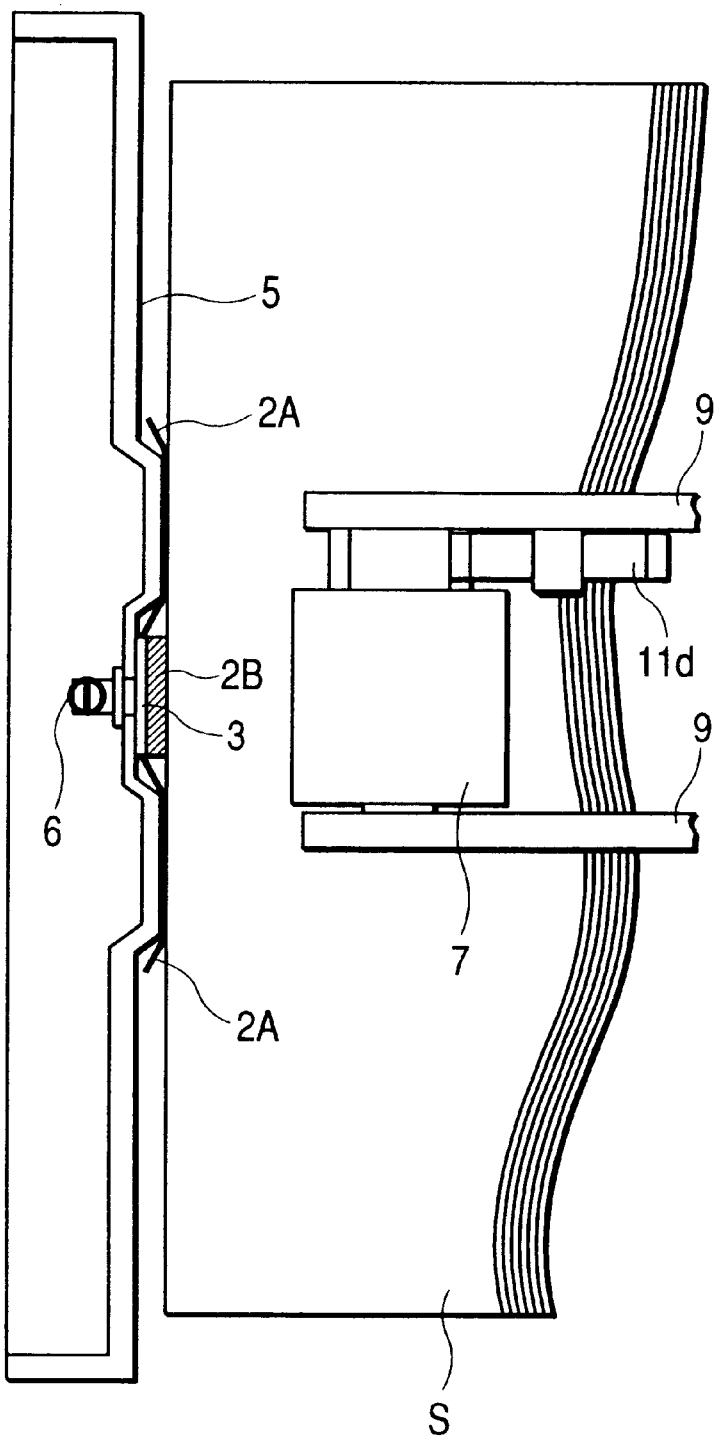
FIG. 7 is a sectional view taken along the line VII—VII in FIG. 5.

In FIGS. 5 to 7, similar to the first embodiment, it is designed so that the sheet is fed out from the sheet feeding tray 1 as the sheet containing means by means of the sheet feeding roller 7 as the sheet feeding means. In this alteration, there are provided first separating inclined surfaces 2A disposed at an abut plane of the sheet feeding tray 1 against which the leading end of the sheet (stack) S abuts, and the first separating inclined surfaces 2A are positioned to have an angle θ (obtuse angle) with respect to the sheet stacking surface 1*b* of the sheet feeding tray. Further, a second separating inclined surface (second inclined surface) 2B disposed in parallel with the first separating inclined surfaces 2A and abutting against the leading end of the sheet (stack) S is also provided, and the second separating inclined surface 2B is formed from a member having coefficient of friction greater than those of the first separating inclined surfaces 2A.

As shown in FIG. 6, which is a view looked at from a direction shown by the arrow A in FIG. 5, the second separating inclined surface 2B is interposed between the left and right first separating inclined surface 2A. By providing such a second separating inclined surface 2B, the double-feeding of thin sheets is prevented as will be described later.

On the other hand, as shown in FIGS. 5 and 6, an inclined surface reference surface 5 serves to support the first and second separating inclined surfaces 2A, 2B and the sheet feeding tray 1, and, in the illustrated alteration, the inclined surface reference surface also acts as a sheet guiding member in a range other than an area where the first and second separating inclined surfaces 2A, 2B are not situated.

In FIG. 5, the reference numeral 1*a* denotes a spring receiving fixed boss provided on an outer surface of the inclined surface reference surface 5; 3 denotes an inclined surface holding member adopted to hold the second separating inclined surface 2B and movable by means of the inclined surface reference surface 5 in the sheet feeding direction (i.e., movable in an up-and-down direction along the first separating inclined surfaces 2A); 3*a* denotes a spring receiving movable boss provided on the inclined surface holding member 3; and 6 denotes an inclined surface spring as an elastic member having one end locked to the spring receiving fixed boss 1*a* and the other end locked to the spring receiving movable boss 3*a*.

By providing the inclined surface spring 6 on the inclined surface holding member 3 held by the inclined surface reference surface 5 for shifting movement in the sheet feeding direction (sheet shifting direction) in this way, as will be described later, when the sheet feeding operation is started, as the sheet is shifted toward the conveying roller 10 along the first and second separating inclined surfaces 2A, 2B, the inclined surface holding member 3 (the second separating inclined surface 2B) is upwardly shifted together with the sheet along the first separating inclined surfaces 2A in opposition to the inclined surface spring 6. That is to say, the inclined surface holding member is shifted from the initial position at an upstream side in the sheet shifting direction toward a downstream side.

Incidentally, the inclined surface reference surface 5 is provided with slits (guide means) 5*a* for determining the shifting direction of the inclined surface holding member 3, which slits are disposed with a predetermined interval in the up-and-down direction. By locking a dislodgment preventing boss 3*a* formed on a bottom surface of the inclined surface holding member 3 into the slit 5*a*, the shifting direction and the shifting range of the inclined surface holding member 3 (the second separating inclined surface 2B) are regulated.

FIG. 7 is a sectional view taken along the line VII—VII in FIG. 5. Also in this alteration, as shown in FIG. 7, the second separating inclined surface 2B is slightly protruded toward the sheet stacking area in comparison with the first separating inclined surfaces 2A. Incidentally, a protruded amount of the second separating inclined surface 2B is determined in consideration of the balance of the prevention of the double-feeding of thin sheets and the thick sheet feeding ability.

Figure 8:
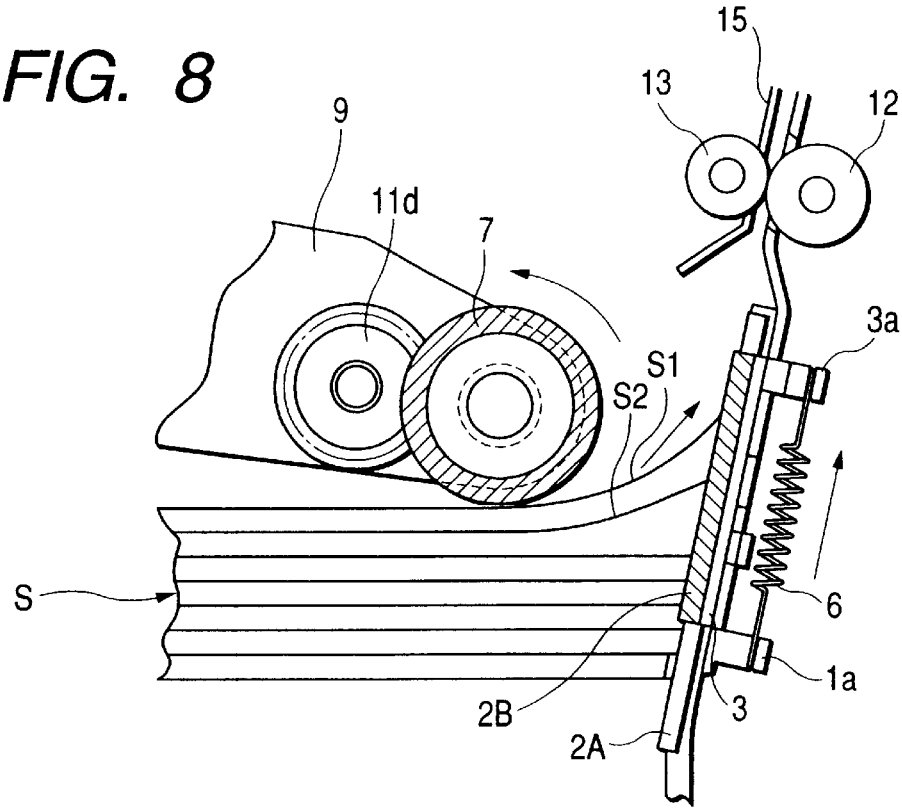
FIG. 8 is a view showing an initial stage of a sheet feeding operation of the sheet feeding apparatus.

Next, an sheet feeding operation of the sheet feeding apparatus having the above-mentioned construction will be explained with reference to FIGS. 8 to 10.

When the sheet feeding operation is started, first of all, the driving shaft 8 is rotated by the driving mechanism (not shown), and the rotation of the driving shaft 8 is transmitted to the sheet feeding roller 7 through the idler gears 11*a*, 11*b*, 11*c*, 11*d* held by the sheet feeding roller arm 9, thereby starting rotation of the sheet feeding roller 7. In this case, since the sheet feeding roller 7 abuts against the uppermost sheet S1 included in the sheet (stack) S rested on the sheet stacking surface 1*b*, when the rotation of the sheet feeding roller 7 is started, a feeding force due to a friction force of the sheet feeding roller 7 acts on the uppermost sheet S1.

Due to the presence of this feeding force, the uppermost sheet S1 is subjected to a reaction force against the friction force from the first and second separating inclined surfaces 2A, 2B trying to stop the movement of the sheet. Incidentally, in this case, particularly, since the coefficient of friction of the second separating inclined surface 2B is great, a next sheet S2 immediately below the sheet S1 is not moved or, as shown in FIG. 8, movement of the next sheet is slightly delayed with respect to the movement of the sheet S1.

If the next sheet S2 is not moved, the sheet feeding operation having no problem can be obtained. However, if the next sheet S2 is moved, as shown in FIG. 8, since the second separating inclined surface 2B is subjected to a force from the uppermost sheet S1 and the next sheet S2, the inclined surface holding member 3 holding the second separating inclined surface 2B is also subjected to the force.

If this force is increased to overcome the biasing force of the inclined surface spring 6, the second separating inclined surface 2B and the inclined surface holding member 3 are shifted upwardly within the movement range defined by the slit 5*a* at a speed substantially the same as the shifting speed of the leading end of the sheet. As a result, the leading end of the uppermost sheet S1 is shifted while being flexed upwardly, as shown by the arrow.

Figure 9:
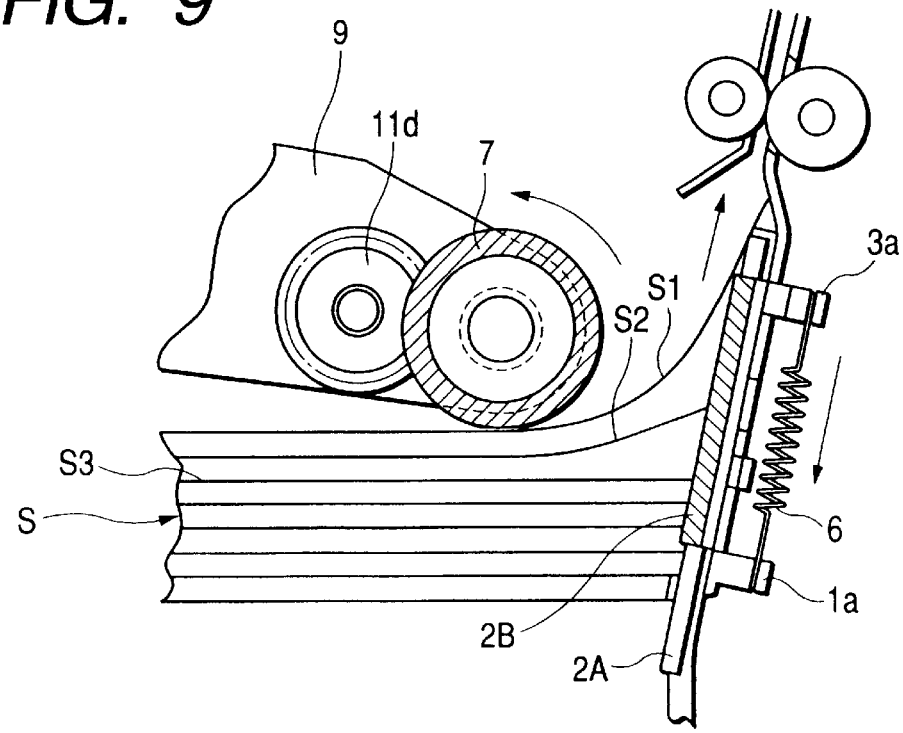
FIG. 9 is a view showing an intermediate stage of the sheet feeding operation of the sheet feeding apparatus.

Thereafter, as shown in FIG. 9, when the flexed amount of the uppermost sheet S1 reaches a predetermined amount, the leading end of the uppermost sheet S1 can be slid on the second separating inclined surface 2B. When the uppermost sheet S1 is slid in this way, the force acting on the second separating inclined surface 2B is reduced to only the force applied from the next sheet S2.

In this case, since the force acting on the next sheet S2 is smaller than the friction force between the uppermost sheet S1 and the next sheet S2 (the next sheet S2 receives a friction force generated between the next sheet S2 and an underlying third sheet S3 as a break force), the biasing force of the inclined surface spring 6 overcomes this force, with the result that the second separating inclined surface 2B (the inclined surface holding member 3) starts to shift toward the initial position as shown in FIG. 9, thereby returning to the initial position before the sheet feeding operation.

Figure 10:
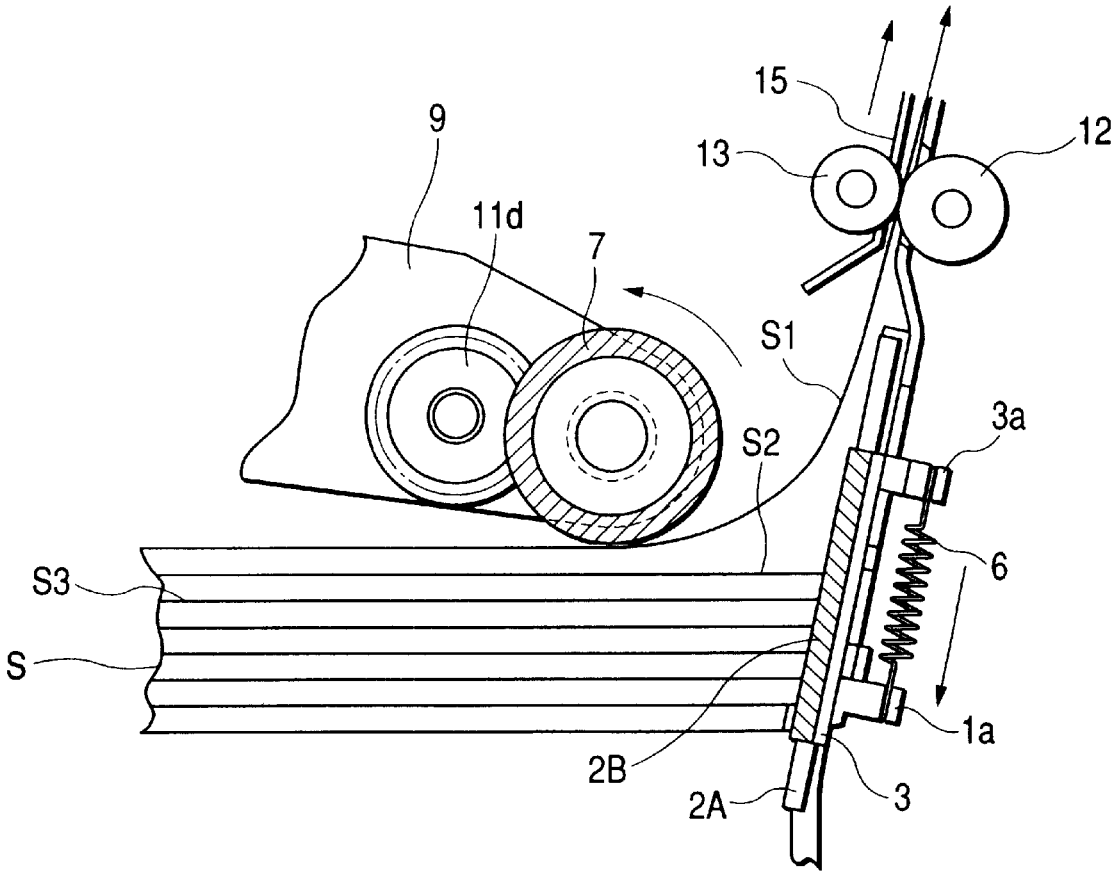
FIG. 10 is a view showing a final stage of the sheet feeding operation of the sheet feeding apparatus.

As the inclined surface holding member 3 is shifted, as shown in FIG. 10, the next sheet S2 trying to ride on the second separating inclined surface 2B to be double-fed is returned to the initial position on the sheet (stack) S, with the result that the double-feeding of the next sheet S2 is prevented. Incidentally, in this case, since the uppermost sheet S1 is sliding on the second separating inclined surface 2B, the uppermost sheet is not influenced by the movement of the inclined surface holding member 3, and, thereafter, the uppermost sheet is conveyed from the upper guide 15 to the image forming apparatus (not shown) by the conveying roller 13 and the conveying sub-roller 12.

Incidentally, the shifting amount of the inclined surface holding member 3 (the second separating inclined surface 2B) is varied with the kind of sheet. That is to say, when the thin sheet is fed, the inclined surface holding member 3 (the second separating inclined surface 2B) is slightly shifted by the feeding force and then is returned to the predetermined position. On the other hand, when the thick sheet or a sheet strongly abutting against the second separating inclined surface 2B is fed, the inclined surface holding member 3 (the second separating inclined surface 2B) is shifted by the full length within the allowable movement range.

In this way, by providing the arrangement in which the second separating inclined surface 2B can be shifted and is held elastically by the inclined surface holding member 3 and the inclined surface spring 6, as the sheet is fed, the second separating inclined surface 2B can be shifted together with the sheet, and, in this case, by the change in the abut angle and abut amount of the leading end of the sheet, the leading end of the sheet can easily be shifted, thereby permitting the thin sheets or any sheet apt to be adhered.

Further, after the uppermost sheet was fed, the second separating inclined surface 2B is returned by the inclined surface spring 6, and, in this case, by acting the returned force of the second separating inclined surface 2B on the sheet other than the uppermost sheet, the double-feeding of the sheets other than the uppermost sheet can be prevented. That is to say, when the uppermost sheet S1 starts to be slid on the second separating inclined surface 2B, by shifting the second separating inclined surface 2B toward the original position, the sheets trying to be double-fed can be returned onto the sheet stack by such a returning movement, thereby preventing double-feeding of thinner sheets having more worse condition or of sheets on the interface between the newly replenished sheets and the previously replenished sheets.

By the way, in this alteration, while an example that the second separating inclined surface 2B is disposed between the first separating inclined surfaces 2A was explained, with appropriate arrangement and combination other than this, it is apparent that similar effect can be achieved. Further, while the sheet feeding apparatus having the sheet feeding tray secured to the main body was explained, even when a sheet feeding tray detachably mounted on the main body is used, it is apparent that similar effect can be achieved.

Next, another alteration of the first embodiment will be explained.

Figure 11:
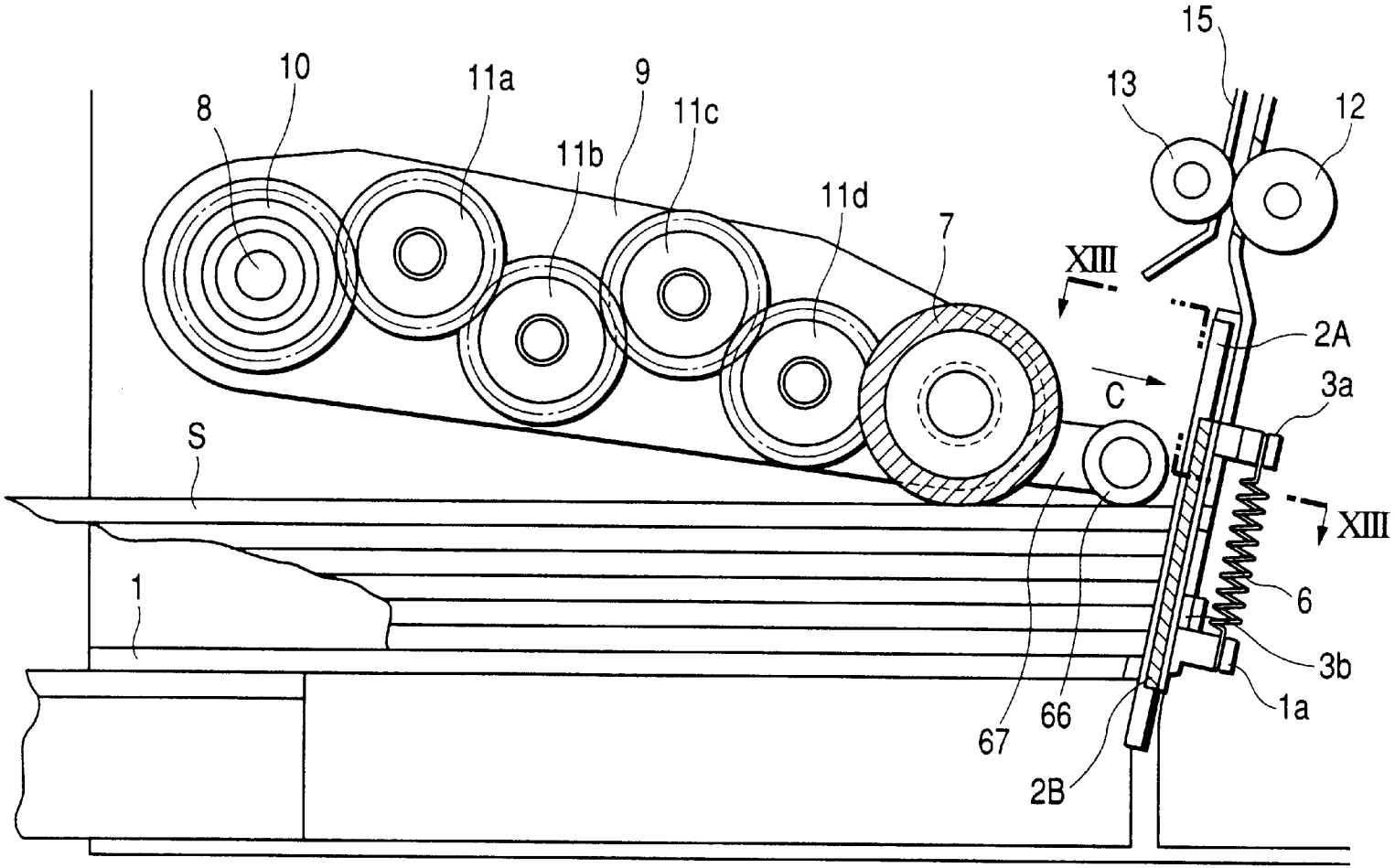
FIG. 11 is a view showing a construction of the sheet feeding apparatus according to another alteration of the first embodiment of the present invention.
Figure 12:
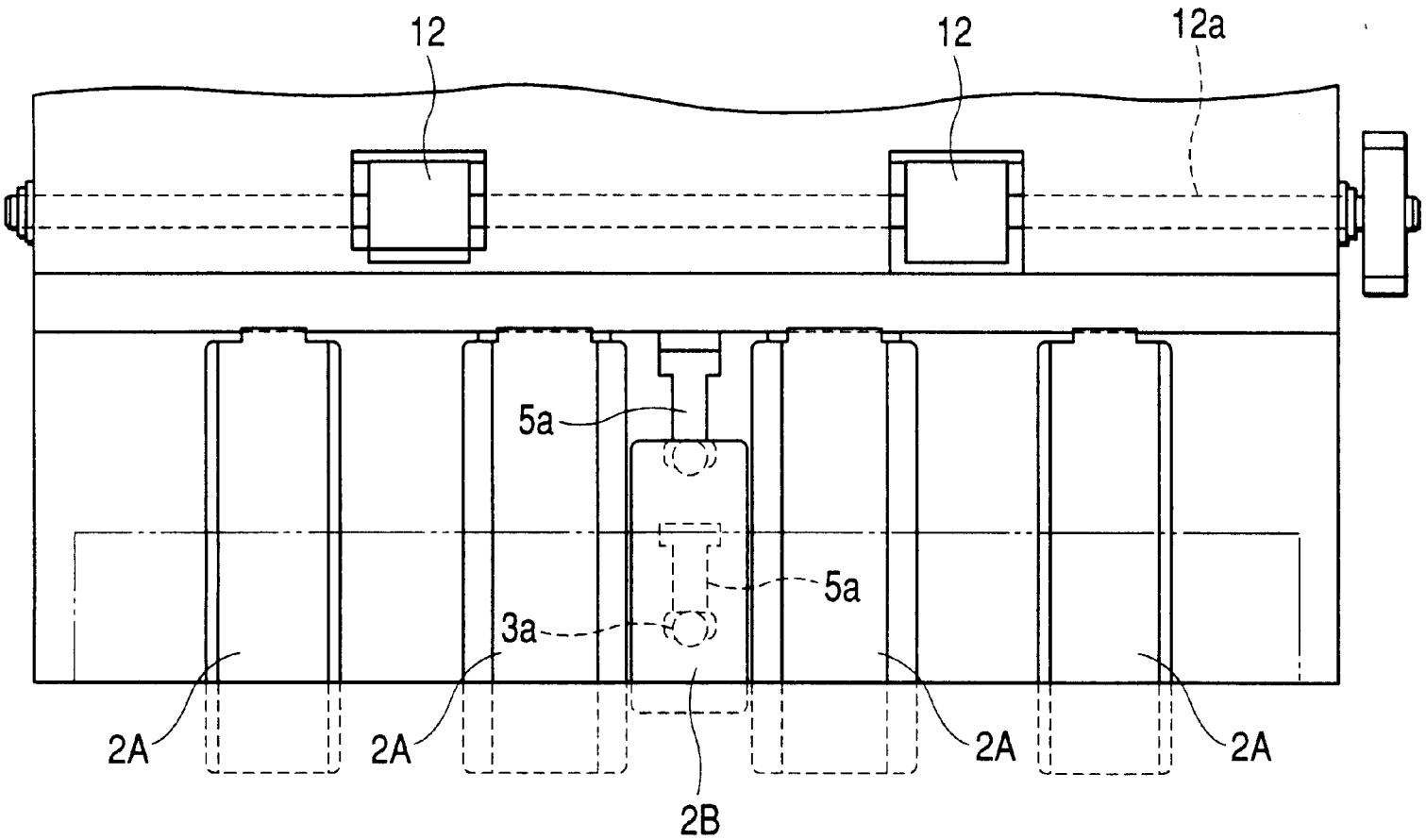
FIG. 12 is a view looked at from a direction shown by the arrow C in FIG. 11.
Figure 13:
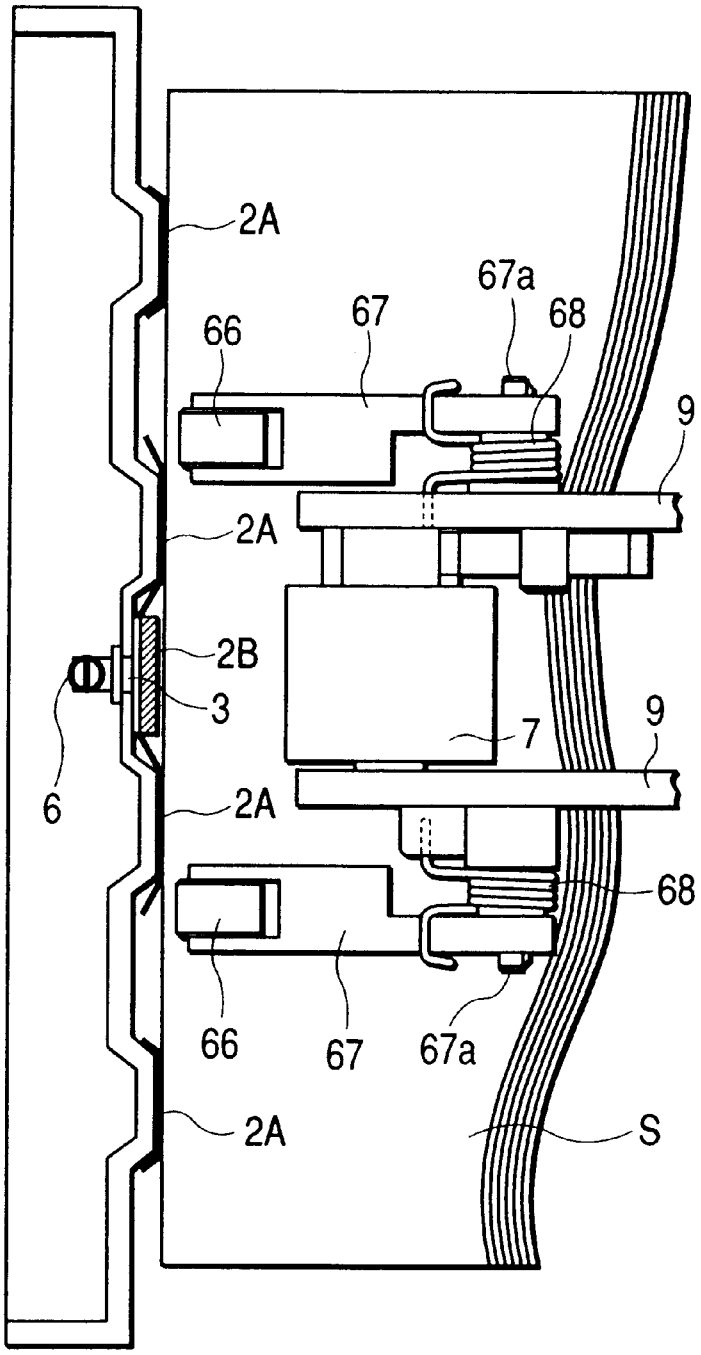
FIG. 13 is a sectional view taken along the line XIII—XIII in FIG. 12.

In FIGS. 11 to 13, the same reference numerals as those shown in FIGS. 5 to 7 designate the same or similar parts, and detailed explanation thereof will be omitted.

The reference numeral 66 denotes urging sub-rollers as urging members for urging the upper surface of the sheet (stack) S downwardly between the sheet feeding roller 7 and the first and second separating inclined surfaces 2A, 2B; 67 denotes sub-roller holders for holding the urging sub-rollers 66; and 68 denotes sub roller springs mounted around sub-roller holder shafts 67*a* provided on the sheet feeding roller arm 9 and adapted to bias the respective sub-roller holders 67 toward the sheet stack.

As shown in FIG. 12 which is a view looked at from a direction shown by the arrow C, the second separating inclined surface 2B is disposed between left and right pairs of first separating inclined surfaces 2A flush with each other and, as shown in FIG. 13 which is a sectional view taken along the line XIII—XIII in FIG. 11, the second separating inclined surface is spaced apart from the sheet stack more than the first separating inclined surfaces 2A.

By arranging the second separating inclined surface 2B in this way, before the sheet feeding operation is started, the sheet (stack) S does not abut against the second separating inclined surface 2B, and, when the sheet feeding operation is started, the sheet stack abuts against the second separating inclined surface 2B while being deformed in a longitudinal wave fashion, as will be described later.

Incidentally, in this alteration, as shown in FIG. 13, the second separating inclined surface 2B is opposed to the sheet feeding roller 7. By arranging the second separating inclined surface 2B in such a position, the separating force generated by the second separating inclined surface 2B acts on a center line of the sheet stack, so that the advancing direction of the sheet is prevented from being changed during the sheet separation. As a result, in a center reference sheet feeding mode, skew-feeding can be prevented more positively.

Further, as shown in FIG. 12, by providing four first separating inclined surfaces 2A, the sheet situated in a range where the sheet does not abut against the first and second separating inclined surfaces 2A, 2B can be bent smoothly, with the result that various sheets having different sheet feeding fashion can be separated. Incidentally, the outermost first separating inclined surfaces 2A may not be in flush with the innermost first separating inclined surfaces 2A so long as these first separating inclined surfaces are in parallel with each other.

Next, a sheet feeding operation having the above-mentioned construction will be explained with reference to FIGS. 14 to 16.

When the sheet starts to be fed, the sheet feeding roller 7 is rotated, with the result that the feeding force due to the friction force between the uppermost sheet and the sheet feeding roller 7 acts on the uppermost sheet S1. By this feeding force, the uppermost sheet S1 is firstly subjected to a reaction force against the friction force by means of the first separating inclined surfaces 2A trying to stop the movement of the sheet S1.

In this alteration, even if such a reaction force is applied, since the posture of the sheet (stack) S is lightly regulated by the urging sub-rollers 66, regarding the thin sheet, a bent radius of the sheet becomes smaller, with the result that the abutting force of the leading end against the first separating inclined surfaces 2B becomes stronger.

Figure 14:
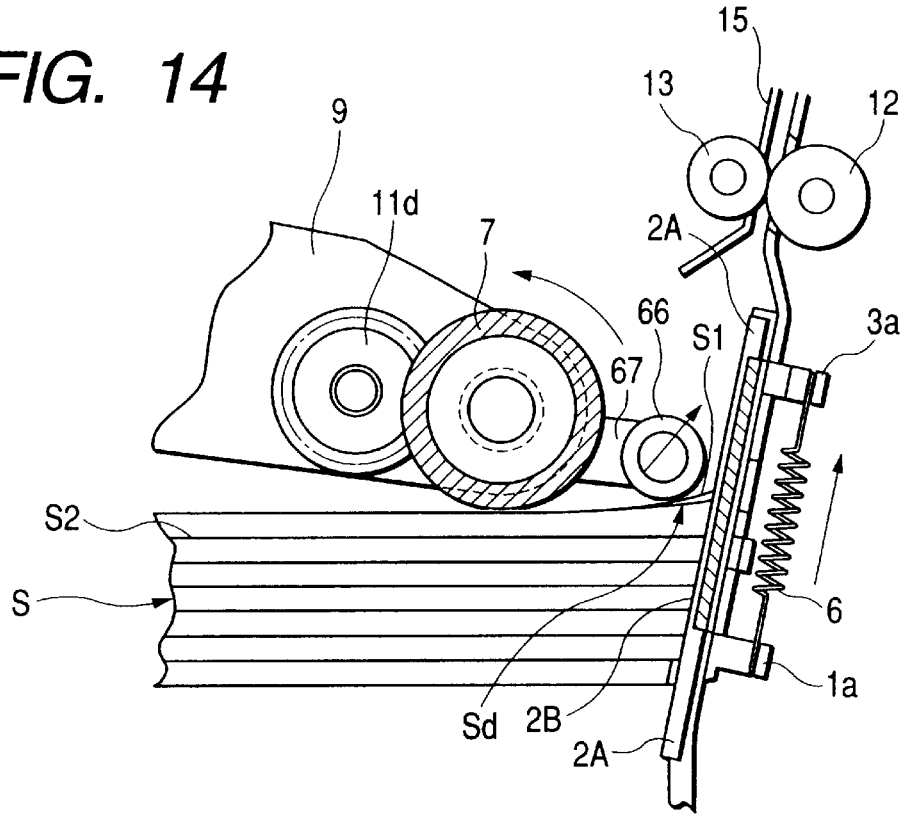
FIG. 14 is a view showing an initial stage of a sheet feeding operation of the sheet feeding apparatus.

Thereafter, when the sheet feeding roller 7 is further rotated, since the second separating inclined surface 2B is more retracted than the first separating inclined surfaces 2A, the leading end of the sheet is contacted with the second separating inclined surface 2B while creating longitudinal wave shaped distortion Sd as shown in FIG. 14 in front of the second separating inclined surface 2B. After such longitudinal wave-shaped distortion Sd was created, by the force acting on the leading end of the sheet, the uppermost sheet S1 is shifted upwardly from the initial position together with the second separating inclined surface 2B, as shown in FIG. 14.

Figure 15:
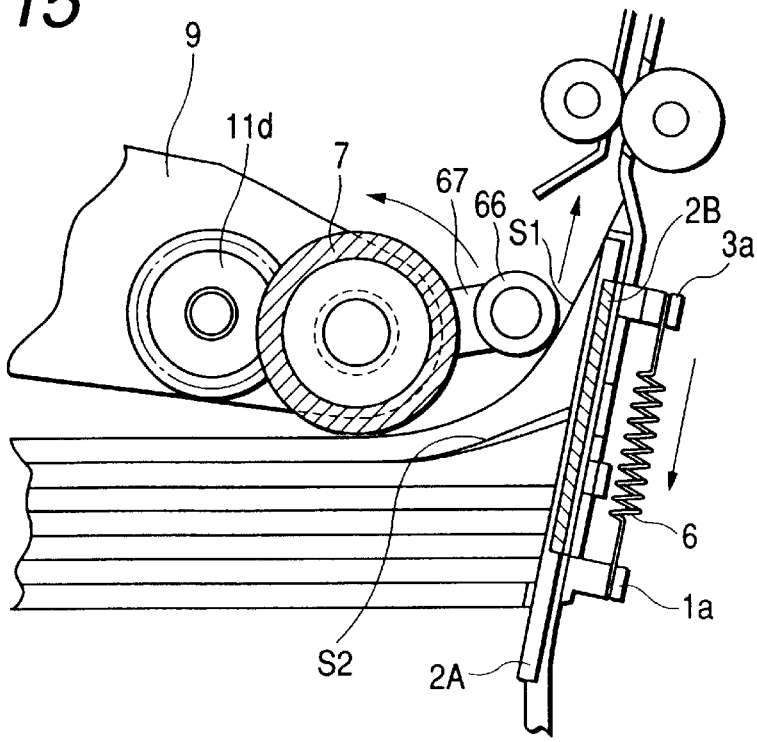
FIG. 15 is a view showing an intermediate stage of the sheet feeding operation of the sheet feeding apparatus.
Figure 16:
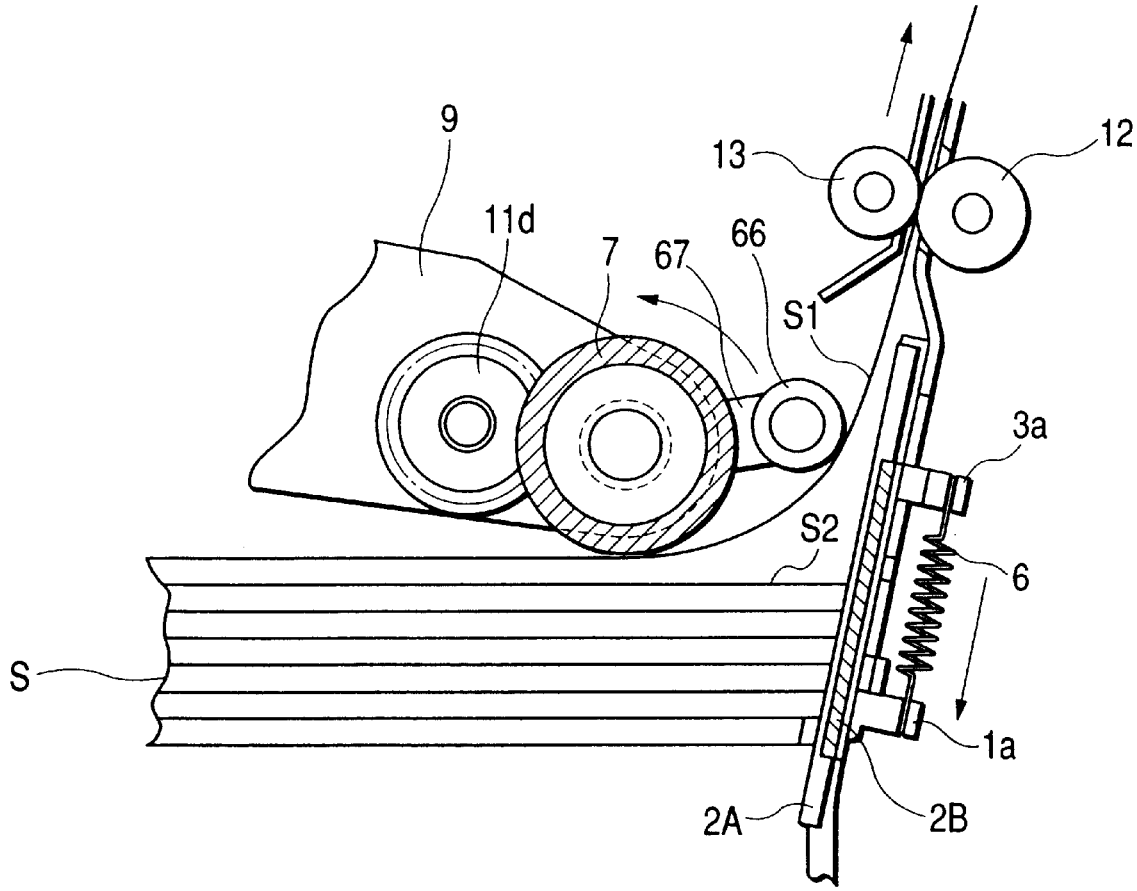
FIG. 16 is a view showing a final stage of the sheet feeding operation of the sheet feeding apparatus.

Incidentally, although the next sheet S2 is also shifted while creating similar distortion and abutting against the second separating inclined surface 2B, as shown in FIG. 15, when the uppermost sheet S1 starts to be slipped on the second separating inclined surface 2B, similar to the above, the second separating inclined surface 2B is shifted toward the downward initial position by the biasing force of the inclined surface spring 6, with the result that the sheet S2 is pushed downwardly and is returned onto the sheet (stack) S as shown in FIG. 16.

In this way, by providing the urging sub-rollers 66 to increase the bent rate of the thin sheet by means of the urging sub-rollers 66, the double-feeding can be hard to occur. Further, dispersion in abut angles between the sheets and the first and second separating inclined surfaces 2A, 2B and influence of fluctuation of the abut angle during the sheet feeding can be reduced. Incidentally, when the thick sheet is fed, the urging sub-rollers 66 is pushed upwardly by the resiliency of the thick sheet and affects less influence upon the feeding force required for the sheet feeding.

Further, by arranging the second separating inclined surface 2B to be more retracted than the first separating inclined surfaces 2A, the sheet such as thin sheet abuts against the second separating inclined surface 2B in a condition that the leading end of the sheet is deformed, thereby making the occurrence of the double-feeding more difficult. Incidentally, since the thick sheet is hard to be deformed and is fed without contacting with the second separating inclined surface 2B, the influence of the second separating inclined surface 2B upon the sheet becomes smaller, thereby achieving more stable sheet feeding.

Next, a second embodiment of the present invention will be explained.

Figure 17:
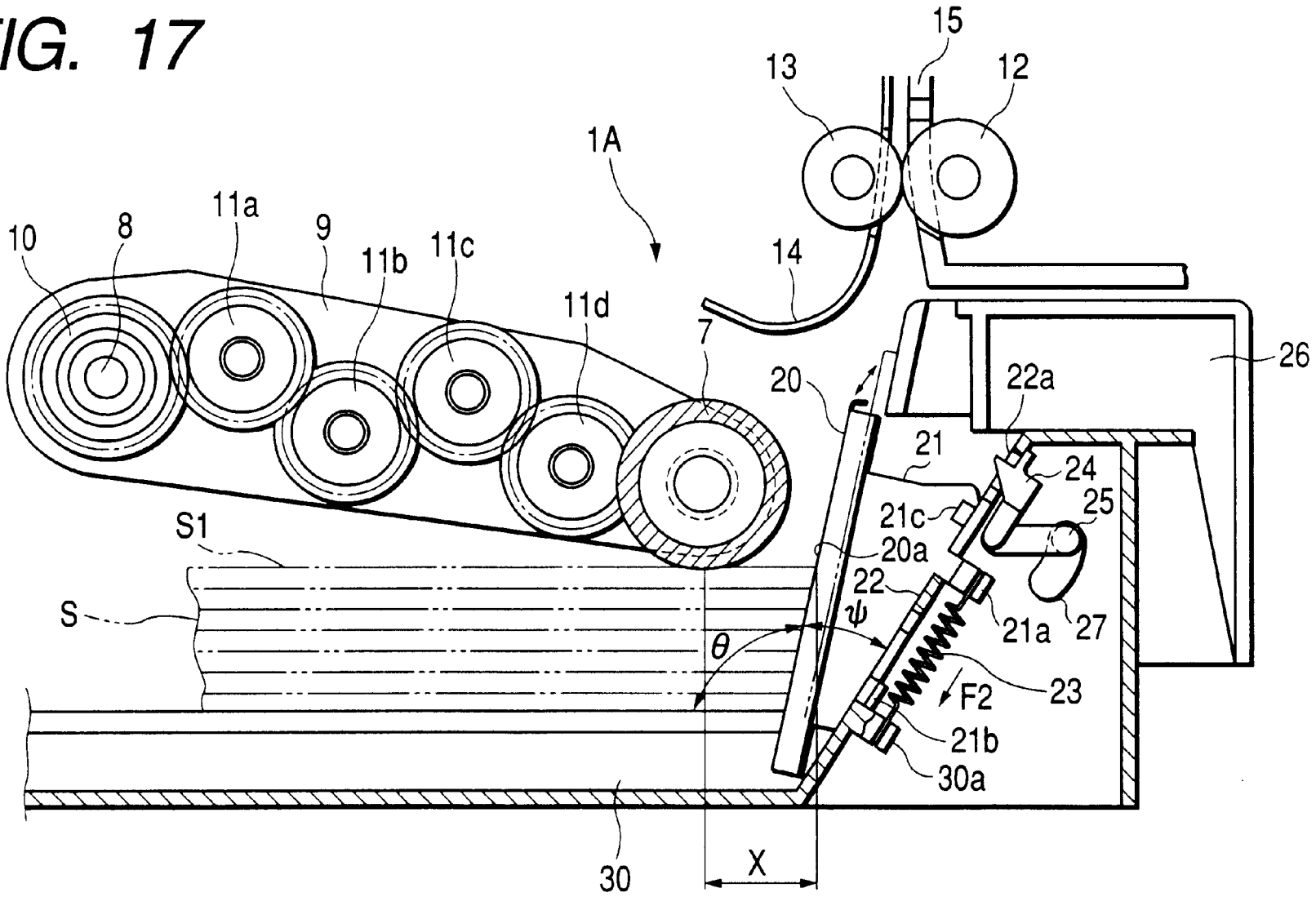
FIG. 17 is a view showing a construction of a sheet feeding apparatus according to a second embodiment of the present invention.

FIG. 17 is a view showing a construction of a sheet feeding apparatus according to the second embodiment of the present invention. Incidentally, in FIG. 17, the same reference numerals as those shown in FIG. 1 designate the same or similar parts.

In FIG. 17, the sheet feeding apparatus includes a sheet feeding tray 30, a separating inclined surface 20 provided at a sheet feeding end of a sheet containing portion of the sheet feeding tray 30, an inclined surface holding member 21 for holding the separating inclined surface 20, and an inclined surface reference surface 22 for slidably holding the inclined surface holding member 21 and is inclined in a direction away from the sheet feeding roller 7. The inclined surface reference surface 22 is inclined in a direction along which the surface 22 is spaced away from the sheet feeding roller 7 more and more from a plane including a sheet abut surface 20*a* (against which the sheet abuts) of the separating inclined surface 20 in the sheet advancing direction, and forms an angle of $\psi$ with respect to the sheet abut surface 20*a* of the separating inclined surface 20.

There are further provided an inclined surface spring 23 for pulling the inclined surface holding member 21 with a predetermined force F2 in an initial position shown in FIG. 17, a spring receiving movable boss 21*a* provided on the inclined surface holding member 21 and holding one end of the inclined surface spring 23, a spring receiving fixed boss 30*a* provided on the sheet feeding tray 30 and holding the other end of the inclined surface spring 23, and a dislodgment preventing boss 21*b* for preventing dislodgment of the inclined surface holding member 21 slidable together with the spring receiving movable boss 21*a* with respect to the inclined surface reference surface 22. Incidentally, attachment of the spring receiving movable boss 21*a* and the dislodgment preventing boss 21*b* to the inclined surface reference surface 22 is the same as the first embodiment.

A latch arm 24 rotatably supported by the sheet feeding tray 30 is normally biased by biasing means (not shown) in an anti-clockwise direction so that a distal end of the latch arm is protruded from a notched portion 22*a* formed in an upper end portion of the inclined surface holding member 21. Incidentally, the reference numeral 21*c* denotes a locking hole provided in a sliding surface of the inclined surface holding member 21 and to which the distal end of the latch arm 24 is locked.

There are further provided a latch releasing portion 25 integrally formed with the latch arm 24 and is protruded from a latch releasing hole 27 formed in a side wall of the sheet feeding tray 30, and a downstream guide member 26 secured to the sheet feeding tray 30 and adapted to guide the sheet fed out by the sheet feeding roller 7.

Next, a sheet separating operation of the sheet feeding apparatus 1A having the above-mentioned construction will be explained.

When the thin sheet is fed, similar to the first embodiment, by the disposition of the sheet feeding roller 7 and the separating inclined surface 20, even if the feeding force is small, the uppermost sheet S1 is conveyed while being deformed along the separating inclined surface 20. In this case, the separating inclined surface 20 (the inclined surface holding member 21) is kept stationary under the action of an initial force F2 of the inclined surface spring 23.

On the other hand, when the thick sheet is fed, by the disposition of the sheet feeding roller 7 and the separating inclined surface 20, the leading end of the uppermost sheet S1 is not deformed along the separating inclined surface 20. Thereafter, when the value of the feeding force is increased by the rotation of the sheet feeding roller 7, this feeding force acts to push the inclined surface holding member 21 upwardly with the aid of the resiliency of the sheet S1.

Then, when the feeding force is further increased, a force component $[Fs\cdot\cos(\theta+\psi)]$ of the feeding force exceeds the predetermined force F2 applied to the inclined surface holding member 21 from the inclined surface spring 23 in the initial condition. As a result, the inclined surface holding member 21 and the separating inclined surface 20 are shifted upwardly and rightwardly together with the sheet S1 as shown in FIG. 6 while stretching the inclined surface spring 23 and separating from the sheet feeding roller 7 because of the angle $(\theta+\psi)$ between the inclined surface reference surface 22 and the sheet stack S.

In this way, by providing the arrangement in which the separating inclined surface 20 is shifted together with the sheet fed out from the sheet feeding roller 7 during the sheet feeding, the thick sheet can be fed while adopting the position of the sheet feeding roller 7 and the angle of the separating inclined surface 20 capable of preventing the double-feeding of thin sheets positively.

Further, in the illustrated embodiment, since the force component $[Fs\cdot\cos(\theta+\psi)]$ of the feeding force Fs becomes greater than a force component $[Fs\cdot\cos(\theta)]$ in the direction of the separating inclined surface 20 ($\theta$: angle between the sheet and the separating inclined surface), the sheet can be fed by a smaller force than that in the first embodiment.

Figure 19:
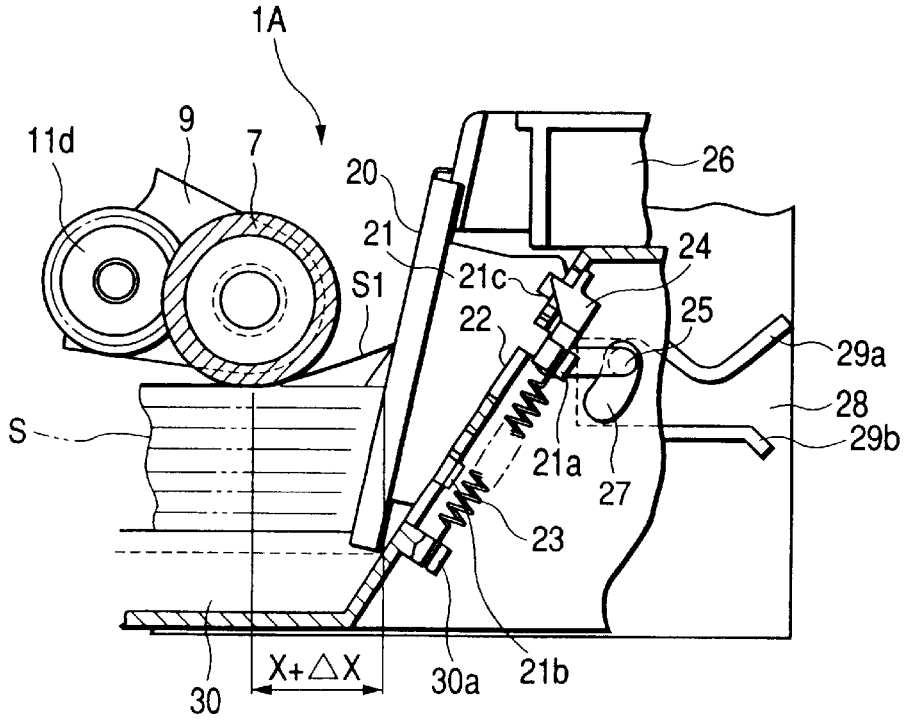
FIG. 19 is an enlarged view of main parts of the sheet feeding apparatus of FIG. 17 in a condition that a thick sheet is fed.

Incidentally, when the thick sheet is fed (in such a case of which the separating inclined surface 20 must be shifted more greatly for the sheet feeding), the inclined surface holding member 21 is shifted up to a position shown in FIG. 19. When the inclined surface holding member 21 is shifted up to this position, the inclined surface holding member is held by regulating means. The regulating means includes a locking hole 21*c* formed in the inclined surface holding member 21, and a latch arm 24 provided on the sheet feeding tray 30 and capable of locking to the locking hole 21*c*. The inclined surface holding member 21 is held by the regulating means at the position shown in FIG. 19.

As a result, a distance from the abut portion between the sheet feeding roller 7 and the sheet stack D to the but portion between the sheet (stack) S and the inclined surface holding member 21 is changed from X (in FIG. 17) to $(X+\Delta X)$ (in FIG. 19); that is to say, a distance between the sheet feeding roller 7 and the separating inclined surface 20 is increased. Consequently, the thick sheet is apt to be bent, with the result that the thick sheet can be fed even in the condition that the inclined surface holding member 21 is fixed.

In this way, according to the illustrated embodiment, since the shifting direction of the separating inclined surface 20 defined by the inclined surface reference surface 22 can be set more gently than the angle $\theta$ of the separating inclined surface, when the thick sheet is fed, the shifting direction of the leading end of the sheet forms a shallow angle. Consequently, the load for starting movement is reduced, with the result that thicker sheet can be easily fed.

Further, by holding the inclined surface holding member 21 by means of the latch mechanism of the regulating means, since the inclined surface holding member 21 is not slidingly shifted whenever the thick sheet is fed, endurance is enhanced and noise is reduced. Further, since the shifting component directing toward the direction of the sheet stacking surface is included in the shifting direction of the separating inclined surface 20, even if the leading end of the sheet is contacted with the separating inclined surface 20 in the initial condition, the operation is not obstructed, thereby permitting more stable operation.

Figure 18:
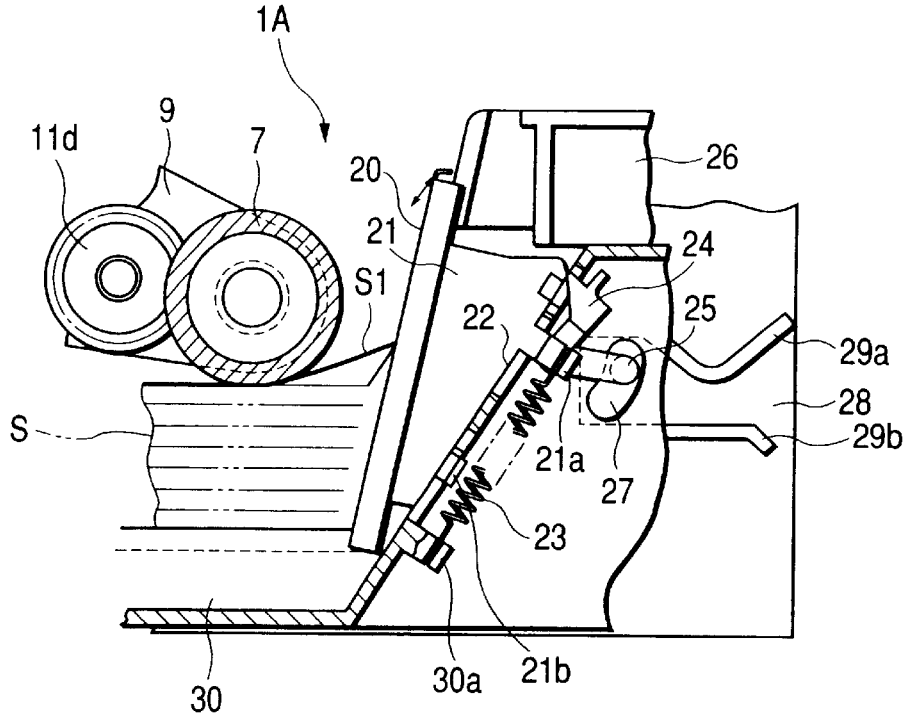
FIG. 18 is an enlarged view of main parts of the sheet feeding apparatus of FIG. 17 in a condition that a thick sheet is fed.

Incidentally, in FIGS. 18 and 19, the reference numeral 29*a* denotes a release cam provided on an inner wall 28 of the image forming apparatus; and 29*b* denotes a latch guide provided in the inner wall 28. The release cam 29*a* serves to release the holding of the inclined surface holding member 21 by means of the latch arm 24, and the release cam 29*a* abuts against the latch releasing portion 25 to rotate the latch arm in a clockwise direction when the sheet feeding tray 30 detachable to the main body of the apparatus is dismounted from the main body of the apparatus. When the latch arm 24 is rotated in the clockwise direction in this way, the holding of the inclined surface holding member 21 by means of the latch arm 24 is released.

Incidentally, in the illustrated embodiment, if the latch arm 24 is omitted, it is apparent from the effect inherent to the present invention can be achieved. Further, in place of the latch arm 24, a plastic member or a damper may be used to provide smooth braking at an upper dead point of the movement of the inclined surface holding member. Further, similar to the first embodiment, the inclined surface spring 23 for returning the separating inclined surface 20 to the initial position may be omitted, and the separating inclined surface may be returned to the initial position by the weight of the separating inclined surface 20 itself or an additional weight.

Next, an alteration of the second embodiment of the present invention will be explained.

FIGS. 20 to 23 show a construction of a sheet feeding apparatus according to this alteration. Incidentally, in FIGS. 20 to 23, the same reference numerals as those shown in FIGS. 17 to 19 designate the same or similar parts.

The sheet feeding apparatus includes an inclined surface holding member 21 for a second separating inclined surface 20B, and an inclined surface reference surface 22 for holding the inclined surface holding member 21 (the second separating inclined surface 20B) for shifting movement in a sheet feeding direction, which inclined surface holding member forms an angle of $\psi$ with respect to first separating inclined surfaces 20A.

Figure 20:
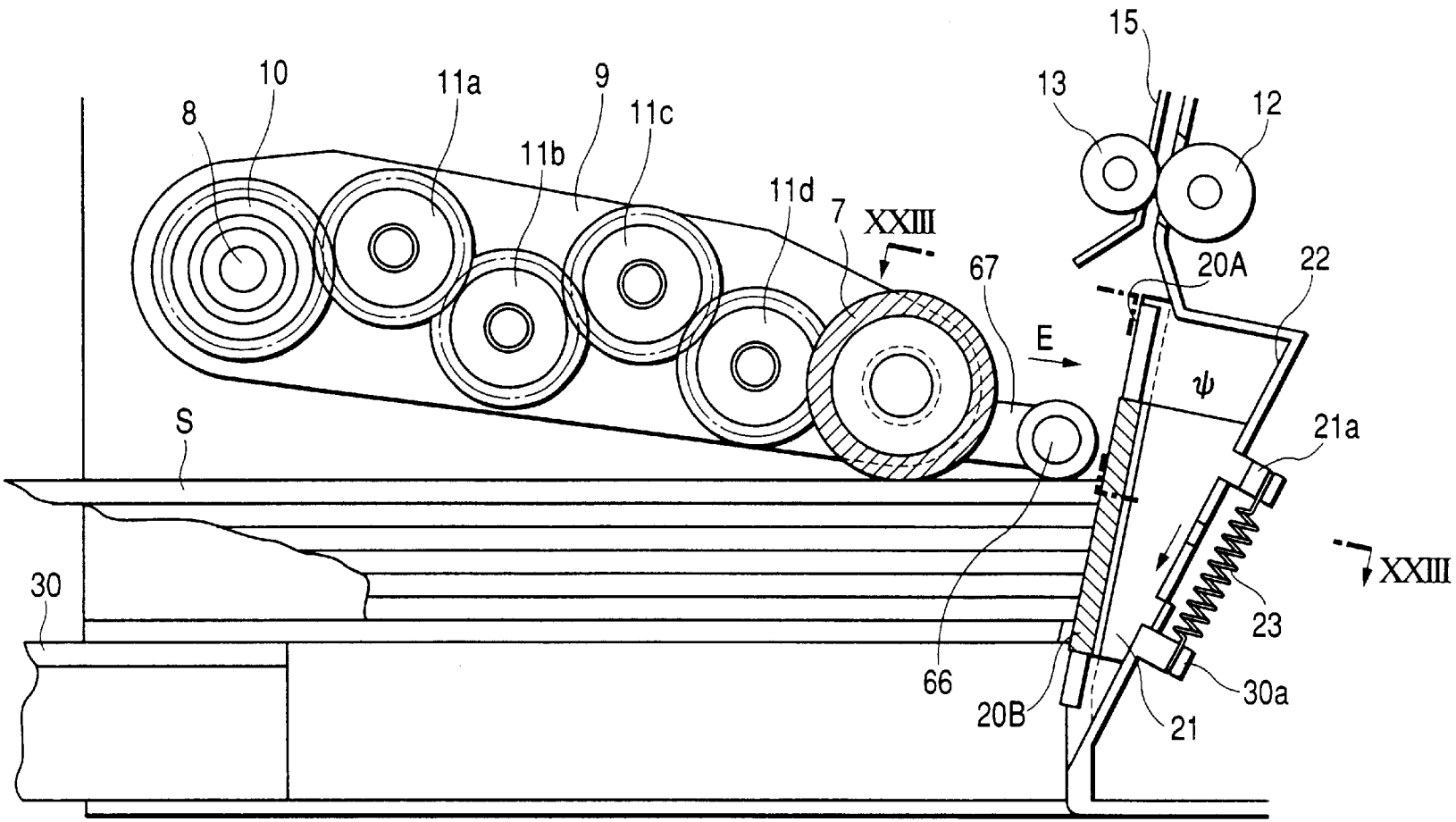
FIG. 20 is a view showing a construction of a sheet feeding apparatus according to an alteration of the second embodiment of the present invention.
Figure 21:
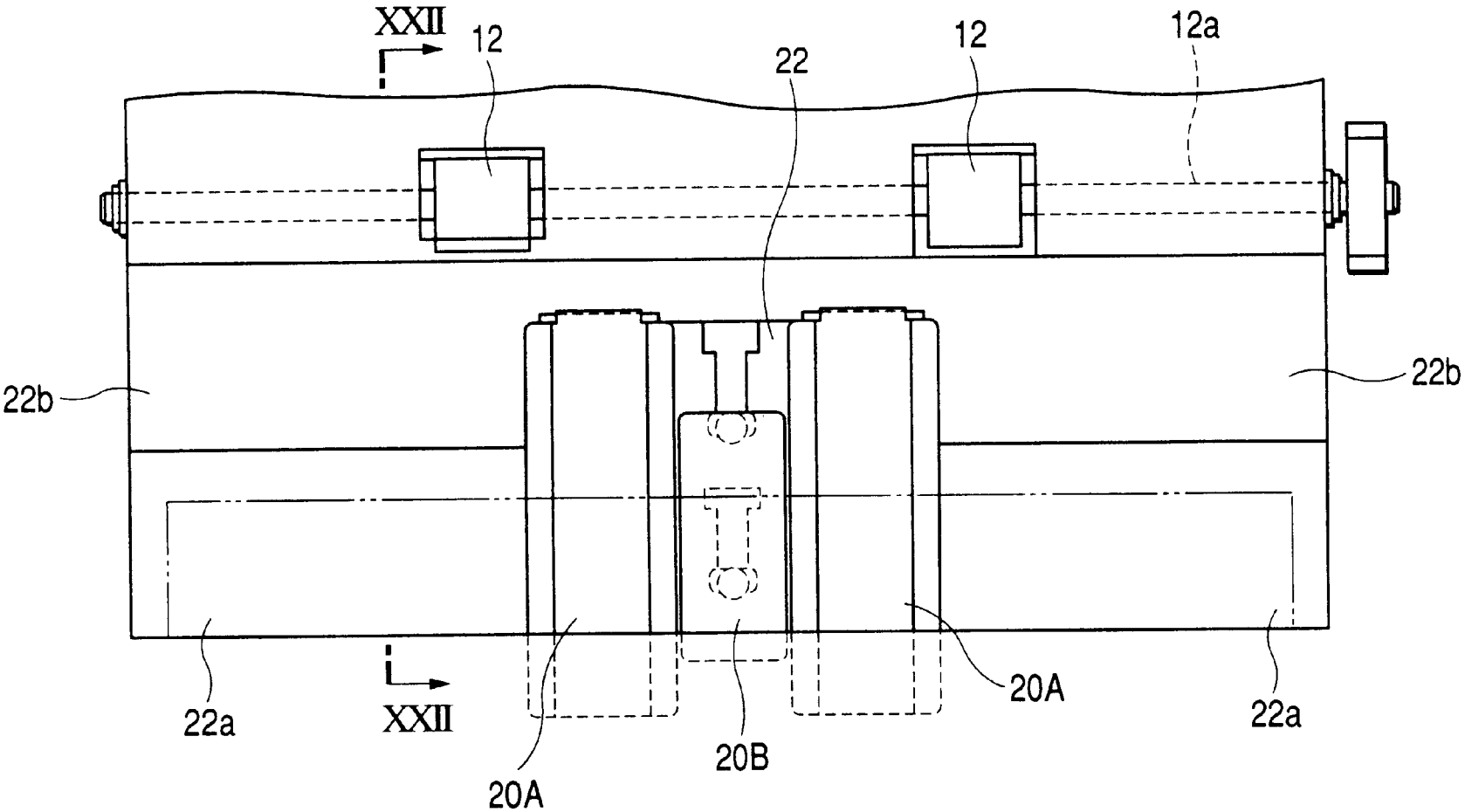
FIG. 21 is a view looked at from a direction shown by the arrow E in FIG. 20.
Figure 22:
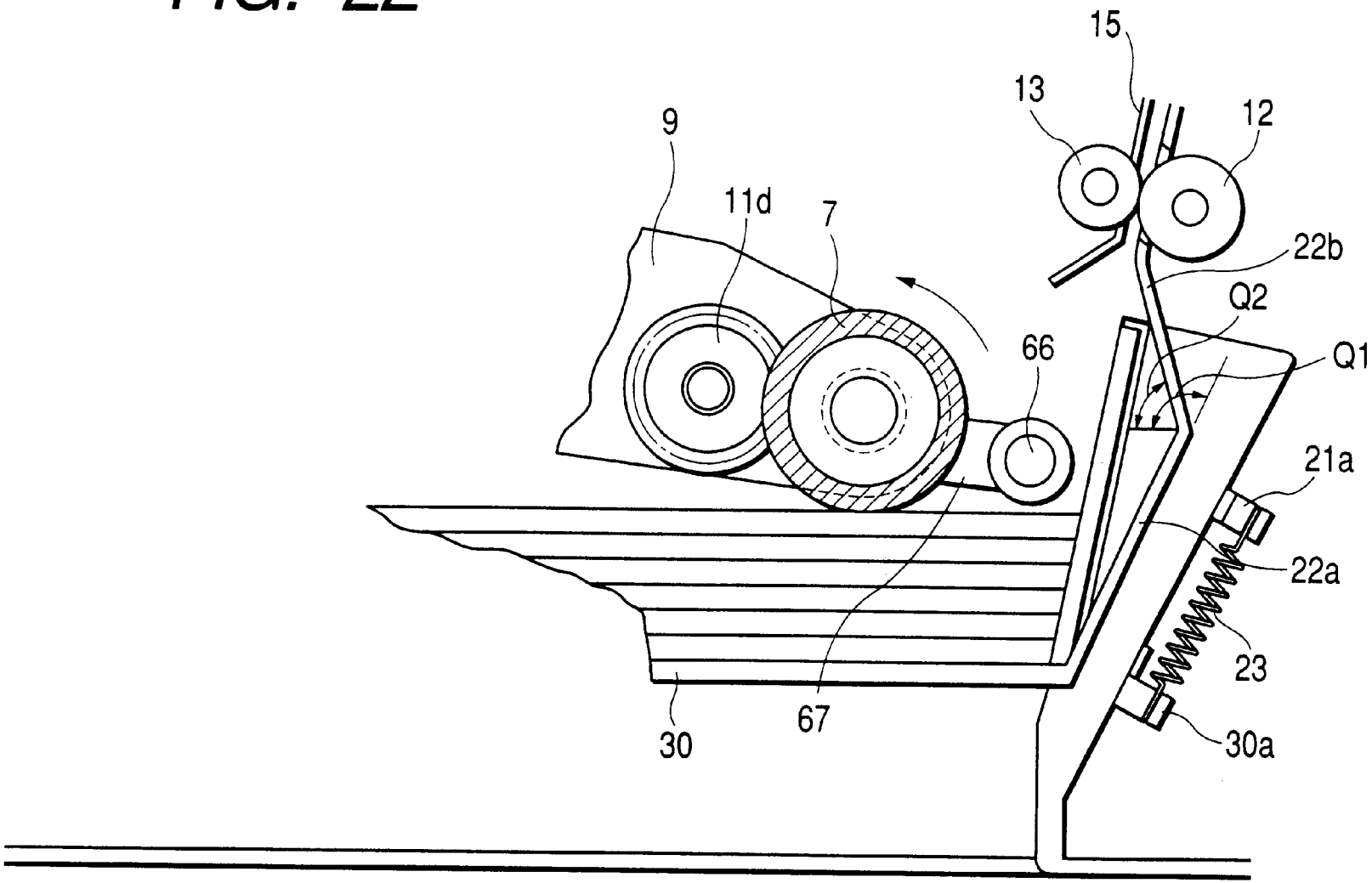
FIG. 22 is a sectional view taken along the line XXII—XXII in FIG. 21.

FIG. 21 is a view looked at from a direction shown by the arrow E in FIG. 20. In FIG. 21, the reference numeral 22*a* denotes a first conveying surface as a first guide surface situated in a range of the inclined surface reference surface 22 where the first and second separating inclined surfaces 20A, 20B are not provided; and 22*b* denotes a second conveying surface as a second guide surface forming an obtuse angle with respect to the first conveying surface 22*a*. The first and second conveying surfaces 22*a*, 22*b* constitute a guide portion for guiding the sheet. Incidentally, as shown in FIG. 22 which is a sectional view taken along the line XII—XII in FIG. 21, the first conveying surface 22*a* forms an angle of θ1 with respect to the sheet feeding tray 30, and the second conveying surface 22*b* forms an angle of θ2 with respect to the sheet feeding tray 30.

By providing two conveying surfaces 22*a*, 22*b* in this way, when the thick sheet is fed, resistance acting on the leading end of the sheet can be reduced and be set more properly.

Figure 23:
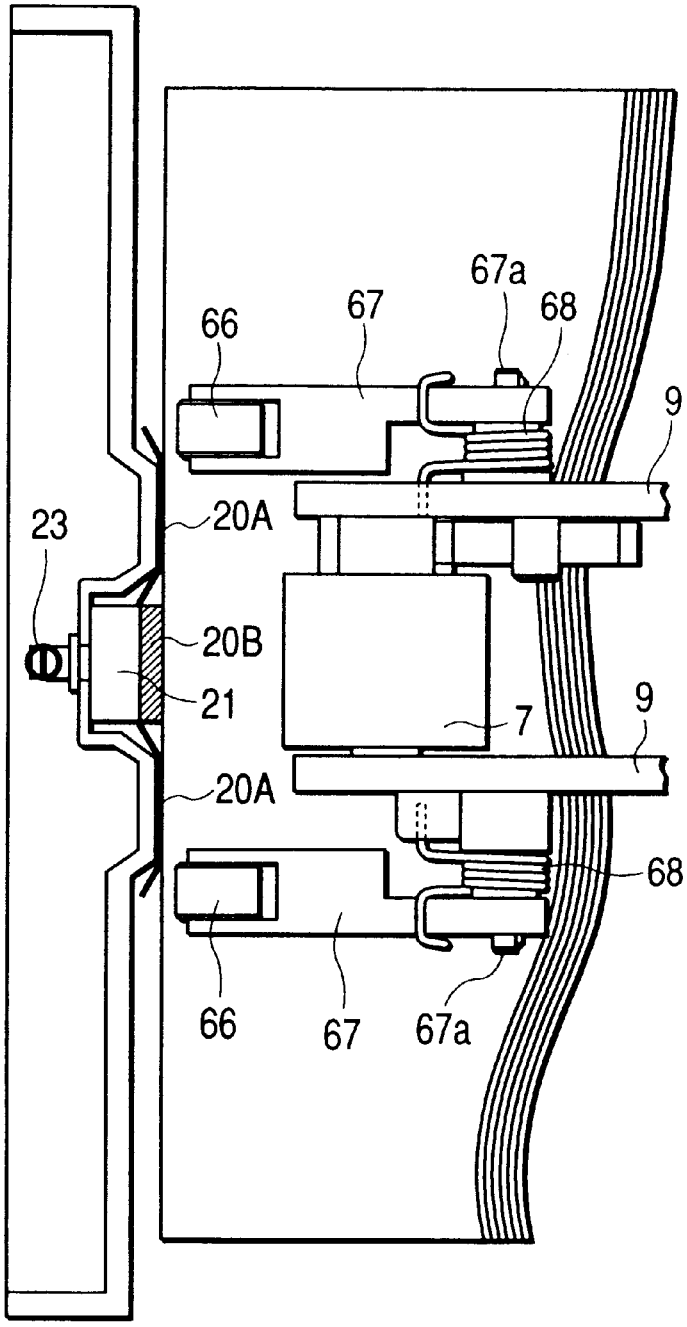
FIG. 23 is a sectional view taken along the line XXIII—XXIII in FIG. 20.

Further, in the illustrated embodiment, the second separating inclined surface 20B is in flush with the first separating inclined surfaces 20A or is more protruded toward the sheet stacking portion than the first separating inclined surfaces 20A when the second separating inclined surface does not receive from the sheet (stack) S in the initial condition, as shown in FIG. 23 which is a view taken along the line XXIII—XXIII in FIG. 20.

The reference numeral 66 denotes urging sub-rollers as urging members for urging the upper surface of the sheet (stack) S downwardly between the sheet feeding roller 7 and the first and second separating inclined surfaces 20A, 20B; 67 denotes sub-roller holders for holding the urging sub-rollers 66; and 68 denotes sub-roller springs mounted around sub-roller holder shafts 67*a* provided on the sheet feeding roller arm 9 and adapted to bias the respective sub-roller holders 67 toward the sheet stack. The attachment arrangement and function of these urging sub-rollers 66 are the same as those in the embodiment explained in connection with FIGS. 11 to 13.

Next, a sheet feeding operation of the sheet feeding apparatus having the above-mentioned construction will be explained with reference to FIGS. 24 to 26.

When the sheet feeding is started, the sheet feeding roller 7 is rotated, with the result that the feeding force due to the friction force between the sheet feeding roller 7 and the sheet stack acts on the uppermost sheet S1. By this feeding force, the uppermost sheet S1 is subjected to a reaction force against the friction force by means of the first and second separating inclined surfaces 20A, 20B trying to stop the movement of the sheet S1.

Figure 24:
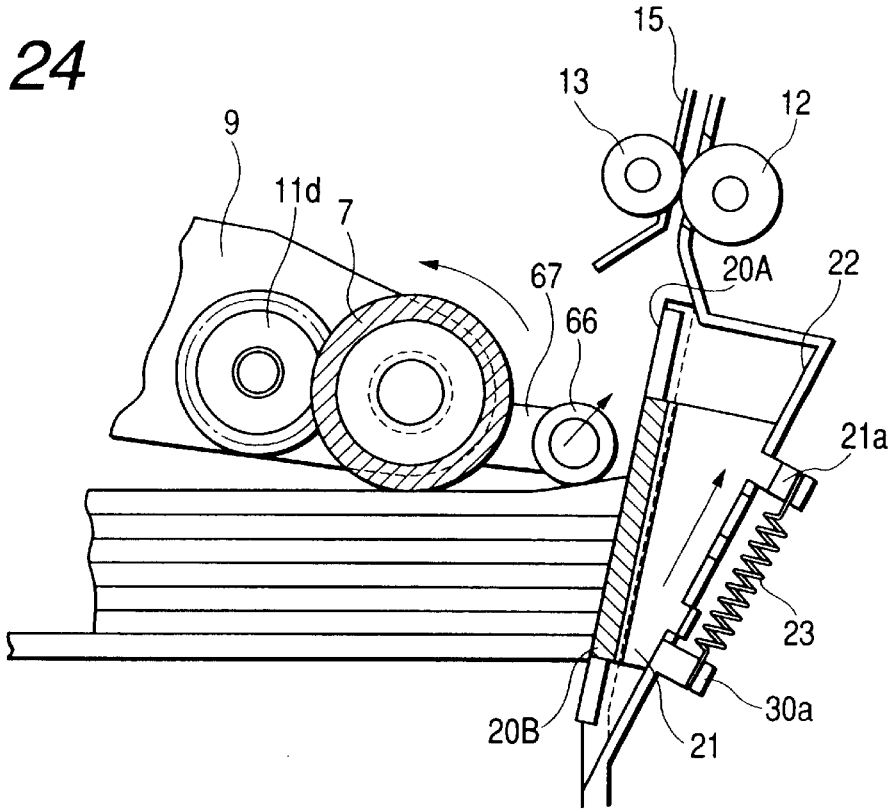
FIG. 24 is a view showing an initial stage of a sheet feeding operation of the sheet feeding apparatus.
Figure 25:
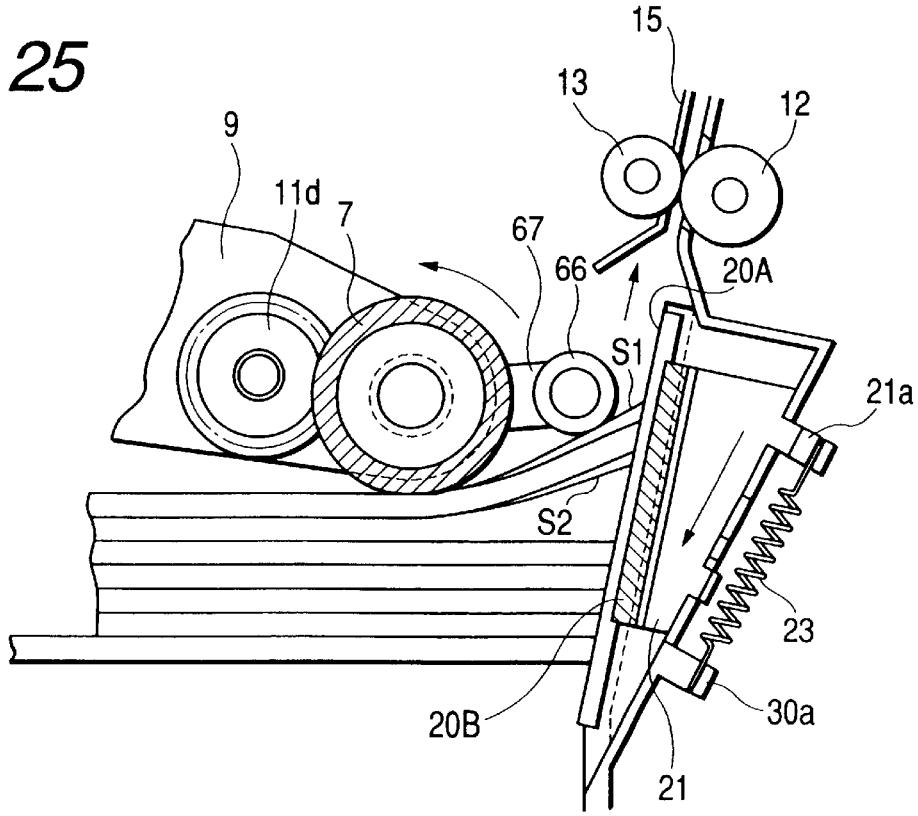
FIG. 25 is a view showing an intermediate stage of the sheet feeding operation of the sheet feeding apparatus.

In this case, when the second separating inclined surface 20B receives the conveying force from the leading end of the sheet, the inclined surface holding member 21 is lifted along the inclined surface reference surface 22 as shown in FIG. 24 and is gradually shifted toward that side more than the first separating inclined surfaces 20A as shown in FIG. 25, due the inclination of the inclined surface reference surface 22.

When the inclined surface holding member 21 is shifted in this way, the contact pressure between the sheet S1 and the second separating inclined surface 20B is decreased, with the result that the leading end of the sheet S1 starts to be slid on the second separating inclined surface 20B faster than the above-mentioned embodiment. Consequently, the shifting movement of the inclined surface holding member 21 (the second separating inclined surface 20B) in the direction shown by the arrow effected by the inclined surface spring 23 is hastened.

Figure 26:
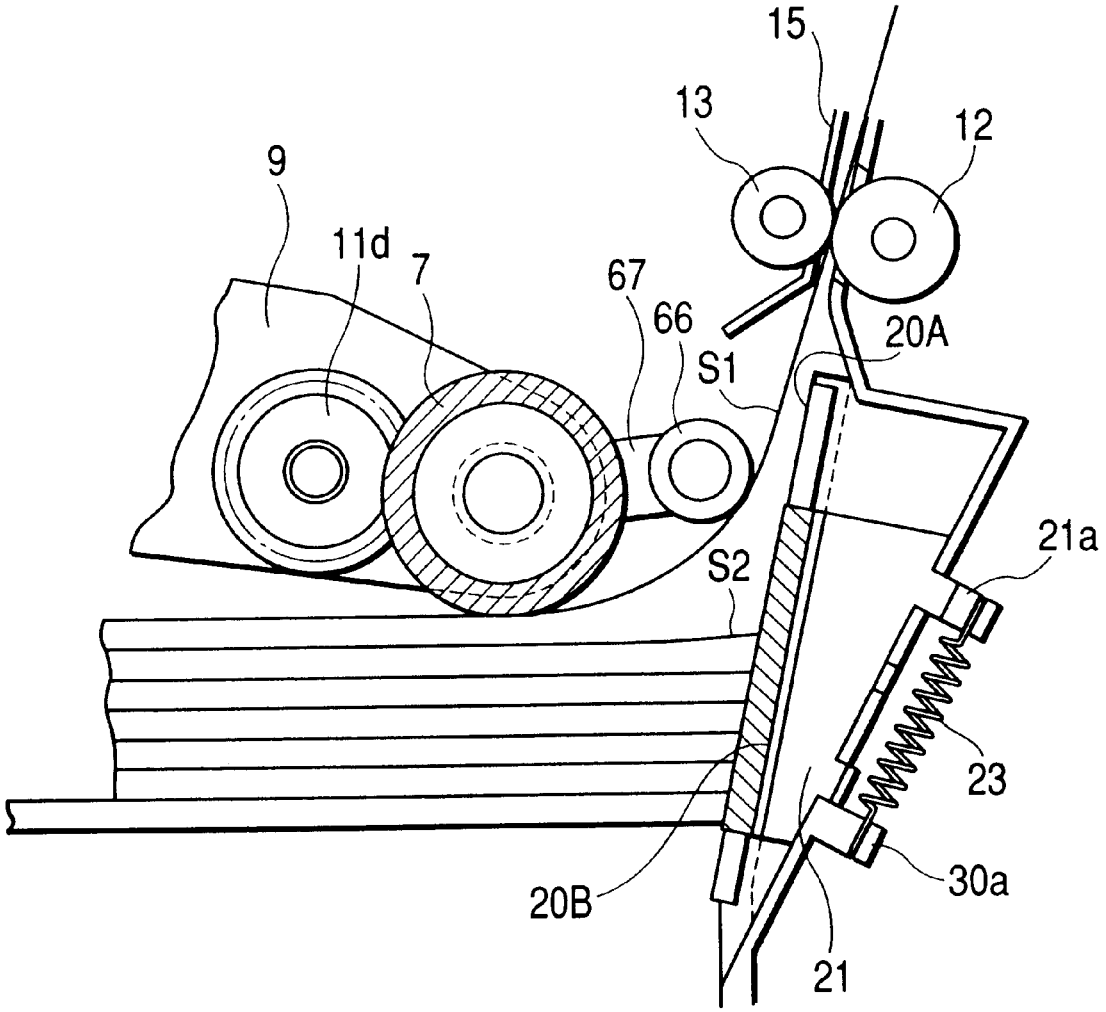
FIG. 26 is a view showing a final stage of the sheet feeding operation of the sheet feeding apparatus.

When the inclined surface holding member 21 (the second separating inclined surface 20B) is shifted in this way, the second separating inclined surface 20B is again protruded toward the sheet stacking portion (see FIG. 26) to abut against the next sheet S2 trying to be double-fed, with the result that advance movement of the next sheet S2 trying to be double-fed is stopped by such an abutting force, as shown in FIG. 26.

In this way, before the sheet feeding operation, by maintaining the second separating inclined surface 20B in flush with the first separating inclined surfaces 20A or by protruding the second separating inclined surface toward the sheet stacking portion, the separating ability when the sheet feeding operation is started can be obtained. Further, during the sheet feeding, by shifting the second separating inclined surface 20B temporarily at the same speed as the leading end of the sheet to shift the second separating inclined surface 20B toward that side more than the first separating inclined surfaces 20A thereby to weaken the abutting force between the leading end of the sheet and the second separating inclined surface, the leading end of the sheet can be slid on the second separating inclined surface 20B and the separating effect due to the distortion of the leading end of the sheet can be obtained.

Incidentally, when the thick sheet is fed, since the second separating inclined surface 20B is pushed-in by the feeding force to be retracted toward that side more than the first separating inclined surfaces 20A, the second separating inclined surface 20B is not contacted with the leading end of the sheet, with the result that the same sheet feeding operation as the case where there is no second separating inclined surface 20B can be effected. Further, by avoiding the contact between the second separating inclined surface 20B with the leading end of the sheet in this way, the load of the sheet feeding drive is reduced, thereby the upper limit of the thick sheet to be handled.

Next, another alteration of the second embodiment of the present invention will be explained.

Figure 27:
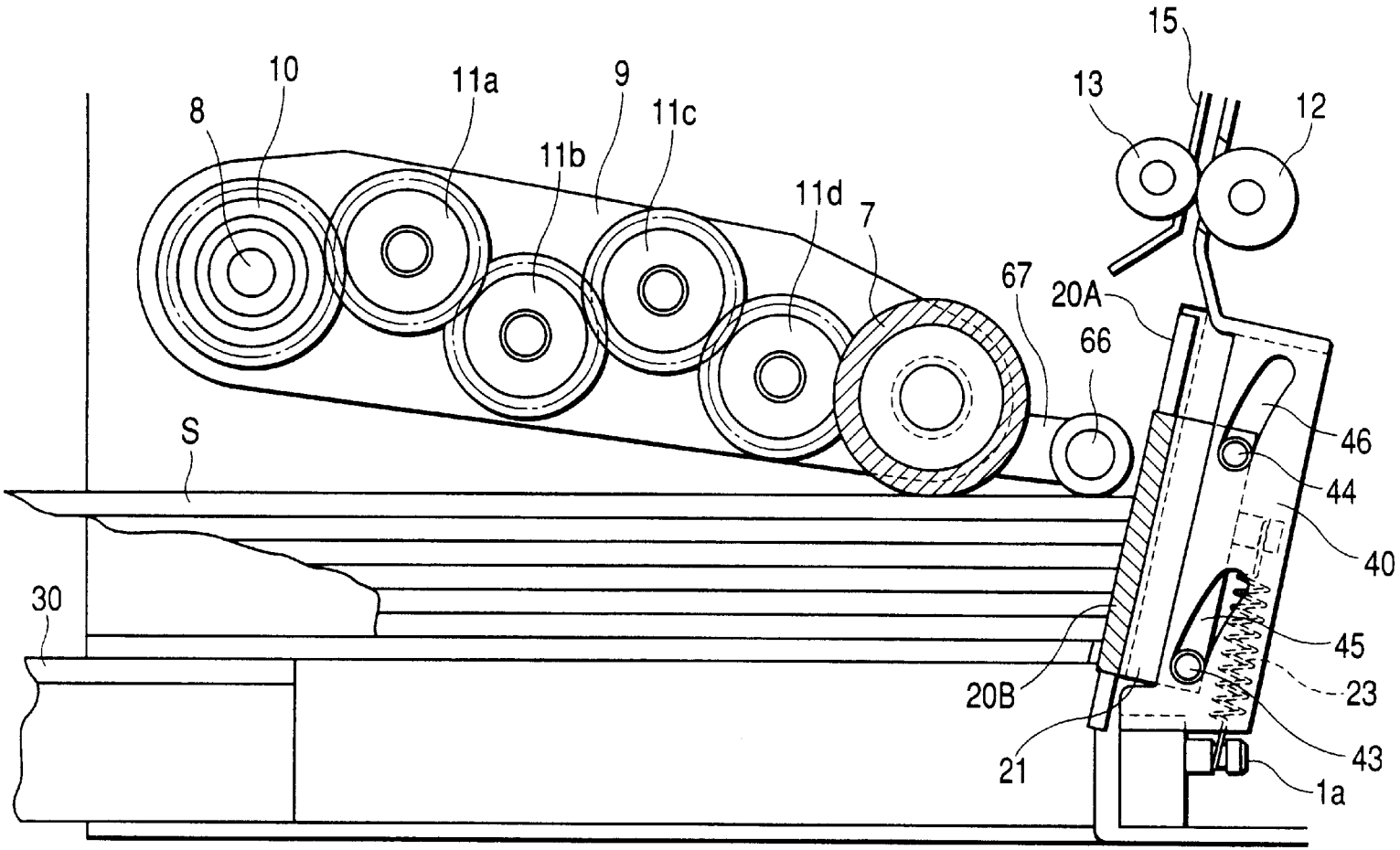
FIG. 27 is a view showing a construction of the sheet feeding apparatus according to an alteration of the second embodiment of the present invention.
Figure 28:
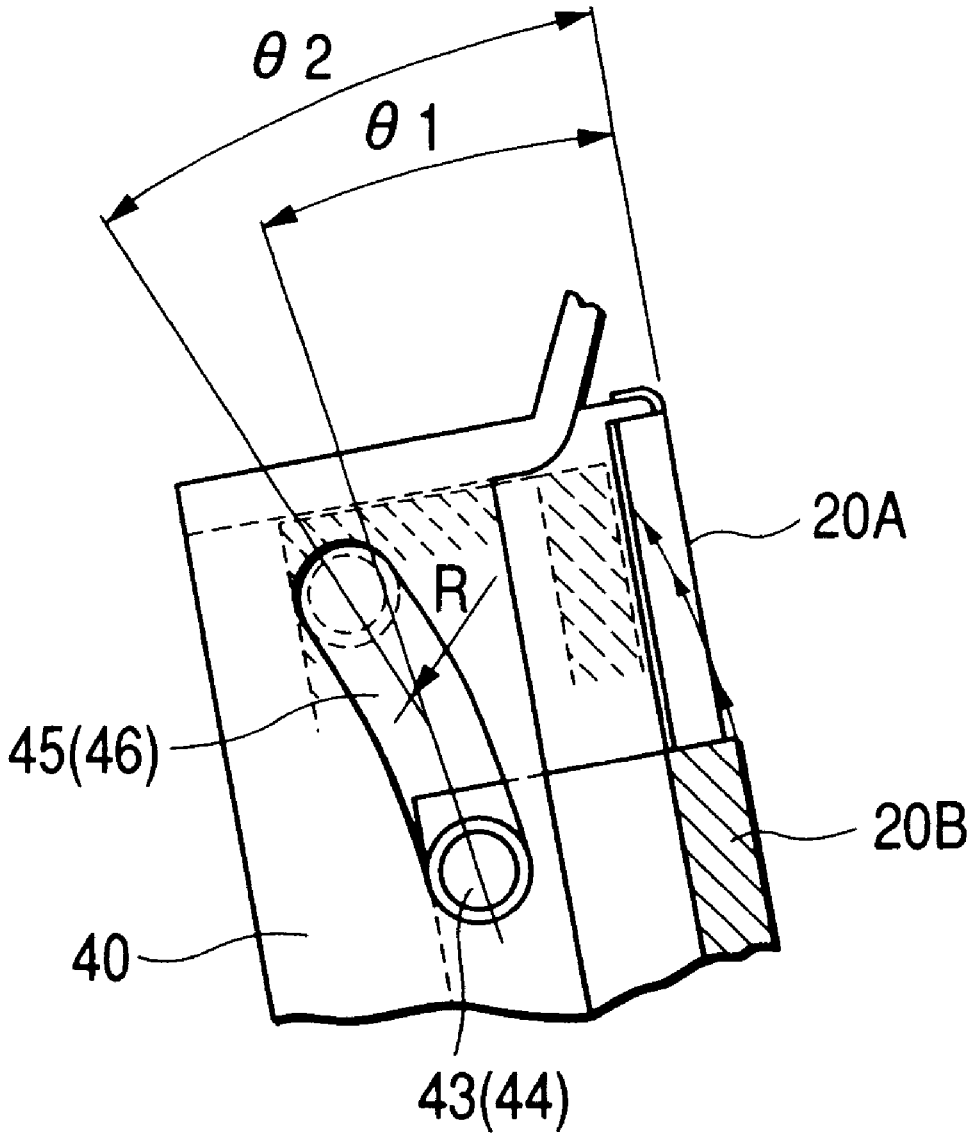
FIG. 28 is an enlarged view of main parts of the sheet feeding apparatus of FIG. 27.

FIGS. 27 and 28 are views for explaining a construction of a sheet feeding apparatus according to this alteration. Incidentally, in FIGS. 27 and 28, the same reference numerals as those shown in FIG. 20 designate the same or similar parts.

In FIGS. 27 and 28, the reference numeral 40 denotes an inclined surface reference surface for holding the inclined surface holding member 21 (second separating inclined surface 20B) for shifting movement in the sheet feeding direction; 43 denotes a first boss provided at a side lower part of the inclined surface holding member 21; and 44 denotes a second boss provided at a side upper part of the inclined surface holding member 21. Incidentally, these first and second bosses 43, 44 are also provided on the other side of the inclined surface holding member 21 symmetrically.

First and second curved elongated holes 45, 46 are provided in the inclined surface reference surface 40 and serve to lock the first and second bosses 43, 44 in such a manner that the inclined surface holding member 21 is supported for movement within a predetermined range. The first and second bosses 43, 44 are located at positions shown by the solid line in FIG. 28 when the urging force of the sheet (stack) S does not act on the second separating inclined surface 20B, and, when the urging force of the sheet (stack) S acts on the second separating inclined surface, the bosses are shifted along the first and second elongated holes 45, 46.

That is to say, in the initial stage of the sheet feeding operation, the first and second bosses 43, 44 are shifted in the directing forming the angle θ1 with respect to the first separating inclined surface 20A, and, when the urging force is increased, after advancing directions of the bosses are gently changed by the curvatures R of the first and second elongated holes 45, 46, the bosses are shifted to the direction forming the angle θ2 with respect to the first separating inclined surfaces 20A.

With this arrangement, the second separating inclined surface 20B is initially protruded more than the first separating inclined surfaces 20A, and, when the conveying force from the sheet is applied, the second separating inclined surface is retracted to that side more than the first separating inclined surfaces 20A. Further, by using the curved first and second elongated holes 45, 46, a relationship between the upward shifting amount of the second separating inclined surface 20B and the protruded and retracted amount of the second separating inclined surface with respect to the first separating inclined surfaces 20A can be made non-linear.

Thus, by changing the configurations of the first and second elongated holes 45, 46, the performance of the second separating inclined surface 20B can be varied with the kind of sheet to be used, thereby selecting the optimum setting. Further, when the second separating inclined surface 20B is returned from the position immediately after the sheet feeding to the original position, by setting so that the second separating inclined surface is shifted toward the sheet, the sheet trying to be double-fed can effectively be prevented.

Next, a third embodiment of the present invention will be explained.

Figure 29:
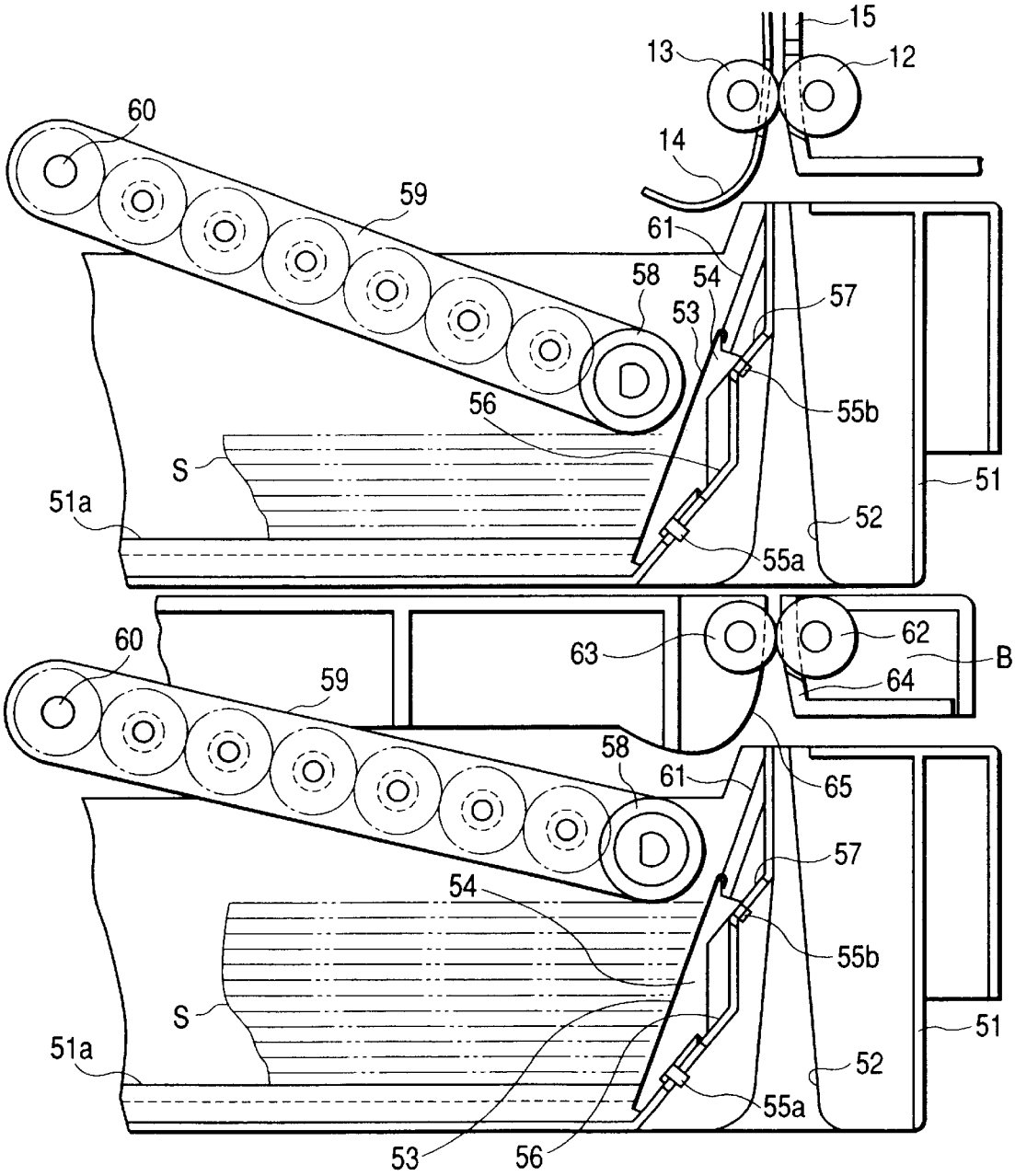
FIG. 29 is a view showing a construction of a sheet feeding apparatus according to a third embodiment of the present invention.
Figure 30:
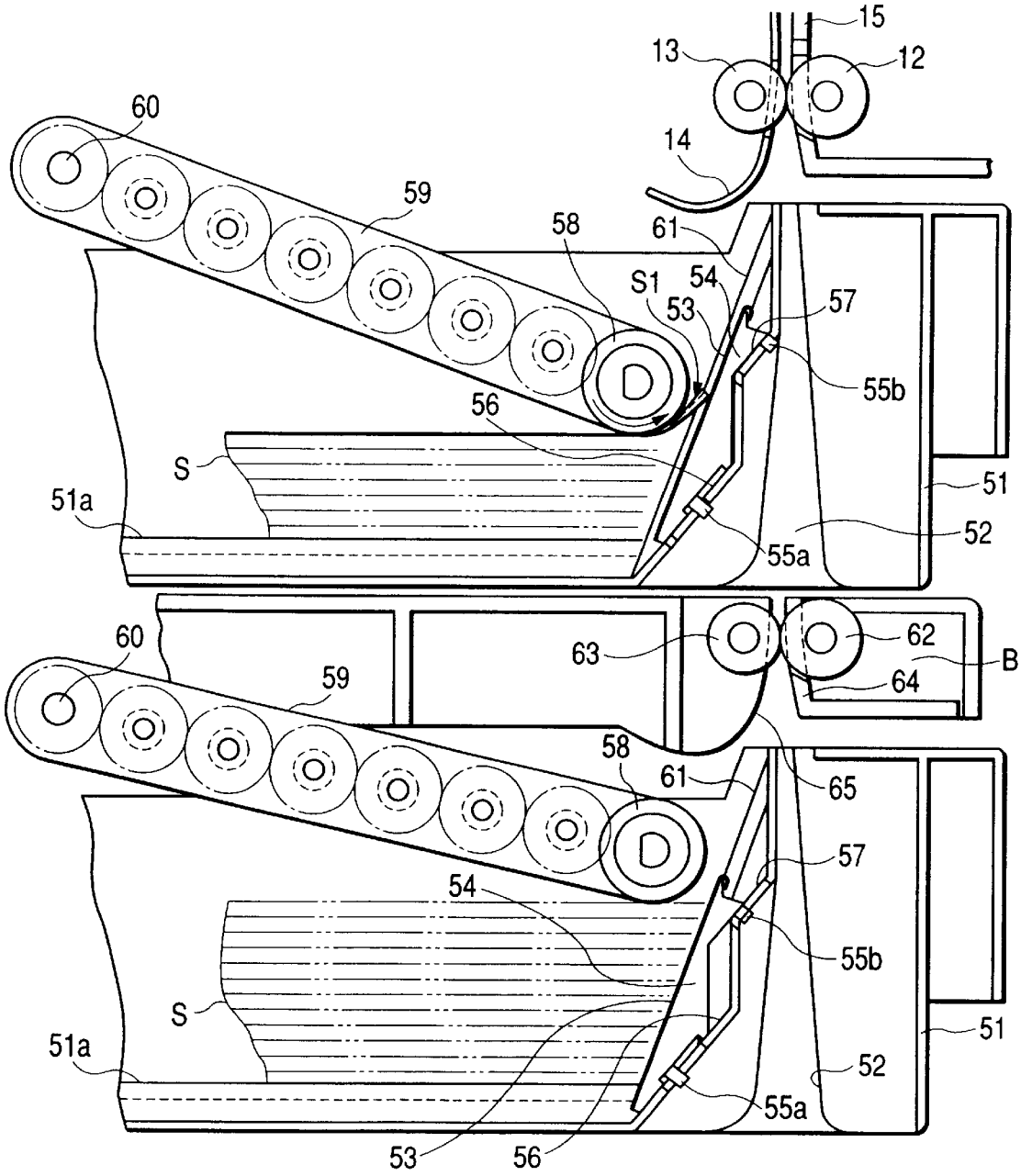
FIG. 30 is a view showing the sheet feeding apparatus of FIG. 29 in a condition that a sheet is fed.
Figure 31:
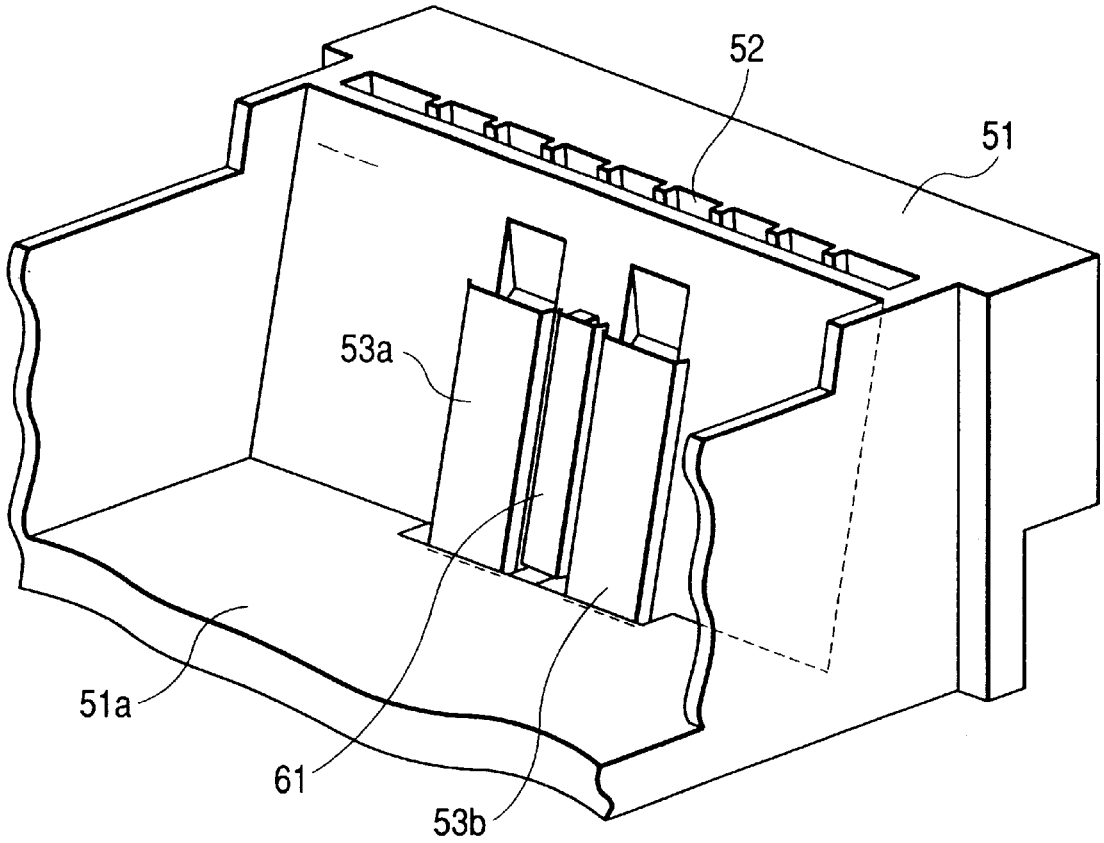
FIG. 31 is a perspective view showing main parts of the sheet feeding apparatus of FIG. 29.

FIG. 29 is a schematic sectional view of a sheet feeding apparatus according to the third embodiment of the present invention. Further, FIG. 30 is a view showing the sheet feeding apparatus according to the third embodiment immediately after a sheet feeding operation is started, and FIG. 31 is a perspective view for explaining a state of an installation plane for an inclined surface member of a sheet feeding tray in this embodiment. Incidentally, in FIGS. 29 to 31, the same reference numeral as those shown in FIG. 1 designate the same or similar parts.

In FIG. 29, the sheet feeding apparatus includes sheet feeding trays (sheet feeding cassettes) 51 each having a sheet stacking surface 51*a*. Two sheet feeding trays are arranged in an up-and-down direction and have the identical construction. An option path 52 is provided in each sheet feeding tray 51, and a separating inclined surface 53 is disposed at a side end of each sheet feeding tray 51. In FIG. 29, the separating inclined surfaces 53 are located at their initial positions before the sheet feeding operation.

An inclined surface holding member 54 is shiftable with respect to each sheet feeding tray 51 while fixing the corresponding separating inclined surface 53. In the illustrated embodiment, the inclined surface holding members 54 are not provided with associated biasing means and are returned to initial positions shown in FIG. 29 by the weights of the separating inclined surfaces 53 and of the inclined surface holding members 54.

Posture positioning pins 55*a*, 55*b* are provided on the corresponding inclined surface holding member 54, a lower stage slide surface 56 is provided on the corresponding sheet feeding tray 51, and an upper stage slide surface 57 is also provided on the corresponding sheet feeding tray 51 and is staggered with respect to the corresponding lower stage slide surface 56 in parallel therewith. Each inclined surface holding member 54 can be slid on both the lower stage slide surface 56 and the upper stage slide surface 57 and the posture thereof is positioned by elongated slots formed in the lower stage slide surface 56 and the upper stage slide surface 57 and the posture positioning pins 55*a*, 55*b*.

A support inclined surface 61 is fixedly arranged at a position more spaced apart from the sheet stacking range (sheet containing portion) than the corresponding separating inclined surface 53 (FIG. 29) substantially in parallel with the separating inclined surface 53. Each support inclined surface 61 is formed from material applying conveying resistance smaller than that of the separating inclined surface 53 to the leading end of the sheet.

By providing two stage slide surfaces, installation area is more reduced than the slide member shown in FIG. 17, with the result that the option path 52 can be arranged to extend in the up-and-down direction as shown in FIG. 29.

Each sheet feeding tray 51 is associated with a sheet feeding roller 58, and a sheet feeding roller arm unit 59 having one end rotatably held on an arm shaft 60 and the other end for holding the sheet feeding roller 58 and including therein driving means for transmitting a driving force to the sheet feeding roller 58.

In FIG. 29, according to the illustrated embodiment, there is provided an option feeder B which includes an option conveying roller 62, an option conveying sub-roller 63, an option lower sheet feeding guide 64 for guiding a lower surface of the leading end of the sheet fed from the sheet feeding tray 51 mounted to the option feeder B, and an option upper sheet feeding guide 65 for guiding an upper surface of the leading end of the sheet fed from the sheet feeding tray 51 mounted to the option feeder B.

In FIG. 30, the sheet being fed is denoted by "S1".

FIG. 31 is a view showing disposition of the separating inclined surface 53 and the support inclined surface in a width-wise direction of the sheet in the illustrated embodiment. In FIG. 31, the reference numerals 53*a* and 53*b* denote left and right separating inclined surfaces disposed in the width-wise direction of the sheet. As shown in FIG. 31, in the illustrated embodiment, there are provided a plurality of separating inclined surfaces, and support inclined surface(s) therebetween.

A surface of the support inclined surface 61 has lower coefficient of friction than those of the left separating inclined surface 53*a* and the right separating inclined surface 53*b* to provide increased slipping ability. Further, when the left separating inclined surface 53*a* and the right separating inclined surface 53*b* are located at lower positions (initial positions), the support inclined surface 61 is more retracted than the left separating inclined surface 53*a* and the right separating inclined surface 53*b* (refer to FIG. 32A), and, when the left separating inclined surface 53*a* and the right separating inclined surface 53*b* are shifted upwardly, the support inclined surface is more protruded toward the sheet stacking range than the left separating inclined surface 53*a* and the right separating inclined surface 53*b*.

Next, a sheet separating operation of the sheet feeding apparatus having the above-mentioned construction will be explained.

By the rotation of the sheet feeding roller 58, the feeding force due to the friction force between the uppermost sheet and the sheet feeding roller 58 acts on the uppermost sheet, with the result that the uppermost sheet starts to advance to the left. In this case, the leading end of the sheet abut against the separating inclined surface 53 to be bent along the separating inclined surface 53. In this case, the uppermost sheet is separated from the other sheets. Thereafter, the rotation of the sheet feeding 58 continues, the leading end of the sheet is sent into a nip between the conveying roller 12 and the conveying sub-roller 13 and then is conveyed to an image forming apparatus (not shown) by a conveying force of the conveying roller pair.

If rigidity of the sheet to be fed is great, since the force applied to the separating inclined surface 53 is increased, the left separating inclined surface 53*a* and the right separating inclined surface 53*b* are pushed upwardly together with the inclined surface holding member 54 by the feeding force applied from the sheet feeding roller 58. In this case, the inclined surface holding member 54 is guide by the lower stage guide surface 56 and the upper stage slide surface 57 to be shifted along the sliding direction defined by the slide surfaces.

Figure 32A:
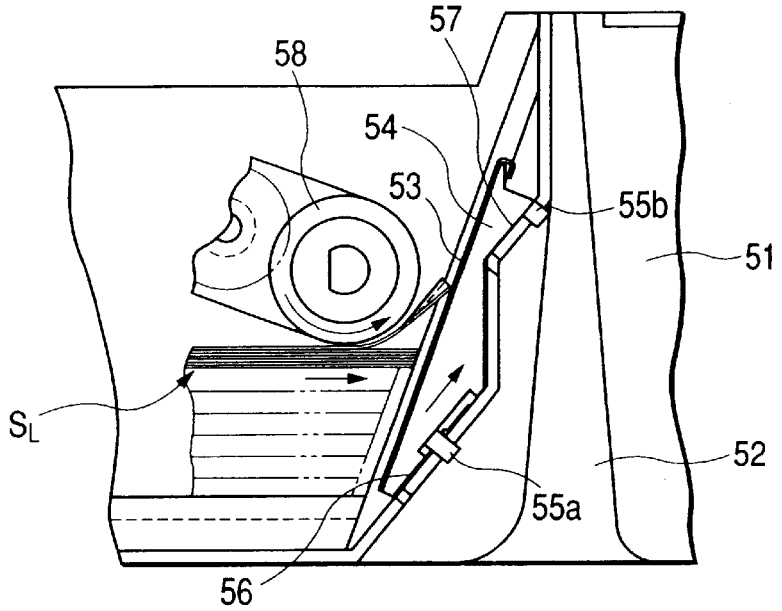
FIGS. 32A and 32B are enlarged view showing main parts of the sheet feeding apparatus of FIG. 29 in a sheet separating condition.

As shown in FIG. 32A, when the shifting amount of the left separating inclined surface 53*a* and the right separating inclined surface 53*b* exceeds a predetermined amount, the leading end of the sheet abuts against the support inclined surface 61 protruded from the left separating inclined surface 53*a* and the right separating inclined surface 53*b*. Since the surface of the support inclined surface 61 has more increased slipping ability than those of the left separating inclined surface 53*a* and the right separating inclined surface 53*b*, a central portion of the leading end of the sheet having great rigidity starts to be slid along the support inclined surface 61. As a result, the advancing direction of the sheet becomes a direction of the support inclined surface 61 in the range where the sheet abuts against the support inclined surface 61 and becomes a direction of the slide surface in the range where it abuts against the separating inclined surfaces. Consequently, as the leading end of the sheet is advanced, abutting degree of the leading end of the sheet against the left separating inclined surface 53*a* and the right separating inclined surface 53*b* is reduced, with the result that the leading end of the sheet is gradually shifted toward the direction of the support inclined surface 61.

Figure 32B:
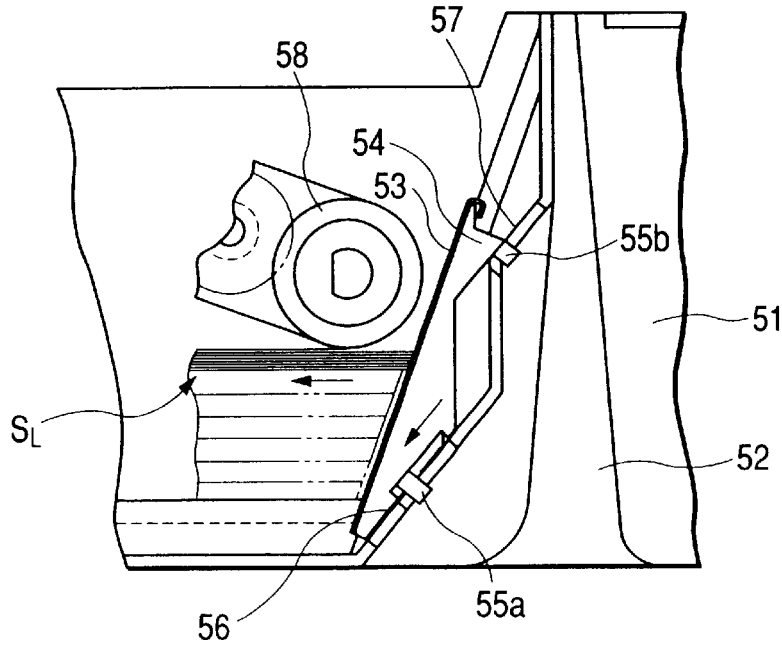

If a sheet having a surface having significantly smaller coefficient of friction than those of the other sheets is a inclined in the sheet stack, several sheets immediately above the surface having the low coefficient of friction may be shifted in front and in the rear in synchronous with movement of the sheet feeding roller 58. FIGS. 32A and 32B show such conditions. In FIGS. 32A and 32B, the surface having the low coefficient of friction is denoted by "SL". Also in such a case, since the range of movement in front and in the rear is determined by the support inclined surface 61, the sheet feeding can be effected without double-feeding.

Incidentally, in the illustrated embodiment, since the inclined surface holding member 54 is subjected to only its own weight, even if the separating inclined surfaces are lifted by the leading end of the sheet having great rigidity, the identical resistance force is always applied from the left separating inclined surface 53*a* and the right separating inclined surface 53*b*.

With the arrangement as mentioned above, the following effects can be achieved.

(1) By providing the plurality of slide surfaces, great space can be reserved in the back, with the result that the option path can easily be provided.

(2) By providing the support inclined surface in the center, the direction of the thick sheet can be changed quickly, thereby improving the thick sheet feeding ability.

(3) By using the slide separating inclined surfaces biased toward the shifting direction only by their own weights, the identical resistance can be applied to the leading end of the sheet regardless of the lifted amount of the slide separating inclined surfaces, the damage of the leading end of the sheet can be prevented during the thick sheet feeding.

Next, a fourth embodiment of the present invention will be explained.

Figure 33:
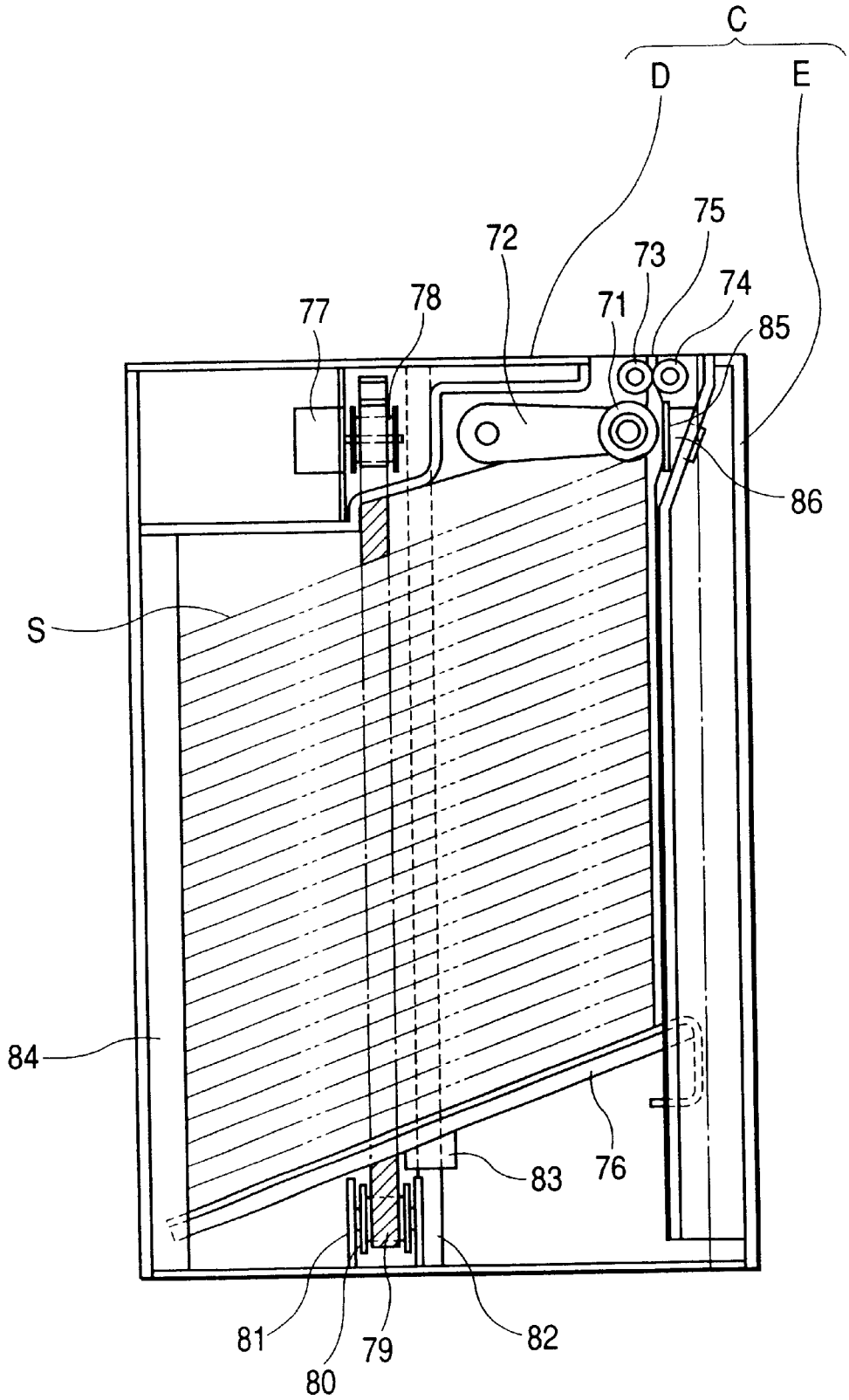
FIG. 33 is a longitudinal sectional view of a sheet feeding apparatus according to a fourth embodiment of the present invention.
Figure 34:
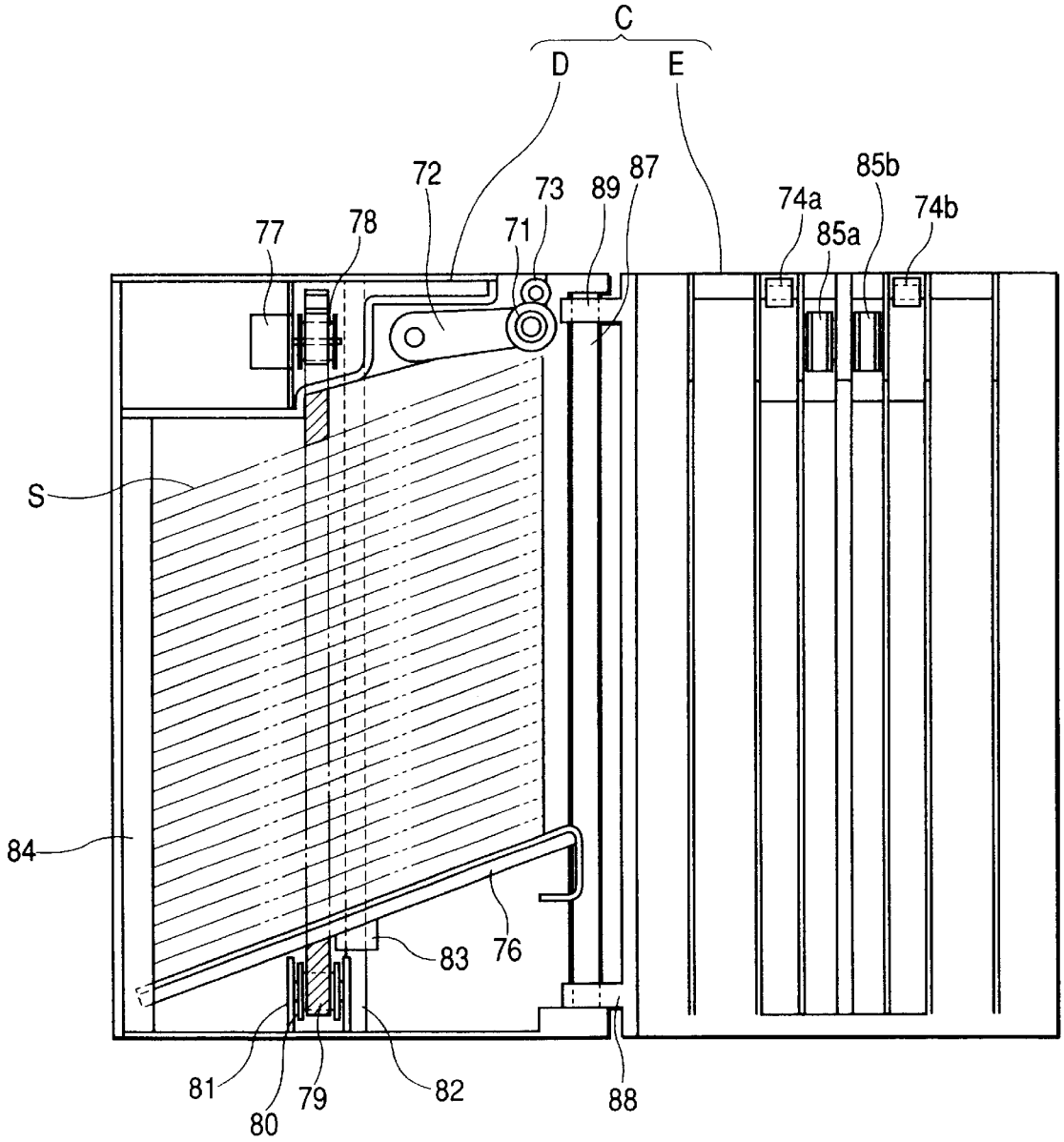
FIG. 34 is a view showing the sheet feeding apparatus of FIG. 33 in a condition that a front door unit is opened.
Figure 35:
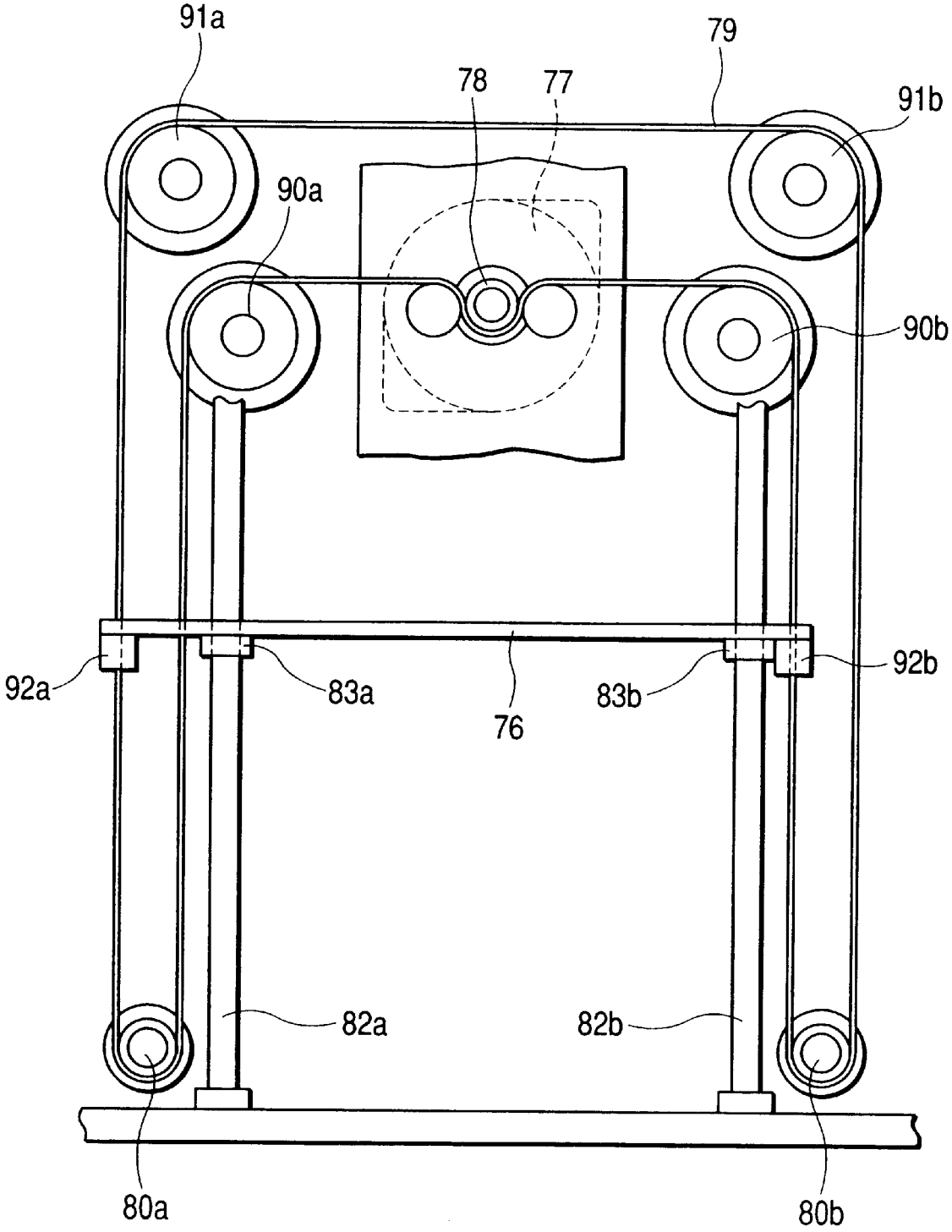
FIG. 35 is a view for briefly explaining a sheet lifter driving mechanism of the sheet feeding apparatus of FIG. 33.

FIG. 33 is a schematic sectional view of a large capacity sheet feeding apparatus according to the fourth embodiment. Further, FIG. 34 is a view showing the sheet feeding apparatus in a condition that a front door is opened, and FIG. 35 is a conceptional view for explaining a stacking plate lifting/lowering mechanism in this embodiment.

In FIG. 33, the large capacity sheet feeding apparatus C includes a main body D of a large capacity tray mechanism, and a front door unit E rotated when sheets are replenished. In FIG. 33, the reference numeral 71 denotes a sheet feeding roller; 72 denotes a sheet feeding roller arm including therein driving means for transmitting a driving force to the sheet feeding roller 71; 73 denotes conveying rollers; 74 denotes conveying sub-rollers opposed to the conveying rollers and biased toward the conveying rollers 73 by urging means (not shown).

In this embodiment, two pairs of conveying rollers/sub-rollers are arranged in a direction perpendicular to a plane of FIG. 33. A conveying path 75 is opposed to a sheet inlet of an image forming apparatus (not shown). A sheet lifter 76 movable in an up-and-down direction by control has a sheet stacking surface inclined so that a conveying direction directs toward the vertical direction. A lift motor 77 serves to control the up-down movement of the sheet lifter 76, and a driving pulley 78 is directly connected to the lift motor. In the illustrated embodiment, for the purpose of explanation, while the driving pulley 78 was directly connected to the lift motor 77, it may be connected to the lift motor via a driving system. The reference numeral 79 denotes a lifter driving belt; 80 denotes idler pulleys B; 81 denotes regulating means for holding the idler pulleys B80; 82 denotes positioning posts for determining a shifting direction of the sheet lifter 76; and 83 denotes slide bearings secured with respect to the sheet lifter 76.

In the illustrated embodiment, two pairs of positioning posts 82, slide bearings 83 and idler pulleys B80 are arranged in the direction perpendicular to the plane of FIG. 33. The reference numeral 84 denotes a trailing end regulating member for positioning a position of a trailing end of the sheet; 85 denotes two separating inclined surface provided on the front door unit E and arranged in the direction perpendicular to the plane of FIG. 33; and 86 denotes an inclined surface holding member adapted to hold the separating inclined surface 85 and positioned in the same manner as the inclined surface holding member 54 in the third embodiment.

FIG. 34 shows a condition that the front door unit is rotated. In FIG. 34, the reference numeral 87 denotes a front door rotary shaft provided on the main body D of the large capacity tray mechanism; 88, 89 denote bearing members H, L held by the front door unit E; 74*a*, 74*b* denote conveying sub-rollers L, R; and 85*a*, 85*b* denote separating inclined surfaces L, R. FIG. 35 shows driving means for the sheet lifter 76. In FIG. 35, the reference numerals 80*a*, 80*b* denote idler pulleys B(L), B(R); 90*a*, 90*b* denote idler pulleys B(L), B(R); and 91*a*, 91*b* denote idler pulleys B(L), B(R). These idler pulleys are idler pulleys for determining a path of the lifter driving belt 79 for driving the sheet lifter 76. The reference numerals 92*a*, 92*b* denote parts of the sheet lifter as belt fixing member (L) and belt fixing member (R) for fixing predetermined positions of the lifter driving belt 79. By these fixing means, the sheet lifter 76 can be lifted and lowered smoothly as the belt is shifted. The reference numerals 82*a*, 82*b* denote positioning posts (L), (R); and 83*a*, 83*b* denote slide bearings (L), (R) secured to sheet lifter 76.

Next, a sheet feeding operation of the large capacity sheet feeding apparatus having the above-mentioned construction will be explained.

The sheet lifter 76 can be lifted and lowered by a sheet lifter driving mechanism under the rotation control of the lift motor 77. Position control of the sheet lifter is effected by a combination of the rotation control and uppermost surface detecting means and front door open/close detecting means (both are not shown).

When the front door unit E is opened, this fact is detected by the front door detecting means, thereby rotating the lift motor 77 to lower the sheet lifter. Then, by stopping the sheet lifter at a predetermined position, the large capacity sheet feeding apparatus according to the illustrated embodiment assumes a posture in which the sheets can be replenished into the apparatus by the user. In this case, it is easy to rotate the sheet feeding roller arm 72 upwardly as shown in FIG. 34 by a simple mechanism thereby to release the contact between the sheet and the sheet feeding roller arm. Further, in the illustrated embodiment, since the sheet lifter 76 is constituted to have a surface inclined downwardly toward the sheet replenishing direction, the replenishment can be effected by dropping a sheet bundle. When the replenishment is completed and the front door unit E is closed, the sheet lifter controlling means detects the closed condition by the front door detecting means and rotates the lift motor 77 to lift the sheet lifter 76 until the fact that the uppermost surface of the sheet stack reaches a predetermined height is detected by the uppermost surface detecting means.

The sheet feeding operation is effected as follows. First of all, the driving means in the sheet feeding roller arm 72 is rotated for a predetermined time period by the driving mechanism (not shown), with the result that the sheet feeding roller 71 contacted with the uppermost sheet is also rotated for a predetermined time period. Consequently, the uppermost sheet is subjected to the feeding force and is shifted to the right. In this case, when the uppermost sheet abuts against the separating inclined surfaces 85*a*, 85*b* to be bent, the uppermost sheet is separated from the other sheets by using a force required for such bending as a threshold value. When the thick sheet is fed, similar to the above-mentioned embodiments, by shifting the separating inclined surfaces 85 along the slide direction of the inclined surface holding member 54, the sheet feeding can be effected without influence of the resiliency of the sheet.

In the illustrated embodiment, by providing the separating inclined surfaces 85*a*, 85*b* and the conveying sub-rollers 74*a*, 75*b* on the front door unit, when the front door unit is opened, a view field of a space above the sheet lifter 76 is greatly opened, with the result that the sheet stacking operation, sheet feeding roller exchanging operation, sheet size changing operation and the like can easily be performed.

Incidentally, the construction of the separating portion using the separating inclined surfaces 85*a*, 85*b* may be similar to either one of those in the first to third embodiments.

With the above-mentioned arrangement, the following effects can be obtained.

(1) By using the sheet lifter having the surface inclined downwardly toward the upstream side in the sheet feeding direction, since the sheet replenishing operation can be facilitated and the separating inclined surface portion can be arranged substantially in parallel with the surface of the leading end regulating member on the sheet lifter and the height difference can easily be controlled, the sheet feeding ability can be stabilized effectively.

(2) By providing the separating inclined surface on the front door unit, the sheet stacking operation, sheet feeding roller exchanging operation, sheet size changing operation and the like can easily be performed.

(3) By adopting the sheet feeding roller arm arrangement and by inclining the sheet filter, the space can be provided in the vicinity of the upper surface of the large capacity sheet feeding apparatus. As a result, the driving mechanism for lifting and lowering the sheet lifter can be installed in the vicinity of the upper surface efficiently. Thus, efficient arrangement of electrical parts and optimum arrangement of the lifter lifting and lowering mechanism can be achieved.

Next, a fifth embodiment of the present invention will be explained.

Figure 36:
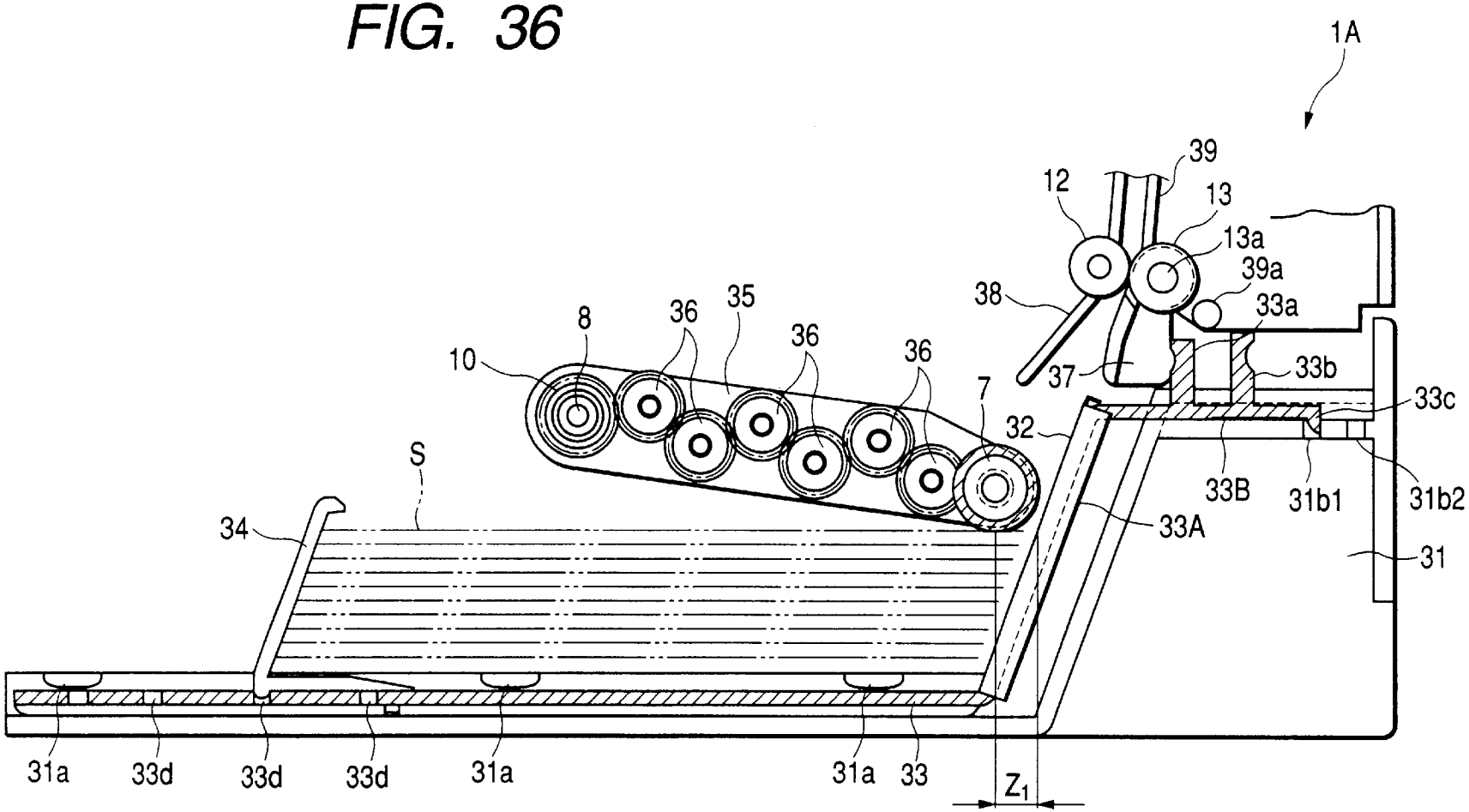
FIG. 36 is a view showing a construction of a sheet feeding apparatus according to a fifth embodiment of the present invention.

FIG. 36 is a view showing a construction of a sheet feeding apparatus according to the fifth embodiment. Incidentally, in FIG. 36, the same reference numerals as those shown in FIG. 1 designate the same or similar parts.

In FIG. 36, the sheet feeding apparatus includes a sheet feeding tray 31 detachably mounted to a main body of the apparatus, a separating inclined surface 32, a sheet holding member 33 adapted to hold the separating inclined surface 32 and slidably provided on the sheet feeding tray 31, and a stopper 31*a* for slidably positioning a position of the sheet holding member 33 in a vertical direction and forming a part of the sheet feeding tray 31. By sliding the sheet holding member 33, the separating inclined surface 32 is shifted toward and away from the sheet feeding roller 7 while maintaining a sheet abut surface in a parallel condition.

There are further provided a trailing end regulating member 34 for determining a position of an upstream end face (in the sheet feeding direction) of the sheet stack, and a plurality of trailing end positioning holes 33*d* adapted to position the trailing end regulating member 34 and provided in the sheet holding member 33. The upper can position and secure the trailing end regulating member 34 by selecting any one of the trailing end positioning holes 33*d*.

There are further provided a sheet feeding roller arm 35 having one end for rotatably holding the sheet feeding roller 7 and rotatably held on a driving shaft 8, an idler gear train 36 for transmitting a driving force of a driving gear 10 to the sheet feeding roller 7.

A lower guide member 37 is adapted to guide a lower surface of the sheet being conveyed along the separating inclined surface 32 and rotatable around a shaft 13*a* of a conveying roller 13 and biased toward an anti-clockwise direction by biasing means (not shown), an upper guide member 38 for guiding an upper surface of the sheet, a lower guide block 39 acting as a guide for the lower surface of the sheet at a downstream side of a conveying roller 12, and a boss member 39*a* for defining a rotation range of the lower guide member 37.

There are further provided first and second grip portions 33*a*, 33*b* provided on an upper end portion 33B of the sheet holding member 33 protruded from an upper end of a separating inclined surface holding member 33A, a positioning hook 33*c* formed on a distal end of the upper end portion 33B, and two positioning holes 31*b*1, 31*b*2 which are formed in the sheet feeding tray 31 and into which the positioning hook 33*c* can selectively be locked.

In the illustrated embodiment, the position of the sheet holding member 33 can be adjusted manually in accordance with a thickness of a sheet to be fed. That is to say, when a thin sheet is fed, as shown in FIG. 36, the positioning hook 33*c* is locked to the first positioning hole 31*b*1 to reduce a distance between the sheet feeding roller 7 and a leading end of the uppermost sheet. By reducing the distance between the sheet feeding roller 7 and the leading end of the uppermost sheet in this way, the thin sheets can separated positively.

Figure 37:
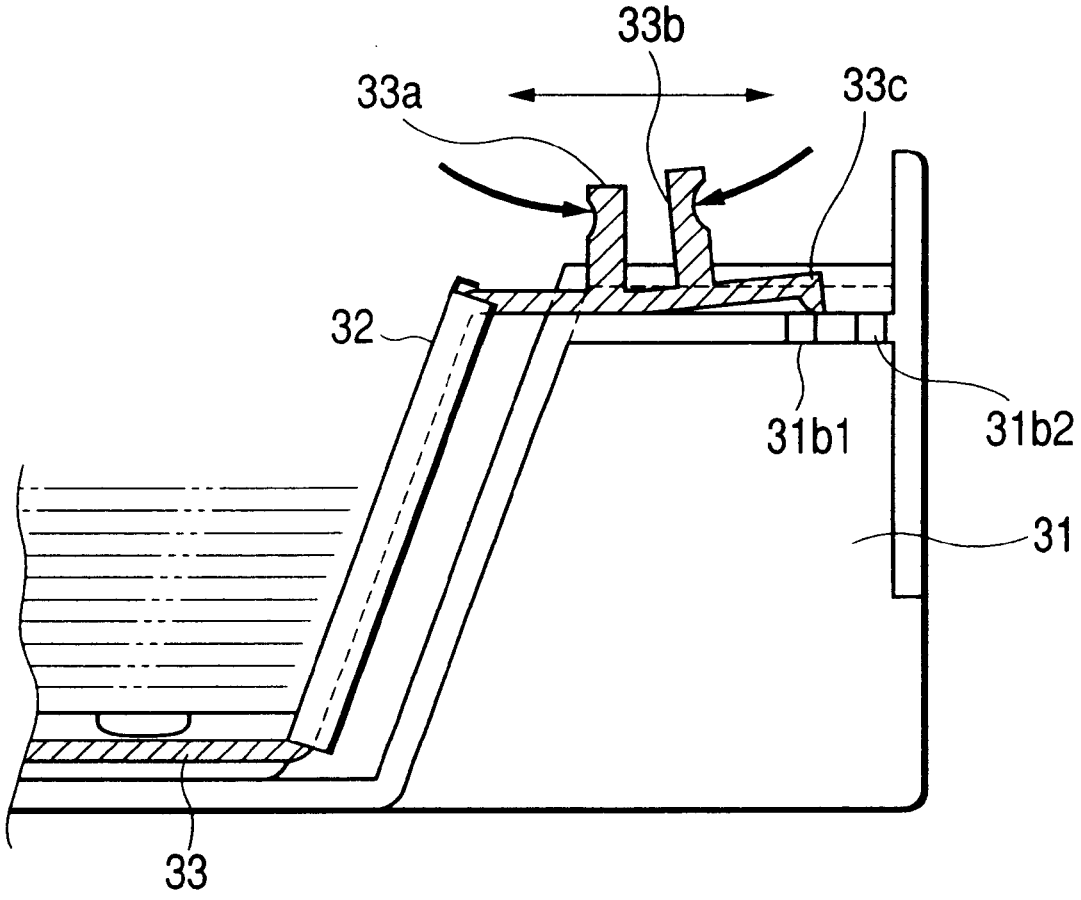
FIG. 37 is a view showing a setting changing operation of the sheet feeding apparatus of FIG. 36.

On the other hand, when the thick sheet is fed, after the sheet feeding tray 31 is drawn, by gripping the first and second grip portions 33*a*, 33*b*, as shown in FIG. 37, the positioning hook 33*c* is firstly removed from the first positioning hole 31*b*1, and then, the sheet holding member (the separating inclined surface 32) is shifted away from the sheet feeding roller 7 while gripping the first and second grip portions 33*a*, 33*b*.

Figure 38:
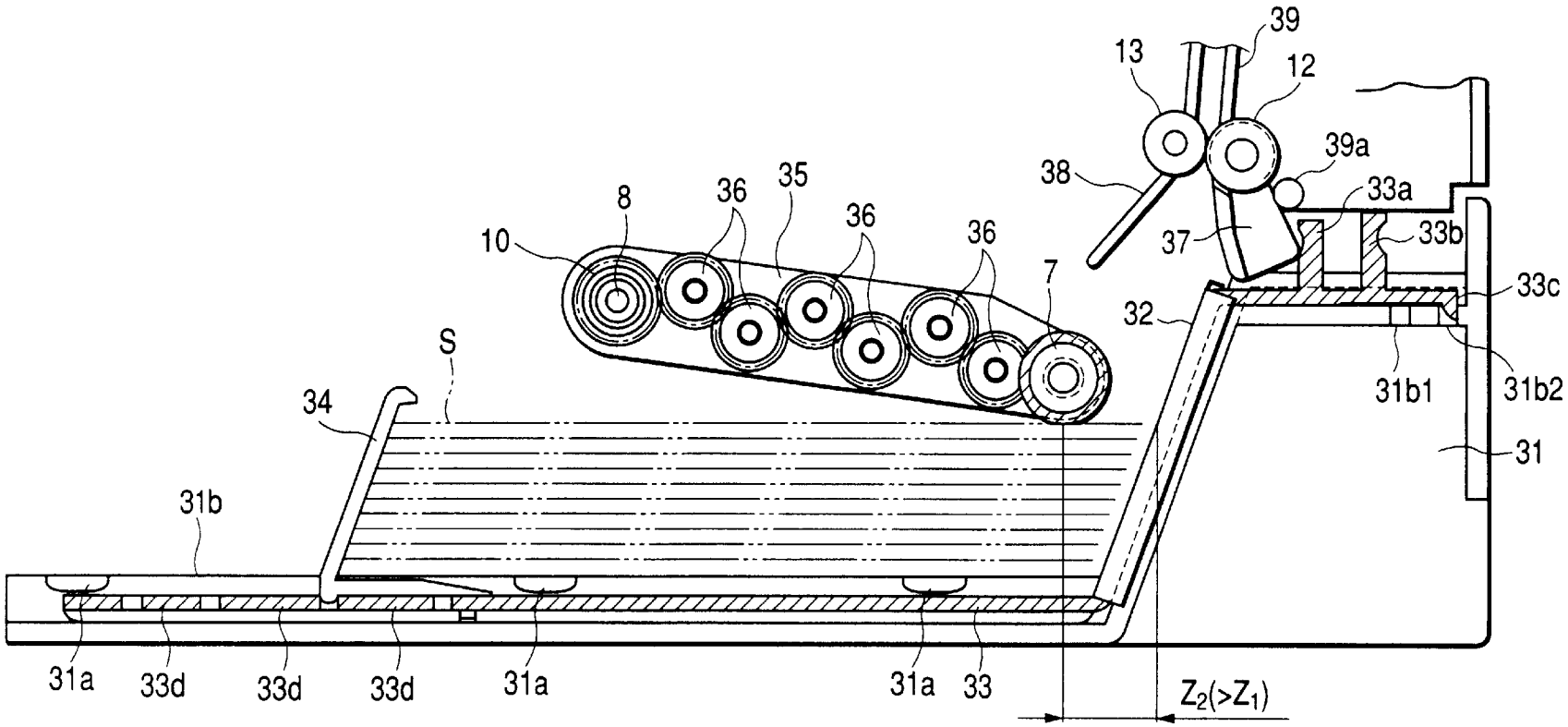
FIG. 38 is a view showing a setting condition of the sheet feeding apparatus of FIG. 36 when a thick sheet is fed.

And, lastly, as shown in FIG. 38, the positioning hook 33*c* is locked to the second positioning hole 31*b*2 to increase the distance between the sheet feeding roller 7 and the leading end of the uppermost sheet. By increasing the distance between the sheet feeding roller 7 and the leading end of the uppermost sheet in this way, the thick sheets can separated positively.

Incidentally, when the positioning hook 33*c* is locked to the second positioning hole 31*b*2 in this way, the first grip portion 33*a* is shifted away from the lower guide member 37. When the first grip portion 33*a* is shifted in this way, the lower guide member 37 is rotated to abut against the first grip portion 33*a* by the biasing force of the biasing means, as shown in FIG. 38. That is to say, the position of the lower guide member 37 is changed in synchronous with the shifting movement of the separating inclined surface 32.

Next, a sheet separating operation of the sheet feeding apparatus 1A having the above-mentioned construction will be explained.

When the sheet feeding is started, the driving shaft 8 and the driving gear 10 are rotated by a driving force from the driving mechanism (not shown). Such rotation is transmitted to the sheet feeding roller 7 through the idler gear of the sheet feeding roller arm 35, thereby starting rotation of the sheet feeding roller 7. Since the sheet feeding roller 7 abuts against the upper surface of the uppermost sheet S1 included in the sheet stack rested on the sheet stacking surface, by the rotation of the sheet feeding roller 7, the feeding force due to the friction force acts on the uppermost sheet S1.

In case of the thin sheet, since the sheet holding member 33 is set in the condition shown in FIG. 36, even if the feeding force is small, the uppermost sheet S1 is deformed along the separating inclined surface 32, and, after the sheet is advanced while being guided by the upper and lower guides 38, 37, the uppermost sheet is conveyed to an image forming apparatus (not shown) by the conveying roller 13 and the conveying sub-roller 12.

On the other hand, when the thick sheet is fed, after the sheet feeding tray 31 is firstly drawn, as shown in FIG. 37, the positioning hook 33*c* is removed from the first positioning hole 31*b*1 by gripping the first and second grip portions 33*a*, 33*b*, and then, the sheet holding member (the separating inclined surface 32) is shifted away from the sheet feeding roller 7 while gripping the first and second grip portions 33*a*, 33*b*, thereby locking the positioning hook 33*c* to the second positioning hole 31*b*2 as shown in FIG. 38.

When the positioning hook 33*c* is locked to the second positioning hole 31*b*2 in this way, the sheet holding member 33 is shifted to the position where the separating inclined surface 32 is spaced away from the sheet feeding roller 7, with the result that a distance Z2 from the contact point between the sheet feeding roller 7 and the sheet S to the leading end of the uppermost sheet is lengthened in comparison with a distance Z1 in the setting for feeding the thin sheet as shown in FIG. 36. Thus, the thick sheets can positively be separated.

By shifting the sheet holding member 33 in accordance with the thickness of the sheet in this way, the switching between the thin sheet feeding condition and the thick sheet feeding condition can be switched, thereby permitting the handling of various kinds of sheets.

Incidentally, when the positioning hook 33*c* is locked to the second positioning hole 31*b*2 in this way, since the lower guide member 37 is rotated to abut against the first grip portion 33*a*, more smooth sheet feeding can be achieved.

In the illustrated embodiment, while an example that the sheet holding member 33 is switched between two positions was explained, when the sheet holding member is switched between three or more positions, higher accurate sheet separation can be achieved. Further, when it is designed so that the angle of the separating inclined surface 32 with respect to the sheet stacking surface or the angle of the sheet stacking surface with respect to the horizontal plane is changed in synchronous with the switching operation of the sheet holding member 33, it is apparent that the effects inherent to the present invention can be more enhanced.

Next, a sixth embodiment of the present invention will be explained.

Figure 39:
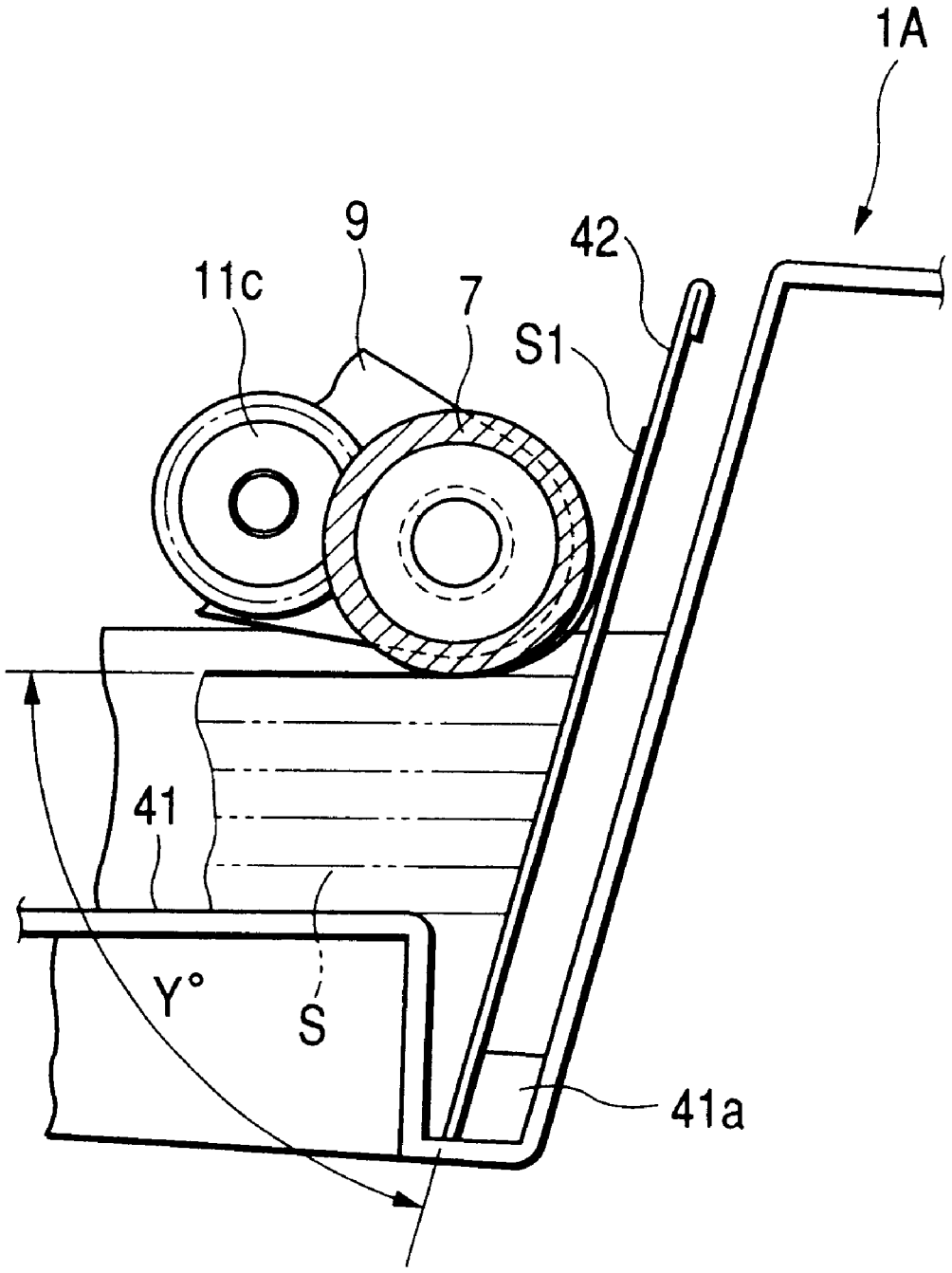
FIG. 39 is a view showing a large capacity sheet feeding apparatus according to a sixth embodiment of the present invention.

FIG. 39 is an enlarged view showing main parts of a sheet feeding apparatus according to the sixth embodiment. Incidentally, in FIG. 39, the same reference numerals as those shown in FIG. 1 designate the same or similar parts.

In FIG. 39, the sheet feeding apparatus includes a sheet feeding tray 41 detachably mounted to an image forming apparatus (not shown), a separating inclined surface 42 formed from flexible material such as spring stainless steel plate or spring bronze phosphate plate, and a holding portion 41*a* for fixing the separating inclined surface 42.

Figure 40:
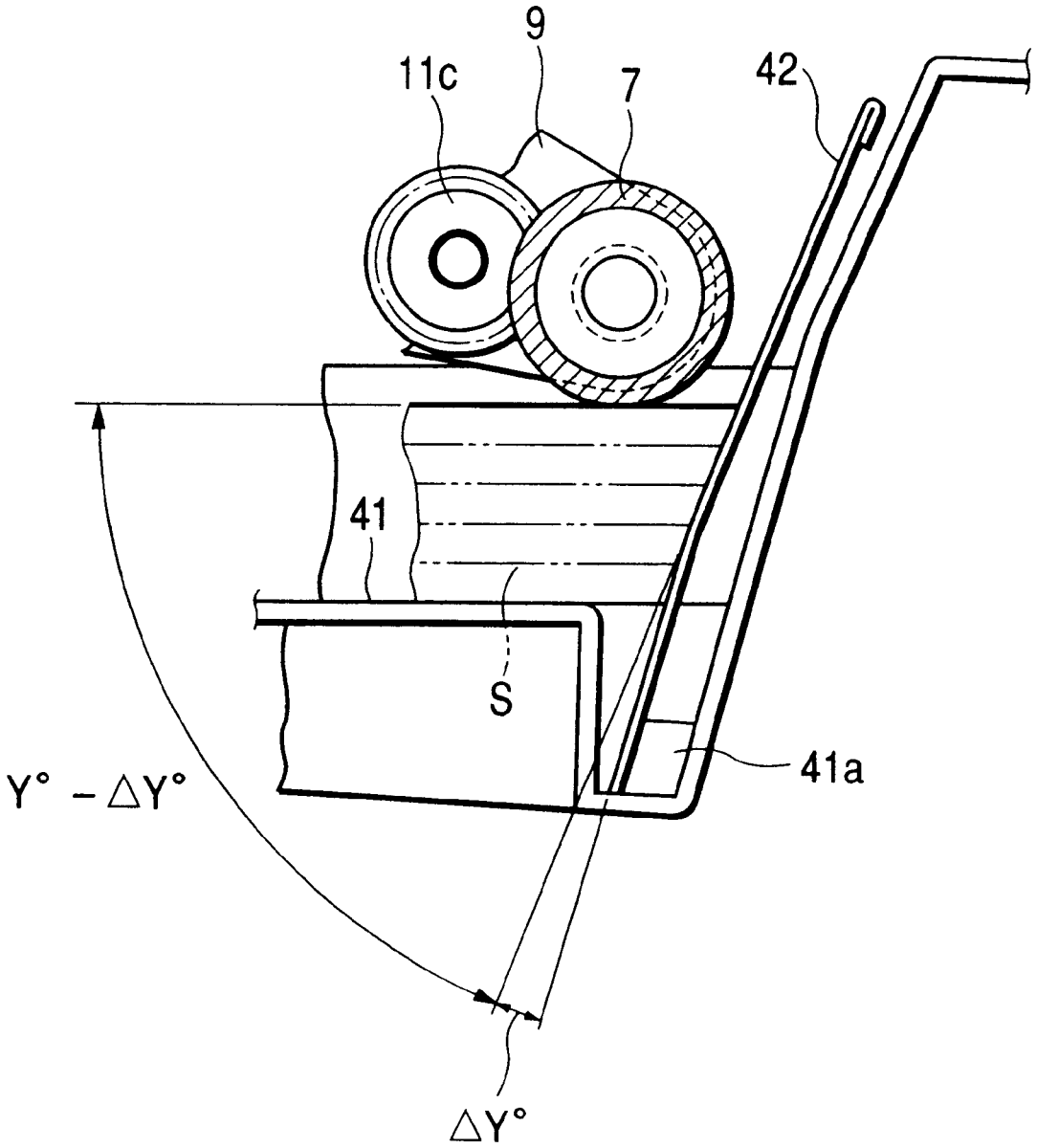
FIG. 40 is an enlarged view showing main parts of the sheet feeding apparatus of FIG. 39 in a condition that a thick sheet is fed.
Figure 41:
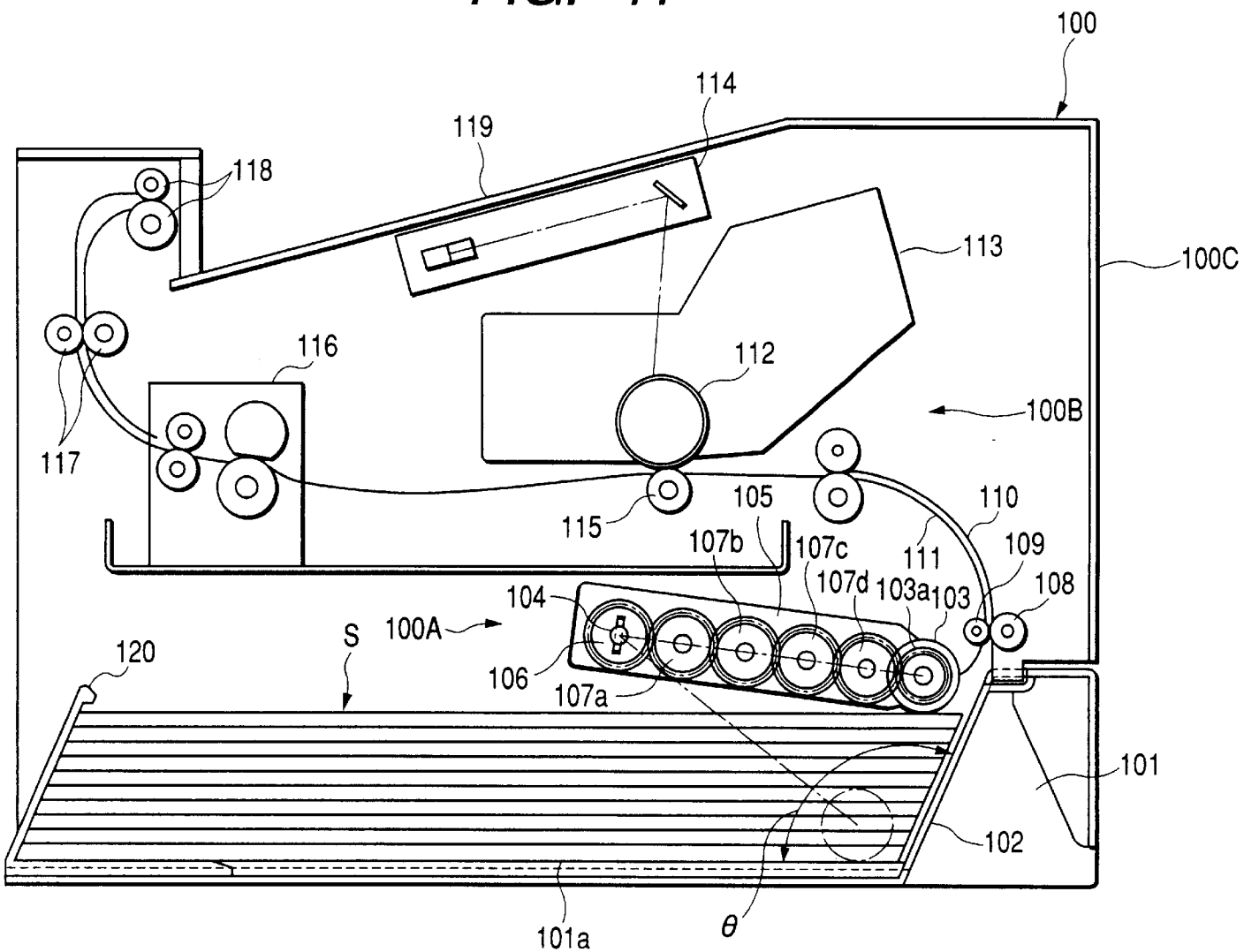
FIG. 41 is a schematic constructural view of an image forming apparatus having a conventional sheet feeding apparatus.
Figure 42:
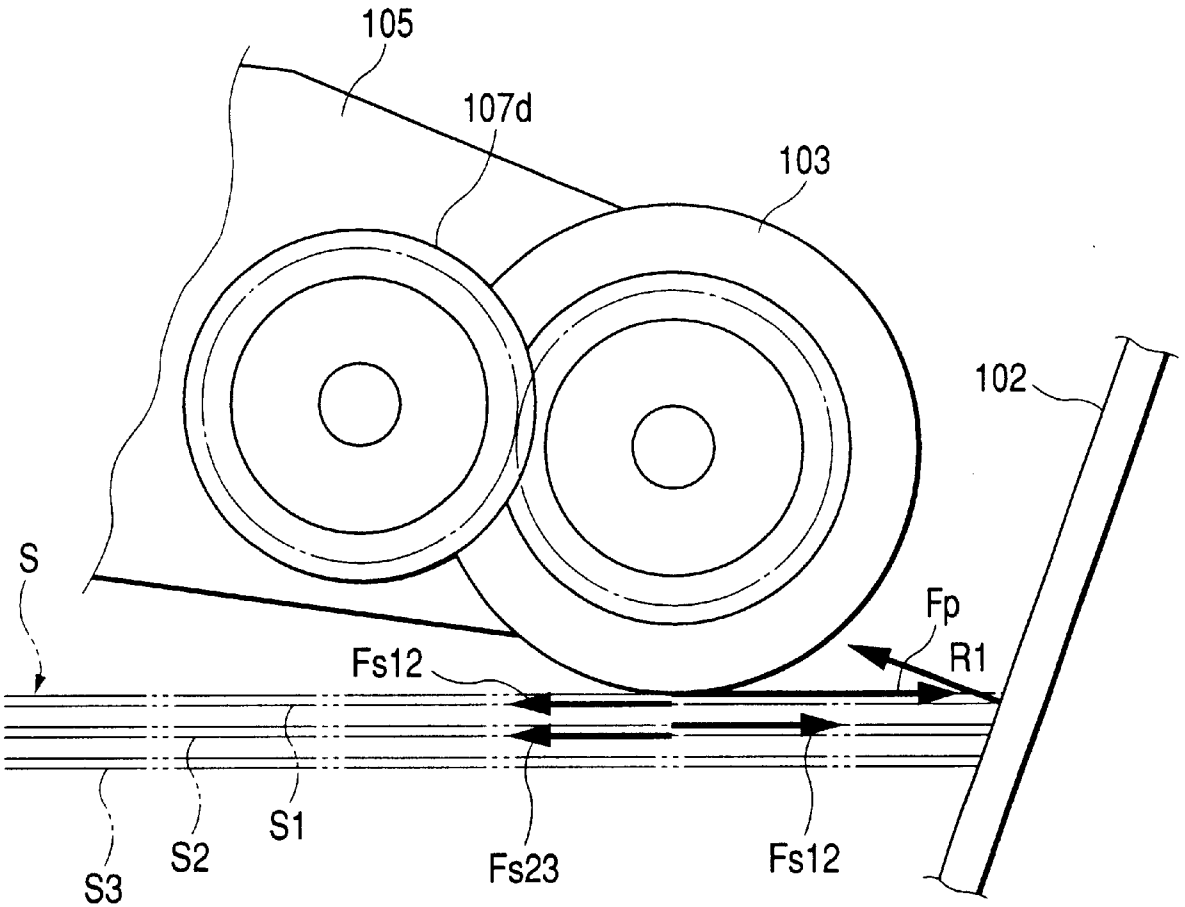
FIG. 42 is a view for explaining a sheet separating operation of the conventional sheet feeding apparatus.

In this embodiment, when a sheet having no rigidity such as a thin sheet is fed, as shown in FIG. 39, the separating inclined surface 42 is not almost flexed. On the other hand, when a sheet having great rigidity such as a thick sheet is fed, as shown in FIG. 40, the separating inclined surface 42 is flexed.

When the separating inclined surface 42 is flexed in this way, an angle between the separating inclined surface 42 and the sheet is reduced to ($Y°-\Delta Y°$) smaller than an initial setting value. As a result, a condition that the sheet can be fed more easily is established, thereby permitting the feeding of the thick sheet. With this arrangement, both the thick sheet feeding ability and the thin sheet double-feeding preventing ability become compatible by using simpler parts having less dimensional dispersion.

Incidentally, the present invention is not limited to the above-mentioned embodiments, but various combinations of the embodiments can be made within the scope of the invention.

What is claimed is:

1. A sheet feeding apparatus comprising:

sheet feeding means abutting against a sheet contained in sheet containing means to feed out the sheet; and a separating inclined surface disposed at an end on a sheet feeding side of the sheet containing means and inclined with respect to the sheet contained in the sheet containing means by a predetermined angle for separating and feeding the sheet fed out by said sheet feeding means one by one;

wherein said separating inclined surface is shiftable while maintaining the predetermined angle.

2. A sheet feeding apparatus comprising:

sheet feeding means abutting against a sheet contained in sheet containing means to feed out the sheet; and a separating inclined surface disposed at an end on a sheet feeding side of the sheet containing means and inclined with respect to the sheet contained in the sheet containing means by a predetermined angle for separating and feeding the sheet fed out by said sheet feeding means one by one;

wherein said separating inclined surface is shiftable along a sheet advancing direction in which the sheet is fed by said separating inclined surface.

3. A sheet feeding apparatus according to claim 2, wherein said separating inclined surface is provided shiftable in an advancing and retracting manner along the sheet advancing direction in a plane including a sheet abut surface of said separating inclined surface against which a leading end of the sheet abuts.

4. A sheet feeding apparatus according to claim 3, wherein said separating inclined surface is provided at an end on a sheet feeding side of a sheet containing portion of said sheet containing means, and said separating inclined surface is shiftably attached to a fixed inclined surface reference surface parallel with said sheet abut surface.

5. A sheet feeding apparatus according to claim 2, wherein said separating inclined surface is constituted by a first separating inclined surface, and a second separating inclined surface having coefficient of friction greater than that of said first separating inclined surface and shiftable along said first separating inclined surface and in the sheet advancing direction of the sheet fed out by said sheet feeding means, and said second separating inclined surface is constituted so as to be shifted from an initial position toward a downstream side in a sheet shifting direction along said first separating inclined surface by a force applied from the sheet fed out from said sheet containing means.

6. A sheet feeding apparatus according to claim 5, wherein said second separating inclined surface is protruded toward the sheet contained more than said first separating inclined surface or said second separating inclined surface is flush with said first separating inclined surface.

7. A sheet feeding apparatus according to claim 5, wherein said second separating inclined surface is concaved toward a direction opposite to the sheet contained more than said first separating inclined surface.

8. A sheet feeding apparatus according to claim 5, wherein a plurality of said first separating inclined surfaces are disposed in a width-wise direction of the sheet contained, and said second separating inclined surface is disposed between said first separating inclined surfaces.

9. A sheet feeding apparatus according to claim 2, wherein, when said separating inclined surface is shifted along the sheet advancing direction as the sheet to be fed is shifted, said separating inclined surface is provided to be gradually shifted away from a plane including the sheet abut surface of said separating inclined surface in an initial condition, against which the sheet abuts, toward a direction opposite to an installation position of said sheet feeding means in a condition that said sheet abut surface is in parallel with said plane.

10. A sheet feeding apparatus according to claim 9, wherein said separating inclined surface is provided at an end on a sheet feeding side of a sheet containing portion of said sheet containing means, and further comprising an inclined surface reference surface inclined from the plane including said sheet abut surface to a direction along which said separating inclined surface is spaced away from said sheet feeding means as advancing in the sheet advancing direction, wherein said separating inclined surface is provided on an inclined surface holding member shiftable along said inclined surface reference surface, and wherein said separating inclined surface is provided to be gradually shifted away from said plane including said sheet abut surface, toward the direction opposite to the installation position of said sheet feeding means in parallel with said plane, by said inclined surface holding member.

11. A sheet feeding apparatus according to claim 10, wherein said inclined surface reference surface is constituted by two stage surfaces parallel with and uneven with each other, and an inclined surface holding member for holding said separating inclined surface is slid on said two stage surfaces of said inclined surface reference surface.

12. A sheet feeding apparatus according to claim 9, wherein said separating inclined surface is constituted by a first separating inclined surface, and a second separating inclined surface having coefficient of friction greater than that of said first separating inclined surface and shiftable along said first separating inclined surface and in the sheet advancing direction of the sheet fed out by said sheet feeding means, and said second separating inclined surface is constituted so as to be shifted from an initial position toward a downstream side in a sheet shifting direction along said first separating inclined surface by a force applied from the sheet fed out from said sheet containing means.

13. A sheet feeding apparatus according to claim 12, wherein, in the initial position, said second separating inclined surface is provided to protrude toward the sheet contained more than said first separating inclined surface, and said second separating inclined surface can be shifted from the protruded position to a position retracted away from the sheet contained more than said first separating inclined surface.

14. A sheet feeding apparatus according to claim 12, wherein, as said second separating inclined surface is shifted toward the downstream side in the sheet shifting direction along said first separating inclined surface, said second separating inclined surface is spaced apart from the sheet contained non-linearly.

15. A sheet feeding apparatus according to claim 14, further comprising:

an inclined surface holding member or holding said second separating inclined surface;

a base member for shiftably holding said second separating inclined surface via said inclined surface holding member; and an arcuate elongated hole provided in said base member and by which a boss provided on said inclined surface holding member is slidably engaged;

wherein as said second separating inclined surface is shifted toward the downstream side in the sheet shifting direction along said first separating inclined surface, said second separating inclined surface is spaced apart from the sheet contained non-linearly.

16. A sheet feeding apparatus according to claim 9, wherein a plurality of said separating inclined surfaces are provided in a width-wise direction of the sheet, and a fixed inclined surface member fixed in a condition concaved from said sheet abut surfaces of said separating inclined surfaces in parallel with said sheet abut surfaces in the initial condition is disposed between said plurality of separating inclined surfaces.

17. A sheet feeding apparatus according to claim 16, wherein a resistance force applied from a surface of said fixed inclined surface member to a leading end of the sheet to be separated is smaller than a resistance force applied from said separating inclined surface.

18. A sheet feeding apparatus according to claim 16, wherein said fixed inclined surface member is gradually protruded more than said sheet abut surfaces of said separating inclined surface when said separating inclined surface is shifted from the initial position together with the sheet.

19. A sheet feeding apparatus according to claim 2, wherein said separating inclined surface is constituted so as to start to shift together with the sheet from an initial position when a predetermined force from the sheet fed out from said sheet feeding means acts on said separating inclined surface.

20. A sheet feeding apparatus according to claim 19, wherein, when said separating inclined surface is shifted by the force from the sheet, said separating inclined surface is returned to the initial position by own weight.

21. A sheet feeding apparatus according to claim 19, further comprising an elastic member for returning said separating inclined surface to the initial position when the shifting movement is started.

22. A sheet feeding apparatus according to claim 2, further comprising regulating means for holding said separating inclined surface shifted to a predetermined position together with the sheet.

23. A sheet feeding apparatus according to claim 22, wherein said sheet containing means is detachably contained within a main body of the apparatus, and a holding operation of said regulating means is released in synchronous with a detaching operation of said sheet containing means.

24. A sheet feeding apparatus according to claim 2, wherein said sheet containing means utilizes a lifter-type intermediate plate capable of being lifted and lowered while keeping a posture angle constant.

25. A sheet feeding apparatus according to claim 24, wherein said separating inclined surface and means for shiftably supporting said separating inclined surface are provided on a side of a front door unit which is opened and closed upon replenishment of sheet.

26. A sheet feeding apparatus according to claim 24, wherein said lifter-type intermediate plate is inclined so that a side where said separating inclined surface is disposed so as to be positioned above in a vertical direction.

27. An image forming apparatus comprising:

sheet feeding means abutting against a sheet contained in sheet containing means to feed out the sheets;

a separating inclined surface disposed at an end on a sheet feeding side of the sheet containing means and inclined with respect to the sheet contained in the sheet containing means by a predetermined angle for separating and feeding the sheet fed out by said sheet feeding means one by one; and an image forming portion for forming an image on the sheet separated by said separating inclined surface;

wherein said separating inclined surface is shiftable along a sheet advancing direction in which the sheet is fed by said separating inclined surface.

* * * * *

UNITED STATES PATENT AND TRADEMARK OFFICE

CERTIFICATE OF CORRECTION

PATENT NO. : 6,502,816 B2
DATED : January 7, 2003
INVENTOR(S) : Ryukichi Inoue et al.

It is certified that error appears in the above-identified patent and that said Letters Patent is hereby corrected as shown below:

Column 1,
Line 42, “an” should read -- a --.

Column 2,
Line 16, “synchronous” should read -- synchronism --.

Column 4,
Line 43, “view” should read -- views --.

Column 6,
Line 7, “arm 8” should read -- arm 9 --.

Column 7,
Line 43, “he” should read -- the --.

Column 9,
Line 1, “an” should read -- a --.

Column 12,
Line 57, “as” should read -- as in --.

Column 19,
Line 7, “guide” should read -- guided --.
Line 37, “synchronous” should read -- synchronism --.

Column 22,
Line 66, “can” should read -- can be --.

Column 23,
Line 14, “can” should read -- can be --.
Line 23, “synchronous” should read -- synchronism --.

Column 24,
Line 15, “synchronous” should read -- synchronism --.

UNITED STATES PATENT AND TRADEMARK OFFICE

CERTIFICATE OF CORRECTION

PATENT NO. : 6,502,816 B2 
DATED : January 7, 2003
INVENTOR(S) : Ryukichi Inoue et al.

It is certified that error appears in the above-identified patent and that said Letters Patent is hereby corrected as shown below:

Column 26,
Line 38, “or” should read -- for --.

Column 27,
Line 24, “synchronous” should read -- synchronism --.

Column 28,
Line 7, “of” should read -- of the --.

Signed and Sealed this

Fifteenth Day of July, 2003

JAMES E. ROGAN
*Director of the United States Patent and Trademark Office*